US007445396B2

(12) United States Patent
Cheng

(10) Patent No.: US 7,445,396 B2
(45) Date of Patent: Nov. 4, 2008

(54) HANGABLE RING MECHANISM

(75) Inventor: Hung Yu Cheng, Hong Kong (CN)

(73) Assignee: World Wide Stationery Mfg. Co., Ltd., Kwai Chung, New Territory (HK)

( * ) Notice: Subject to any disclaimer, the term of this patent is extended or adjusted under 35 U.S.C. 154(b) by 0 days.

(21) Appl. No.: 11/623,192

(22) Filed: Jan. 15, 2007

(65) Prior Publication Data

US 2008/0170905 A1 Jul. 17, 2008

(51) Int. Cl.
*B42F 13/02* (2006.01)

(52) U.S. Cl. ..... 402/19; 402/4; 402/26; 402/80 R

(58) Field of Classification Search ..... 402/4, 402/18, 19, 20, 26, 31, 70, 73, 56, 80 R; D19/26, D19/27; 229/67.2; 312/183, 184; 211/42, 211/45, 46, 113
See application file for complete search history.

(56) References Cited

U.S. PATENT DOCUMENTS

| | | | | | |
|---|---|---|---|---|---|
| 2,256,847 | A | | 9/1941 | Osenberg | |
| 2,715,906 | A | * | 8/1955 | Lucchesi | 402/20 |
| 3,190,293 | A | * | 6/1965 | Schneider et al. | 402/30 |
| 3,910,708 | A | | 10/1975 | Rohner | |
| 3,993,374 | A | * | 11/1976 | Schudy et al. | 312/184 |
| 4,006,992 | A | | 2/1977 | Persson | |
| 4,056,296 | A | * | 11/1977 | Hedstrom et al. | 312/184 |
| 4,239,411 | A | | 12/1980 | Moliard | |
| 4,441,834 | A | * | 4/1984 | Cardellini | 402/55 |
| 4,445,799 | A | * | 5/1984 | Wright et al. | 402/4 |
| 4,708,509 | A | * | 11/1987 | Brunett | 402/4 |
| 4,815,882 | A | | 3/1989 | Ohminato | |
| 4,904,103 | A | * | 2/1990 | Im | 402/35 |
| 4,932,804 | A | | 6/1990 | Richards | |
| 5,085,542 | A | | 2/1992 | Nakayama et al. | |
| 5,199,809 | A | * | 4/1993 | Semerjian | 402/4 |
| 5,683,193 | A | | 11/1997 | Cerri | |

(Continued)

FOREIGN PATENT DOCUMENTS

| | | |
|---|---|---|
| DE | 307283 | 8/1918 |

(Continued)

OTHER PUBLICATIONS

European Search Report for EP04258198 dated Oct. 20, 2005, 2 pages.

*Primary Examiner*—Derris H Banks
*Assistant Examiner*—Jamila Williams
(74) *Attorney, Agent, or Firm*—Senniger Powers LLP

(57) ABSTRACT

A ring mechanism is selectively configurable between an open configuration in which loose leaf pages can be added or removed from the mechanism and a closed configuration in which loose leaf pages are retained by the ring mechanism. Ring mechanism including an elongate frame having first and second frame elements. A hinge pin interconnects the first and second frame elements to permit pivoting movement of the frame elements relative to each other. At least one ring includes a first ring member mounted on the first frame element and a second ring member mounted on the second ring element. At least one hanging member is mounted on the frame for releasably hanging the ring mechanism from a support and inhibiting longitudinal movement of the hanging member relative to the support.

20 Claims, 51 Drawing Sheets

U.S. PATENT DOCUMENTS

| | | | | |
|---|---|---|---|---|
| 6,000,873 | A | 12/1999 | Burton | |
| 6,036,394 | A * | 3/2000 | Cheng | 402/26 |
| 6,168,338 | B1 | 1/2001 | Young | |
| 6,626,602 | B1 * | 9/2003 | Yuen | 402/73 |
| 2006/0024124 | A1 | 2/2006 | Cheng | |

FOREIGN PATENT DOCUMENTS

| | | |
|---|---|---|
| DE | 507415 | 9/1930 |
| JP | 60127973 | 8/1985 |

* cited by examiner

HANGABLE RING MECHANISM

BACKGROUND OF THE INVENTION

This invention relates to ring mechanisms for holding loose leaf pages, and in particular to a hangable ring mechanism.

A typical ring mechanism retains loose-leaf pages, such as loose-leaf papers, in a file or notebook. The mechanism generally features multiple rings, each including two half ring members capable of selectively opening to add or remove papers, or selectively closing to retain papers and allow them to move along the rings. The ring members are typically mounted on an elongate housing or frame for movement between the open and closed position. Most commonly, the ring members are mounted on respective hinge plates supported by the frame. However, the frame is typically riveted or otherwise attached to the spine of the ring binder cover. The ring binder covers are not suited for attaching to a support.

Loose-leaf papers can also be retained in folders. In one known configuration, the folders have spaced hangers for supporting the folder between two supports (i.e., hanging file folders). While the folders are adapted to hold loose-leaf pages, the pages are merely placed in the folder. Thus, the order of the loose-leaf pages relative to other loose-leaf pages in the folder is not positively maintained by the folder.

SUMMARY OF THE INVENTION

A ring mechanism for retaining loose leaf pages is selectively configurable between an open configuration in which loose leaf pages can be added or removed from the mechanism and a closed configuration in which loose leaf pages are retained by the ring mechanism. The ring mechanism is supportable on at least one support member. The ring mechanism comprises an elongate frame having a longitudinal axis and comprising an elongate first frame element and an elongate second frame element separate from the first frame element. A hinge pin interconnects the first and second frame elements to permit pivoting movement of the frame elements relative to each other about an axis extending one of parallel to and coaxial with the longitudinal axis of the frame between a first position corresponding to the closed configuration of the ring mechanism and a second position different from the first position and corresponding to the open configuration of the ring mechanism. At least one ring comprises a first ring member mounted on the first frame element and a second ring member mounted on the second ring element such that in the first position of the frame elements corresponding to the closed configuration of the ring mechanism the first and second ring members together form a substantially continuous, closed loop for allowing loose-leaf pages retained by the ring to be moved along the ring from one ring member to the other, and in the second position of the frame elements corresponding to the open configuration of the ring mechanism the ring members are spaced from each other to form a discontinuous, open loop for adding or removing loose-leaf pages from the ring. At least one hanging member is mounted on the frame for releasably hanging the ring mechanism from the support. The hanging member is configured to inhibit longitudinal movement of the hanging member relative to the support.

Other objects and features will be in part apparent and in part pointed out hereinafter.

BRIEF DESCRIPTION OF THE DRAWINGS

Corresponding reference characters indicate corresponding parts throughout the views of the drawings.

DESCRIPTION OF THE PREFERRED EMBODIMENTS

Figure 1:
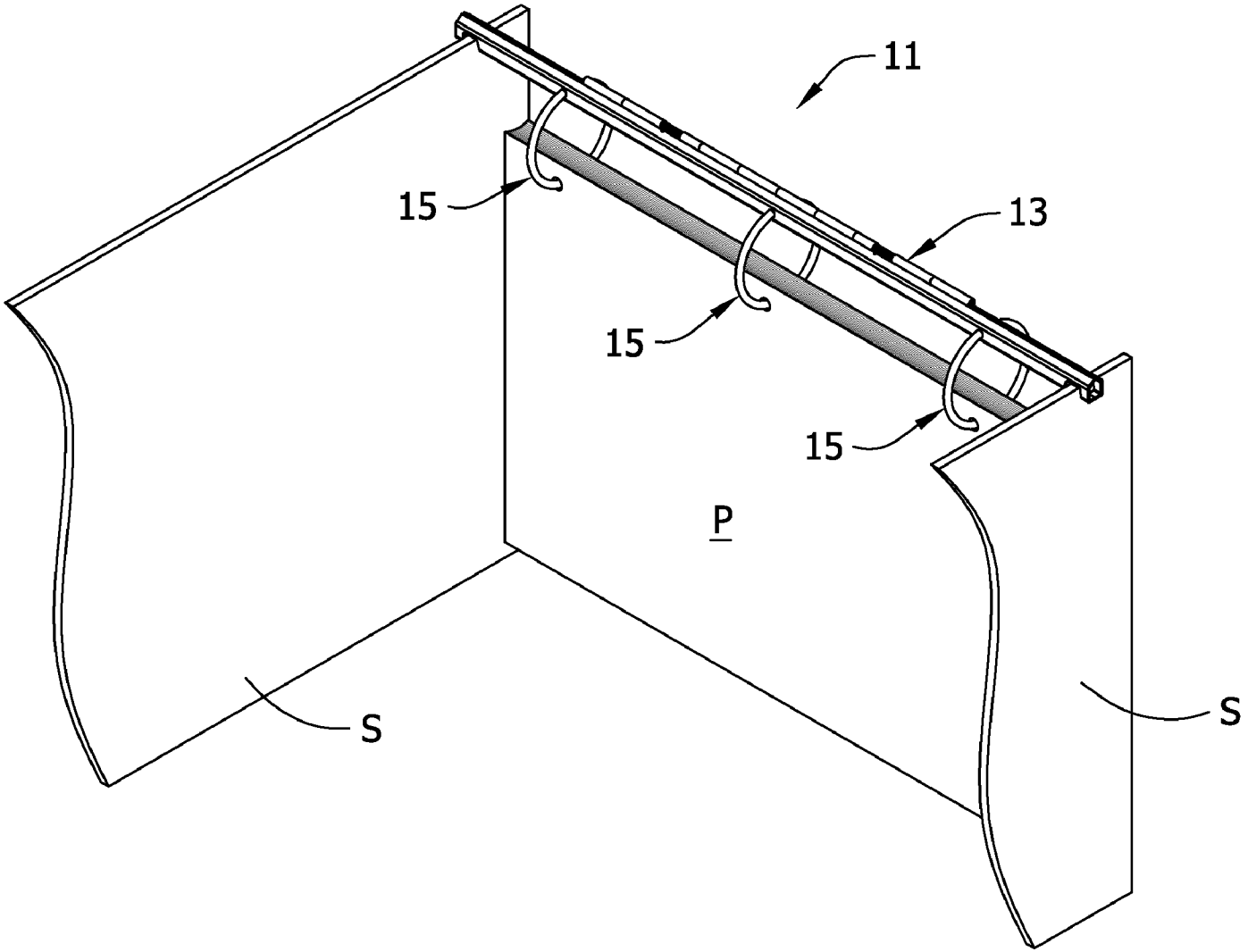
FIG. 1 is a perspective of a hangable ring mechanism hanging from a support.

Referring now to the drawings and in particular to FIGS. 1-6, a hangable ring mechanism for retaining loose-leaf pages P is indicated generally at 11. As illustrated in FIG. 1, the ring mechanism 11 is adapted to be supported by two spaced supports S so that the loose-leaf pages P retained by the mechanism hang downward from the mechanism between the supports. The supports S, for example, can be opposite sides of a box, opposite sides of a desk drawer, opposite sides of a file drawer, or spaced rods. It is understood that other types of supports can be used to support the ring mechanism 11.

The mechanism 11 comprises a frame, generally indicated at 13, and three rings, each generally indicated at 15. The frame 13, which is elongate and has a roughly rectangular cross-section, comprises first and second hinge elements. In the illustrated embodiment, the hinge elements comprise a first frame element 19 and a second frame element 21, respectively (FIGS. 2-6). The first and second frame elements 19, 21 cooperatively define an interior space of the frame 13. As shown in FIG. 6, each of the frame elements 19, 21 has a web 23, an outer flange 25, and an inner flange 26. The outer flanges 25 of the elements 19, 21 extend angularly outward from respective outer edges of the web 23 such that an angle between the outer flange and the web is about 90 degrees. In the illustrated configuration, the inner flanges 26 of the elements 19, 21 extend angularly outward from respective outer edges of the web 23 opposite the outer flanges 25 such that an angle between the inner flange and the web is greater than 90 degrees.

Figure 3:
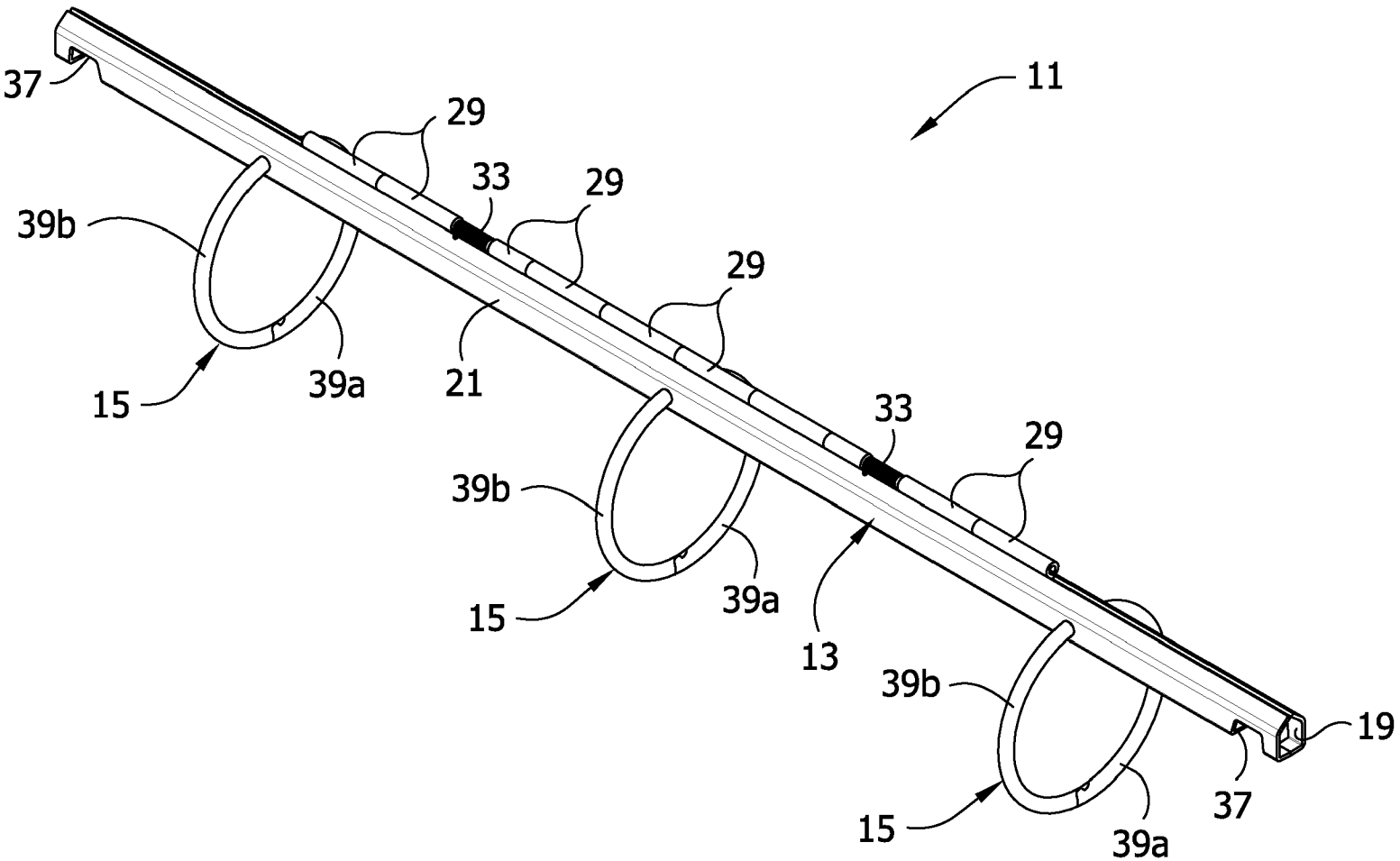
FIG. 3 is bottom side perspective of the ring mechanism.
Figure 4:
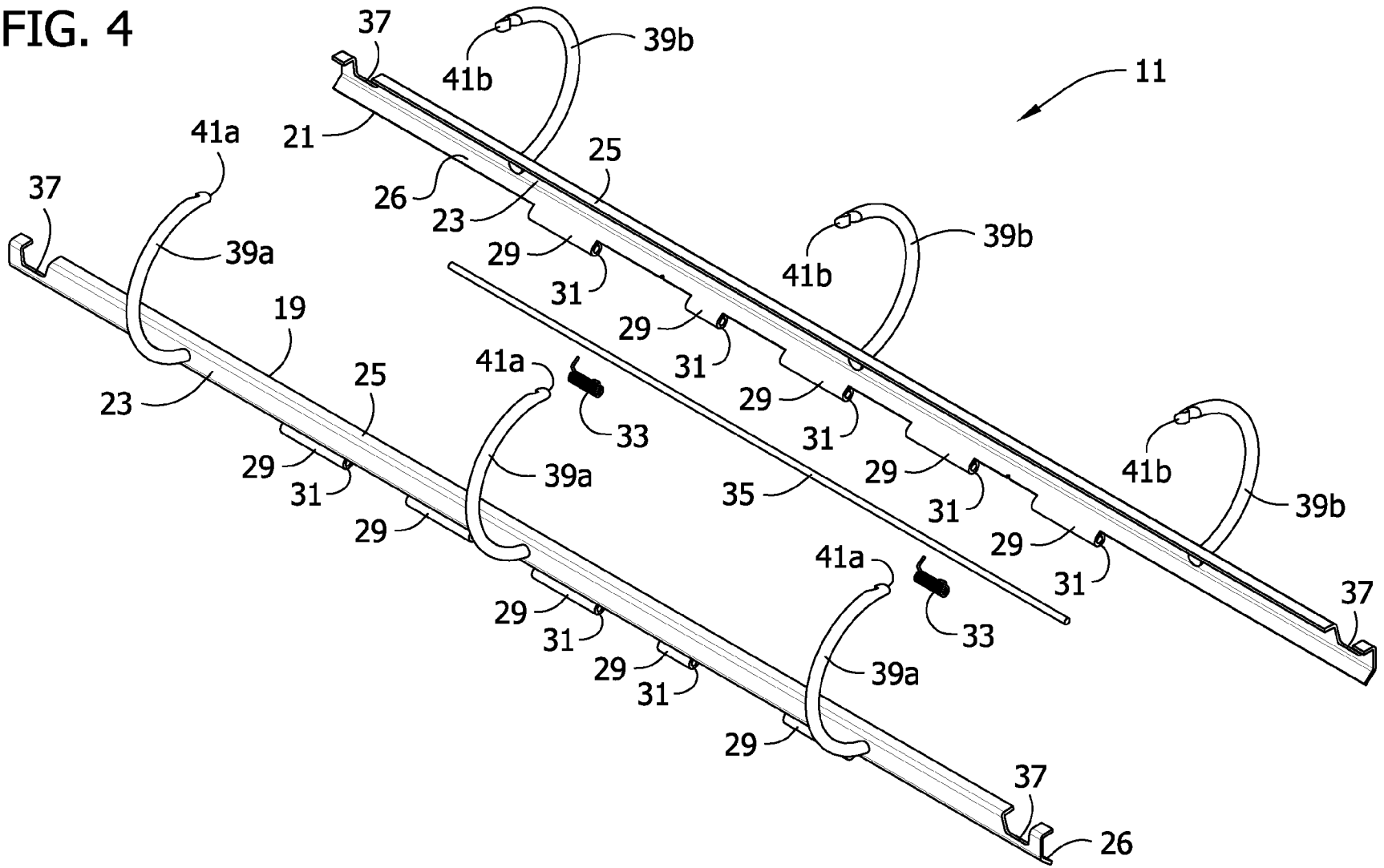
FIG. 4 is an exploded perspective of the ring mechanism.

Referring to FIGS. 3 and 4, a plurality of spaced knuckles 29 with passages 31 extend outwardly from the inner flanges 26 of each of the webs 23. In the illustrated configuration, the first frame element 19 has five knuckles 29, and the second frame element 21 has five knuckles 29 offset from the knuckles of the first frame element. More specifically, the knuckles 29 of the first and second elements 19, 21 are offset from each other so that knuckles can be placed adjacent each other and the passages 31 of knuckles aligned coaxially along a common longitudinal axis. Coil torsion springs 33 (broadly, "biasing members") are also aligned with the knuckles 29 of the first and second frame elements 19, 21.

A hinge pin 35 is received in the passages 31 of the aligned knuckles 29 and the springs 33 to hinge the first and second frame elements 19, 21 to each other. As illustrated in FIG. 3, the knuckles 29, hinge pin 35, and majority of the springs 33 are located outside of the frame 13. It is understood that the frame elements 19, 21 can have more or fewer knuckles 29 and that the knuckles can have different configurations. Opposite ends of the coil torsion springs 33 engage opposite ones of the first and second frame members 19, 21 to bias the frame members away from each other about the hinge pin 35. The illustrated configuration has two coil torsion springs 33 but it is understood that other types or number of biasing members can be used.

Figure 2:
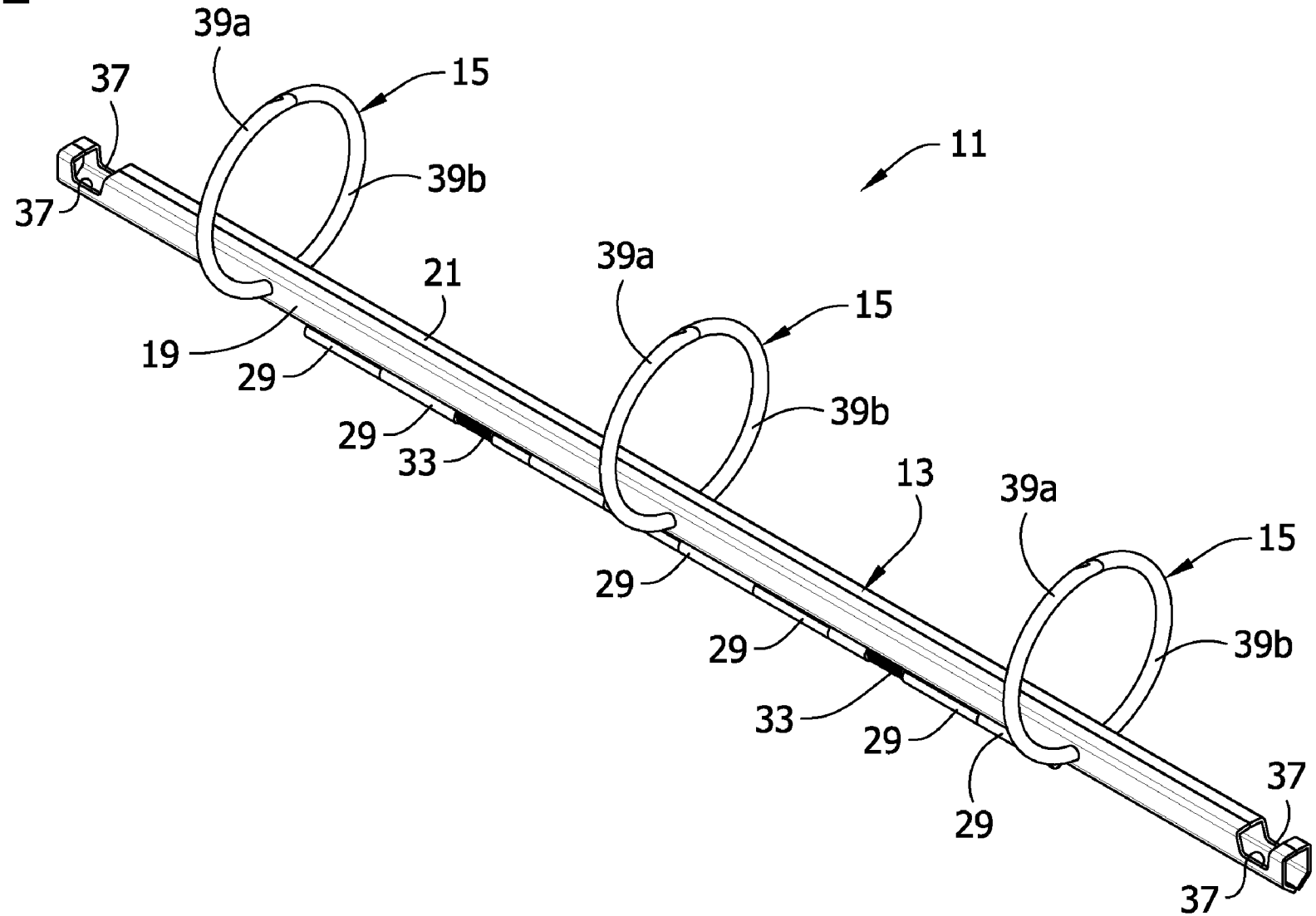
FIG. 2 is a top side perspective of the ring mechanism.

Referring now to FIGS. 2 and 4, each of the frame elements 19, 21 include generally U-shaped cutouts 37 just inward of the longitudinal ends of the frame such that the end portions of the frame that include the cutouts broadly define longitudinally spaced hanging members. Each of the cutouts 37 extends through the respective outer flange 25 and a majority of the respective web 23. The cutouts 37 are sized and shaped for receiving portions of the supports S to positively seat the mechanism 11, and more particularly the hanging members, on the supports (FIG. 1) in a downward facing position. The generally rectangular nature of the frame at these cutouts 37 inhibits pivotal (e.g., rocking) movement of the ring mechanism 11 relative to the supports S while allowing sliding movement of the mechanism along the supports. It is understood that other types of hanging members can be used to hang the mechanism on the supports.

In the illustrated configuration, each of the frame elements 19, 21 are formed from a single-piece of sheet metal but it is understood that the elements can be made materials other than sheet metal (e.g., plastic). Moreover, it is understood that the components of the respective frame elements 19, 21 (e.g., the webs 23, the outer flanges 25, and the inner flanges 26) can be formed as separate pieces that are assembled to form the frame elements.

Each of the three rings 15 comprises a first ring member 39*a* mounted on the first frame element 19 and a second ring member 39*b* mounted on the second frame element 21. In the illustrated configuration, the ring members 39*a*, 39*b* are welded to the respected frame element 19, 21 but it is understood that the ring members can be attached to the frame members in other ways. Respective free ends of the first and second ring members 39*a*, 39*b* include hook-shaped formations 41*a*, 41*b* shaped to interlock when the ring members are closed. More specifically, each of the hook-shaped formations includes a tapered portion and a catch (e.g., a notch) spaced inward from the tapered portion. The catches of respective ring members 39*a*, 39*b* are adapted to selectively hold the ring members together. The hook-shaped formations 41*a*, 41*b* may be broadly and collectively referred to as an interlocking formation.

The ring members 39*a*, 39*b* in one embodiment are suitably formed of a conventional, cylindrical rod, such as a steel rod. It is understood, however, that ring members having a different cross section or ring members made of different material may be used without departing from the scope of the present invention. In addition, ring mechanisms with more or fewer than three rings or with rings that form other shapes, such as "D" or slanted "D" shapes, when the ring members are closed, do not depart from the scope of this invention.

The ring mechanism 11 is selectively configurable between an open configuration in which loose leaf pages P can be added or removed from the mechanism (FIG. 6), and a closed configuration in which loose leaf pages are retained by the ring mechanism (FIG. 2). Particularly, the hinge pin 35 interconnecting the first and second frame elements 19, 21 permits pivoting movement of the frame elements relative to each other about an axis extending one of parallel to and coaxial with the longitudinal axis of the frame 13 between a first position (FIGS. 2 and 5) corresponding to the closed configuration of the ring mechanism 11 and a second position (FIG. 6) different from the first position and corresponding to the open configuration of the ring mechanism. Since the ring members 39*a*, 39*b* are mounted on respective frame elements 19, 21, the ring members pivot conjointly with the frame elements. As a result, in the first position of the frame elements 19, 21, which corresponds to the closed configuration of the ring mechanism 11, the first and second ring members 39*a*, 39*b* are engaged together to form a substantially continuous, closed loop for allowing loose-leaf pages P retained by the ring 15 to be moved along the ring from one ring member to the other. In the second position of the frame elements 19, 21, which corresponds to the open configuration of the ring mechanism 11, the ring members 39*a*, 39*b* are spaced from each other to form a discontinuous, open loop for adding or removing loose-leaf pages P from the ring 15. In the illustrated embodiment both frame elements 19, 21 can move, but mechanisms having one movable frame element and one fixed frame element do not depart from the scope of this invention.

Figure 5:
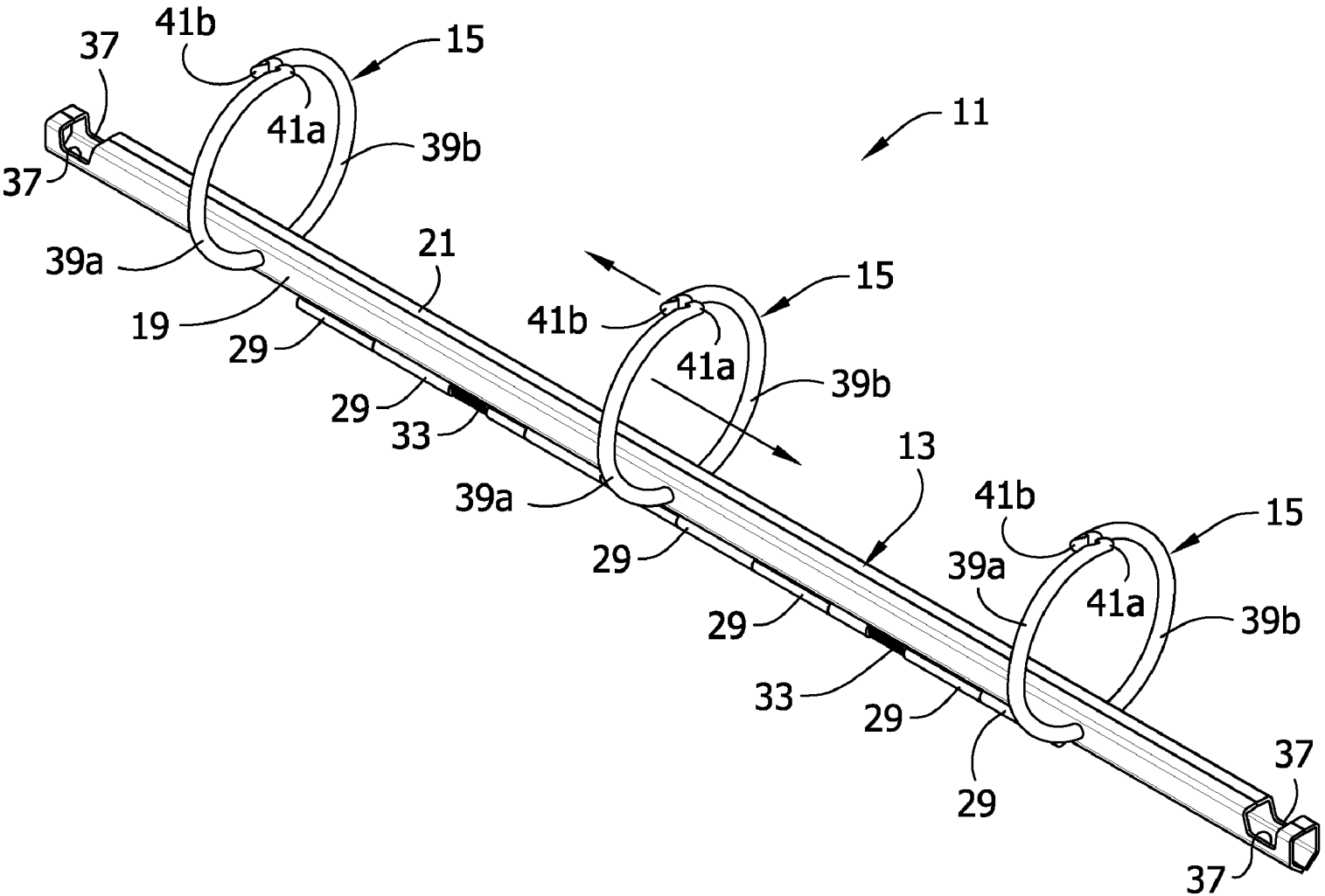
FIG. 5 is a perspective similar to FIG. 2 but showing ring members in an unlocked position.
Figure 6:
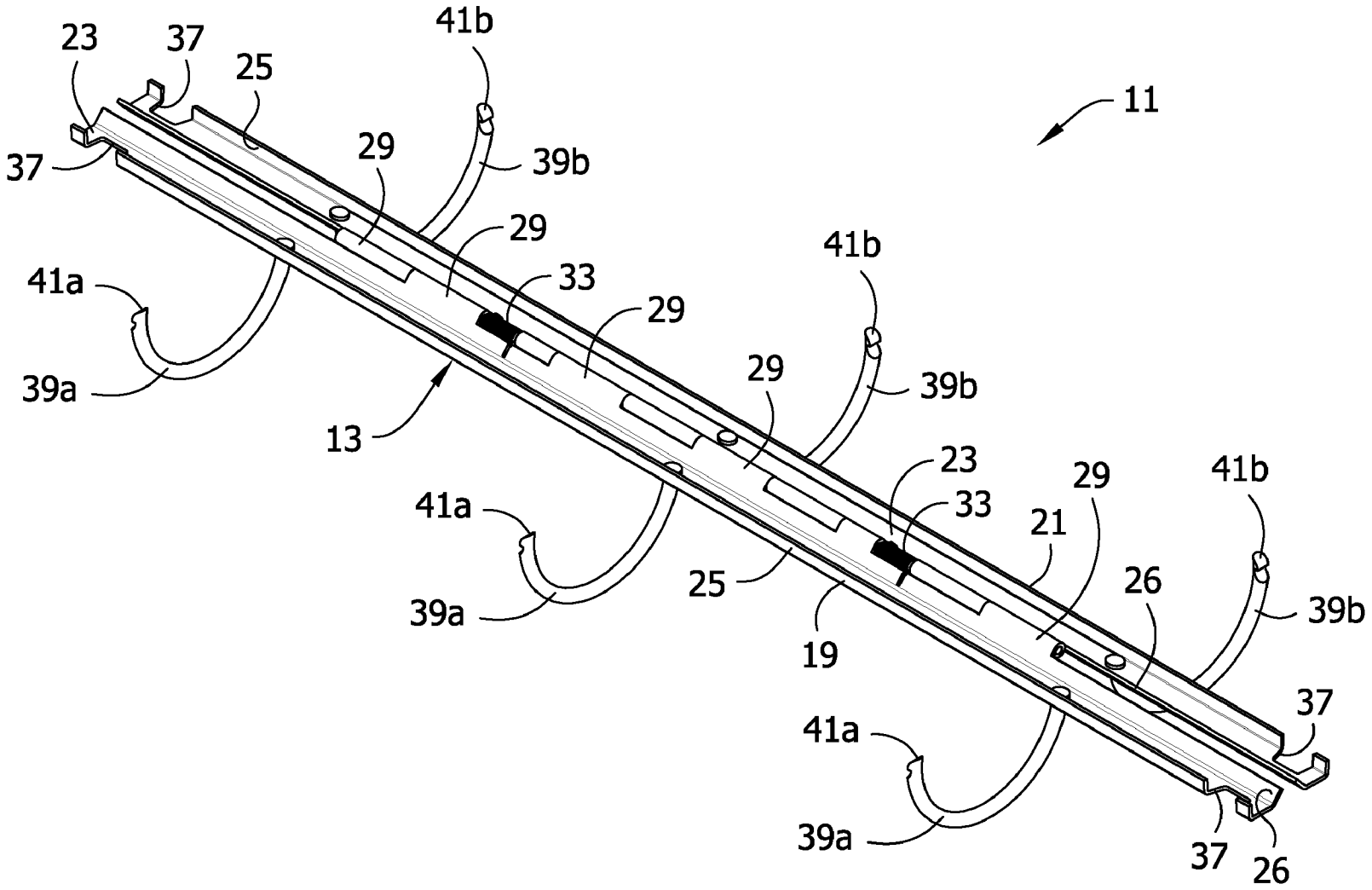
FIG. 6 is a top side perspective of the ring mechanism in an open position.
Figure 7:
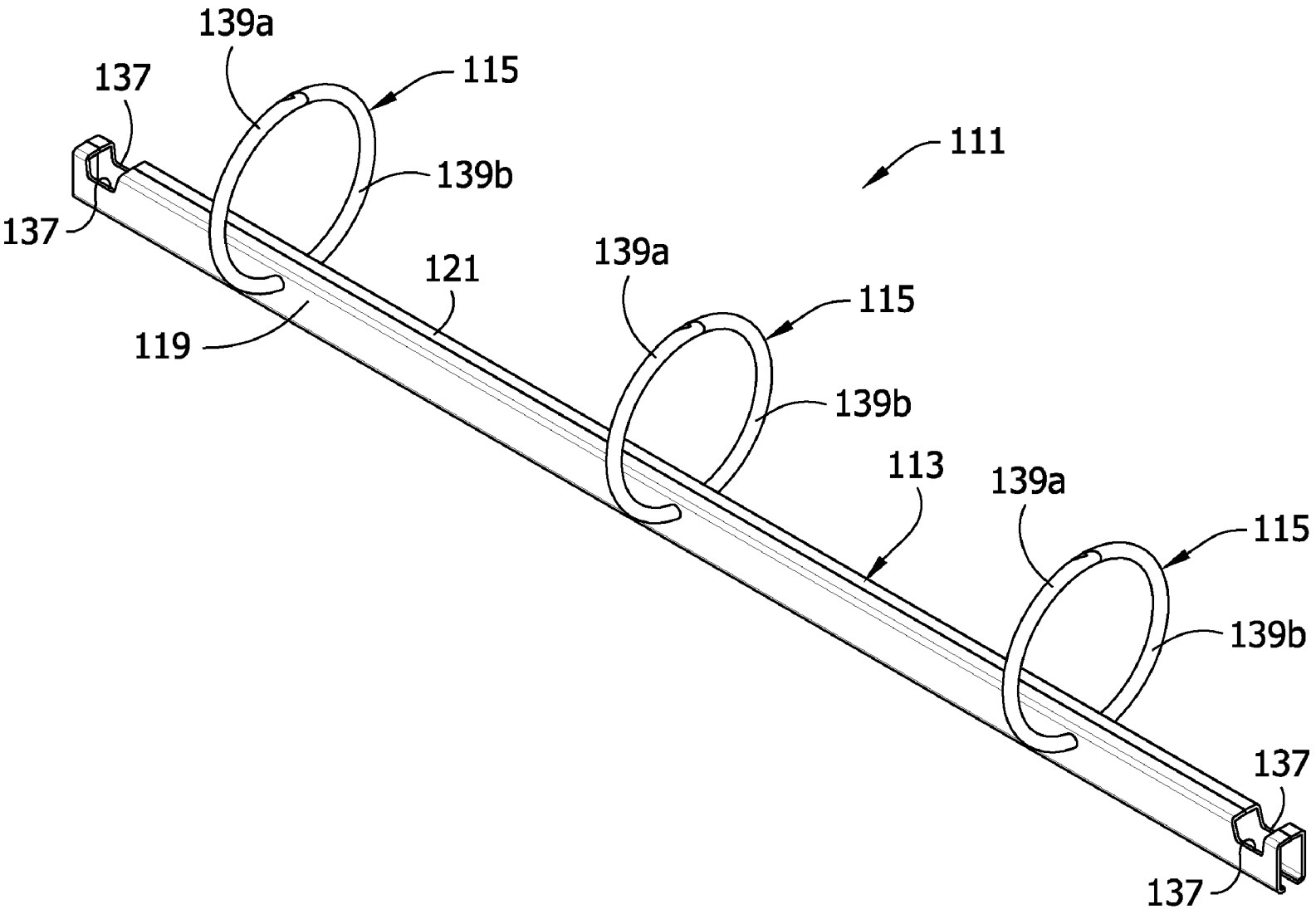
FIG. 7 is a top side perspective of a ring mechanism of a second embodiment.
Figure 8:
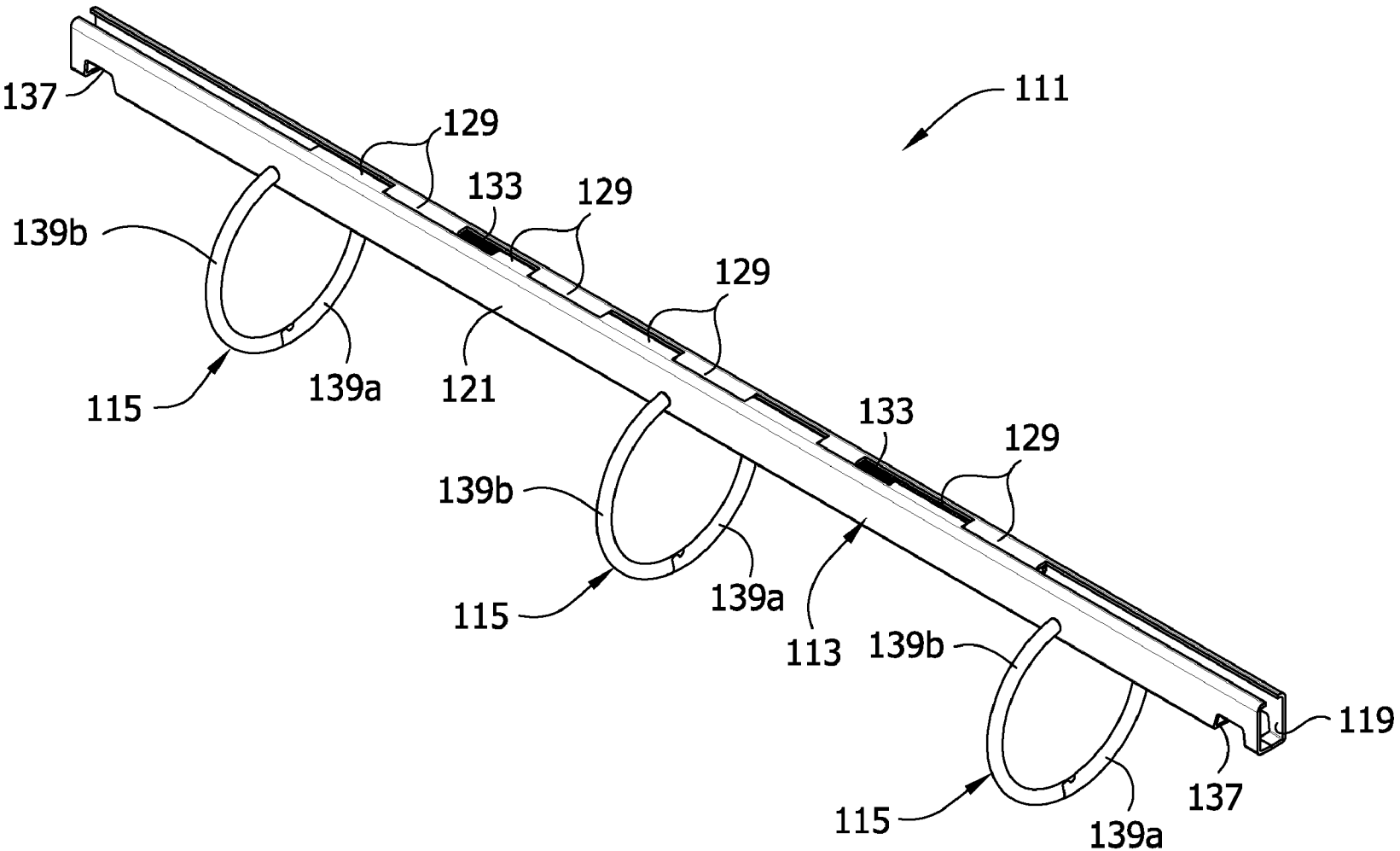
FIG. 8 is a bottom side perspective of the ring mechanism of FIG. 7.
Figure 9:
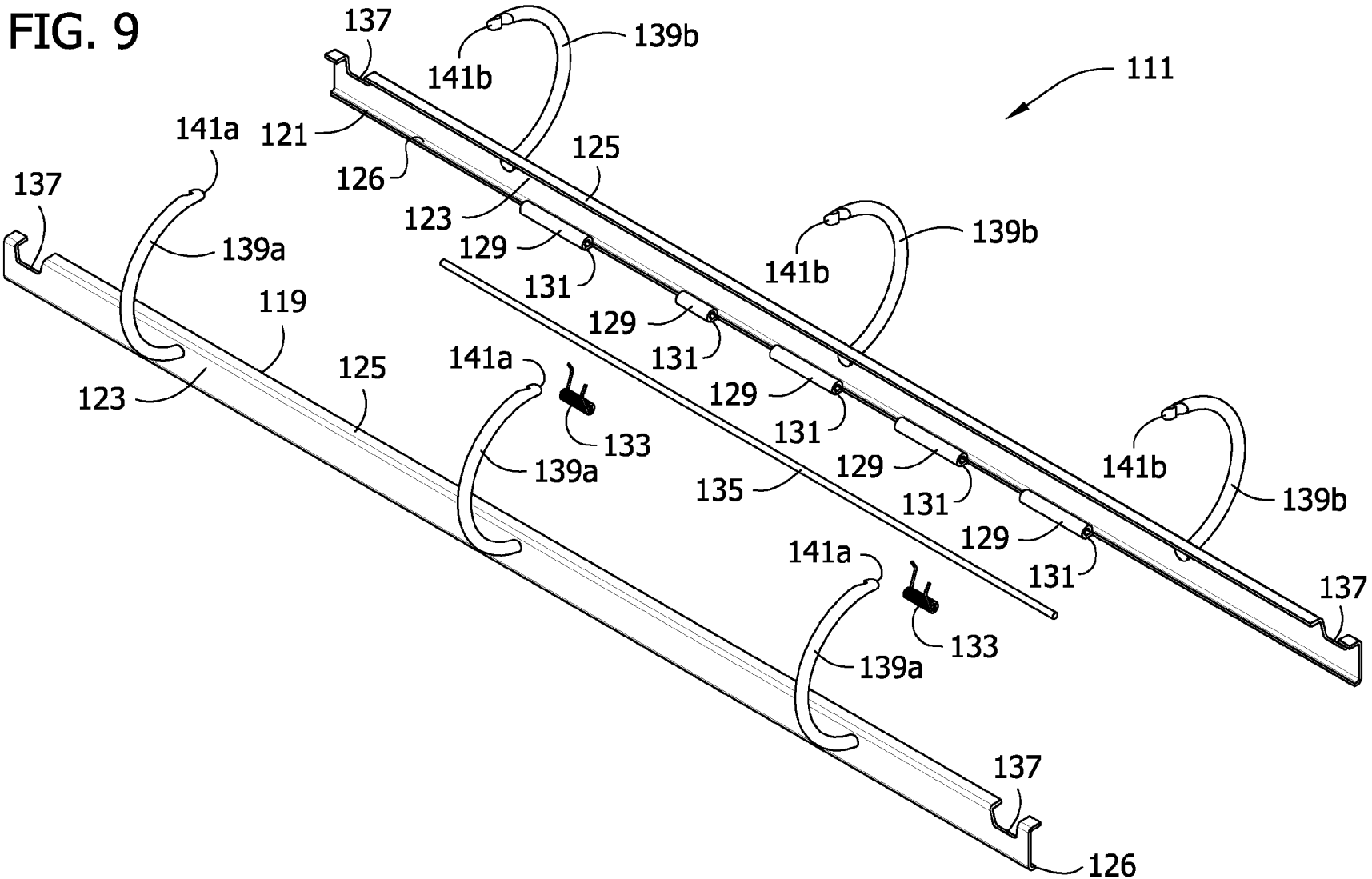
FIG. 9 is an exploded perspective thereof.
Figure 10:
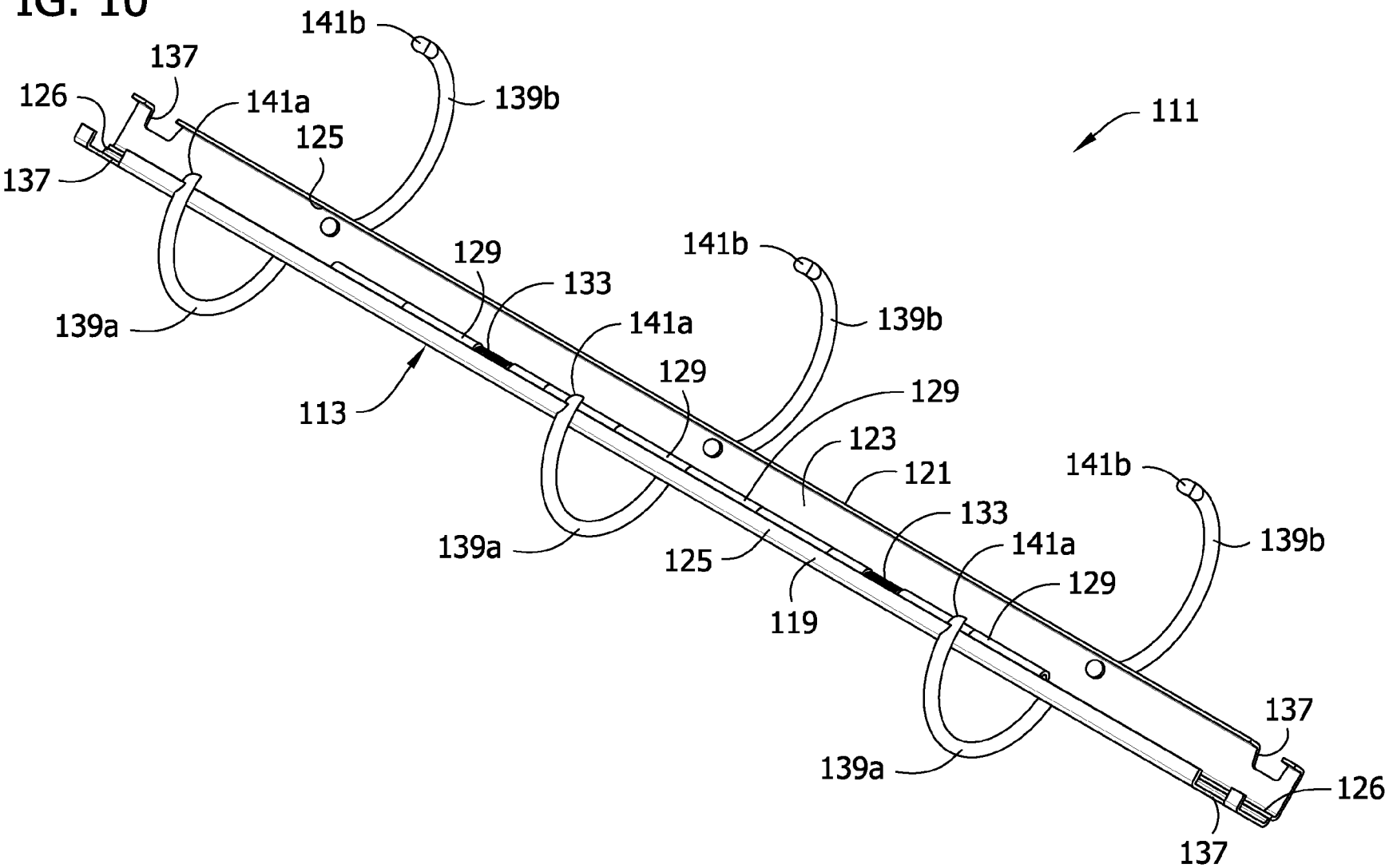
FIG. 10 is a top side perspective thereof with the ring mechanism in an open position.
Figure 11:
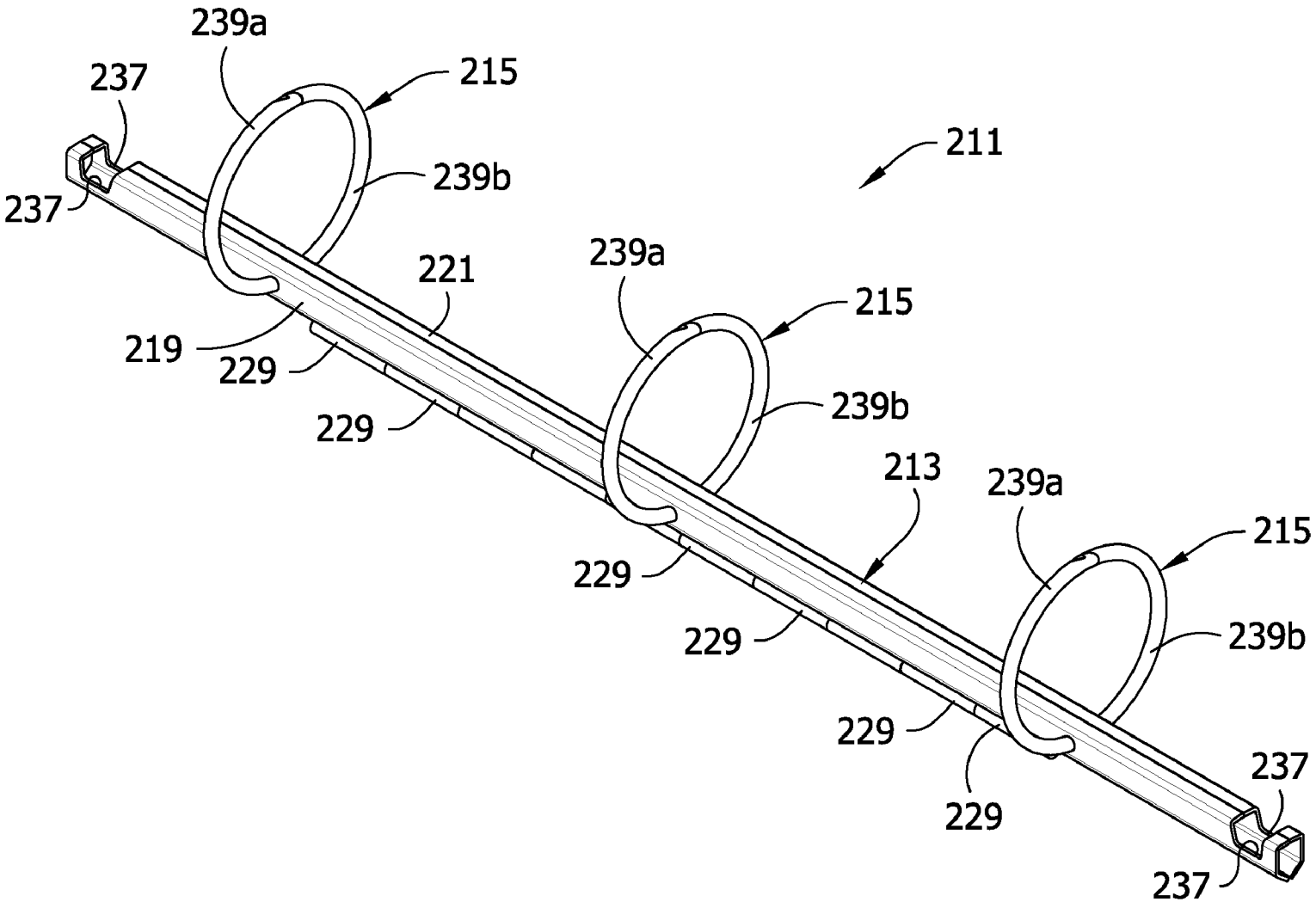
FIG. 11 is a top side perspective of a ring mechanism of a third embodiment.
Figure 12:
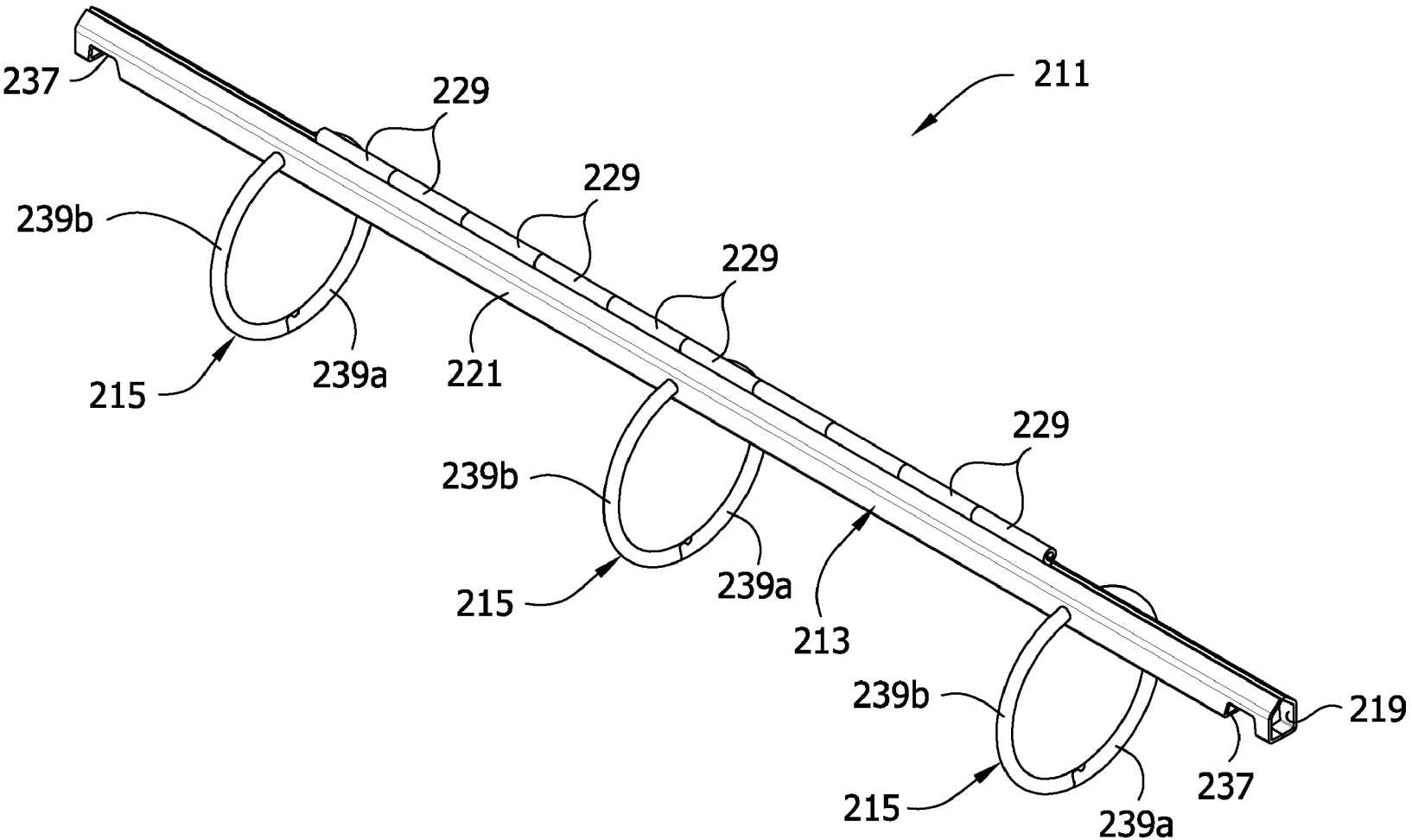
FIG. 12 is a bottom side perspective of the ring mechanism of FIG. 11.
Figure 13:
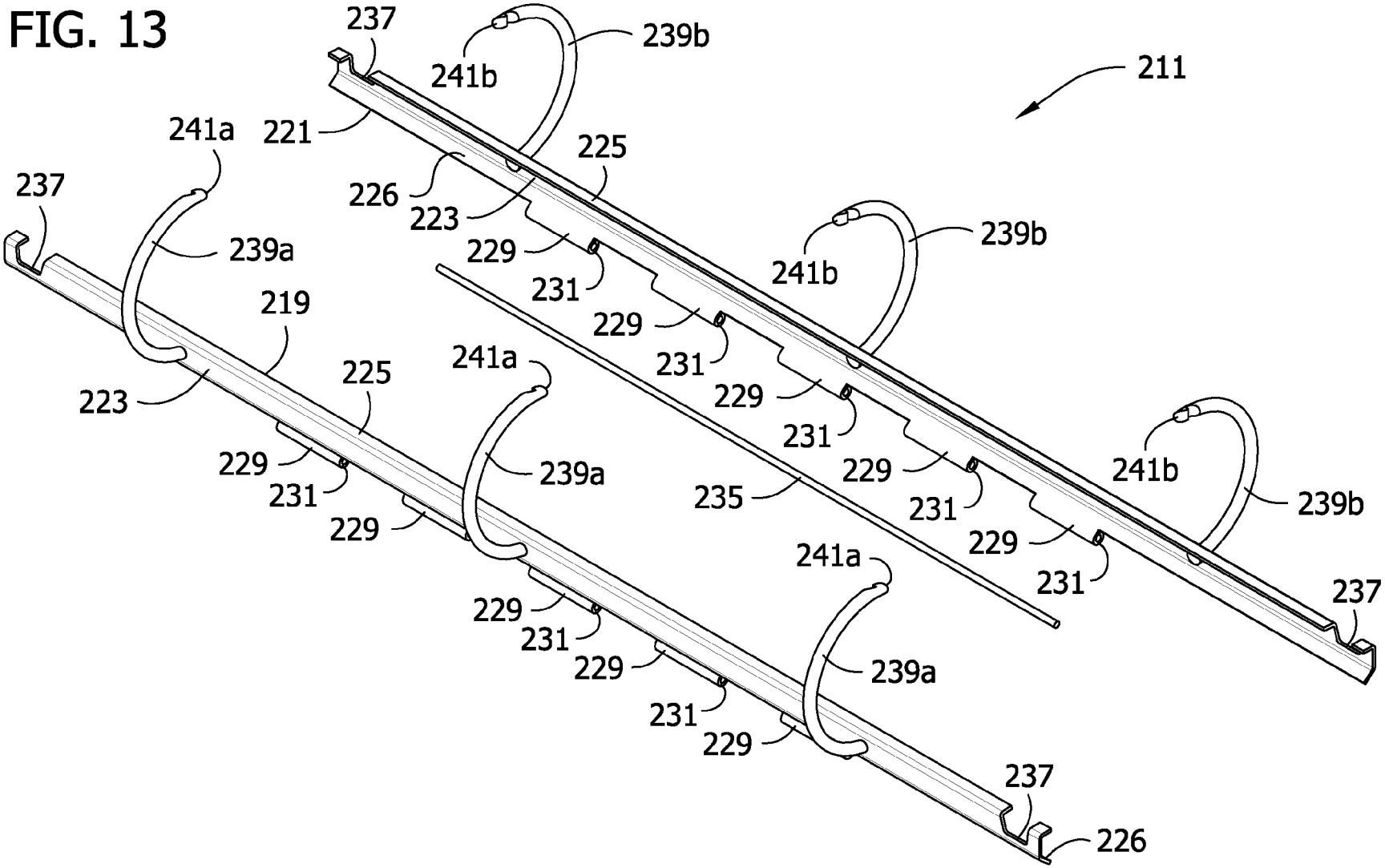
FIG. 13 is an exploded perspective thereof.
Figure 14:
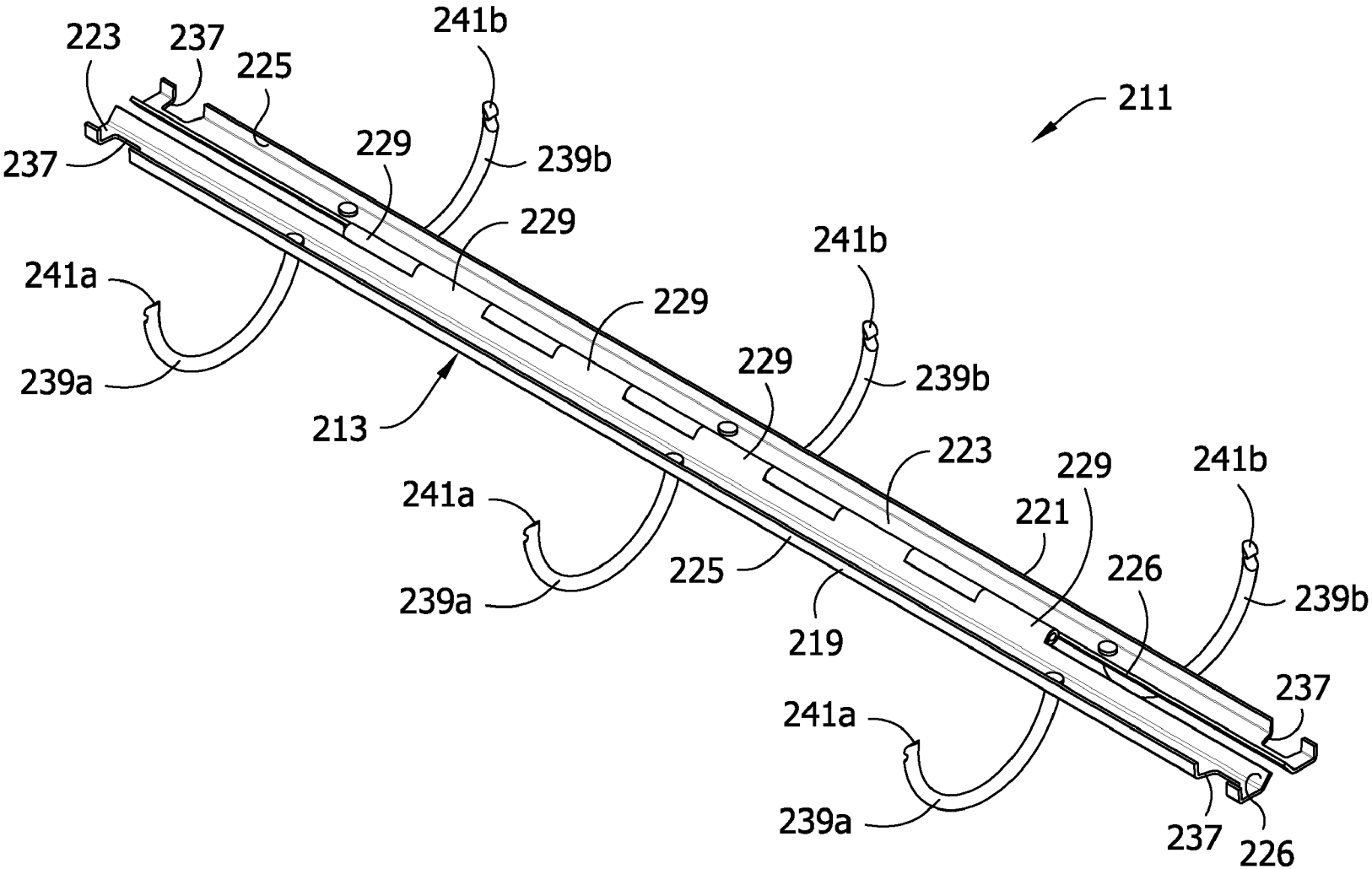
FIG. 14 is a top side perspective thereof with the ring mechanism in an open position.
Figure 15:
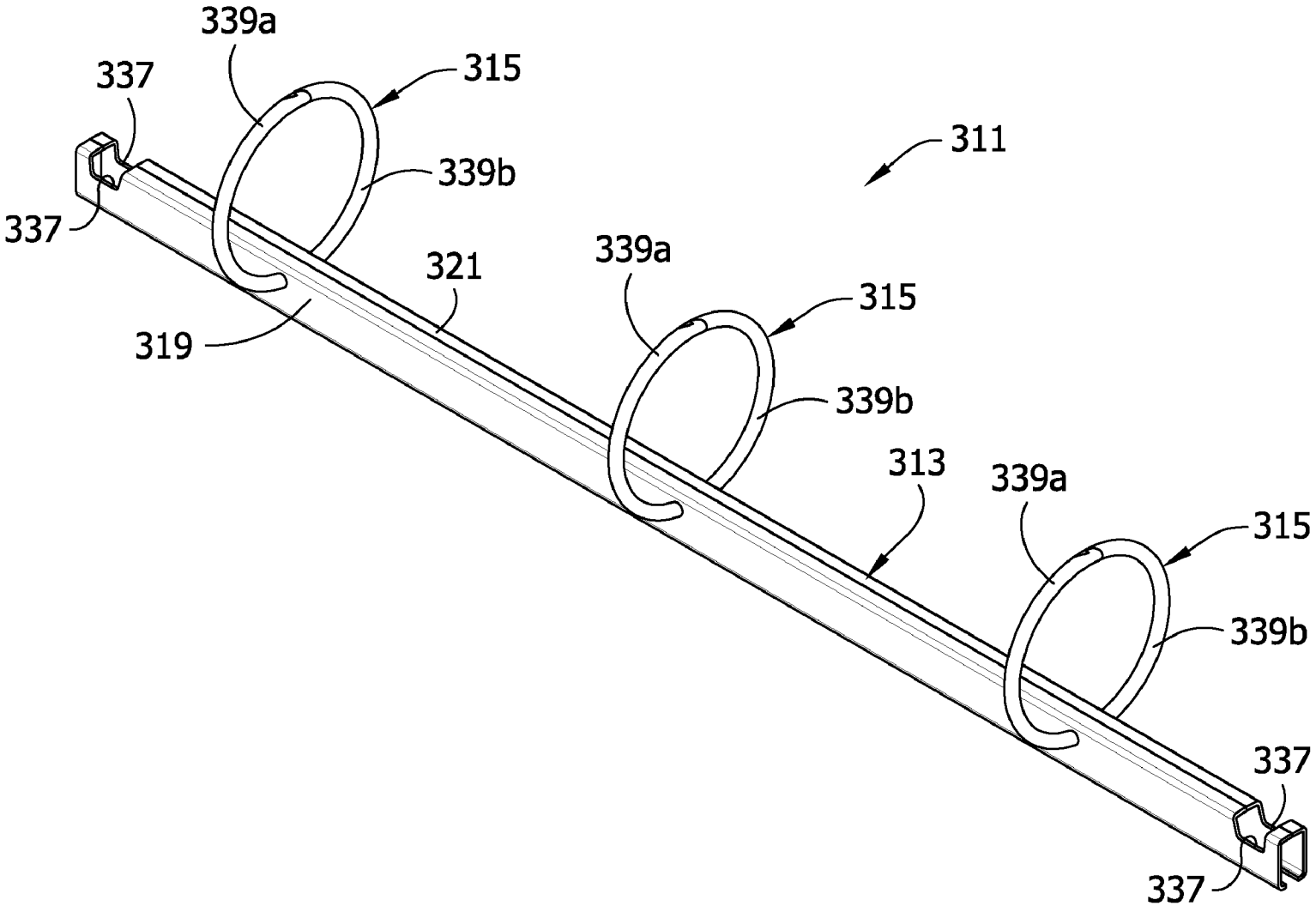
FIG. 15 is a top side perspective of a ring mechanism of a fourth embodiment.
Figure 16:
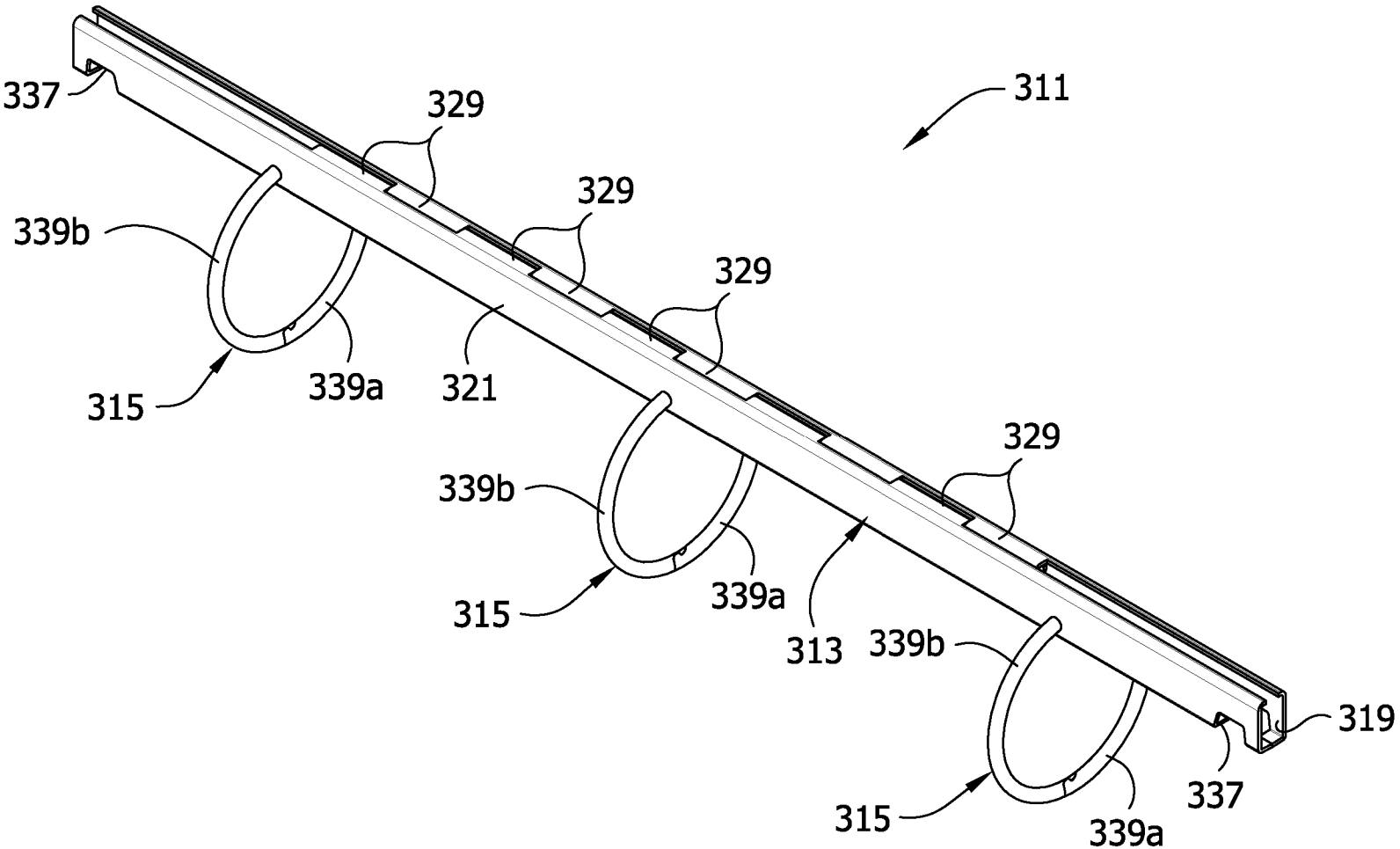
FIG. 16 is a bottom side perspective of the ring mechanism of FIG. 15.
Figure 17:
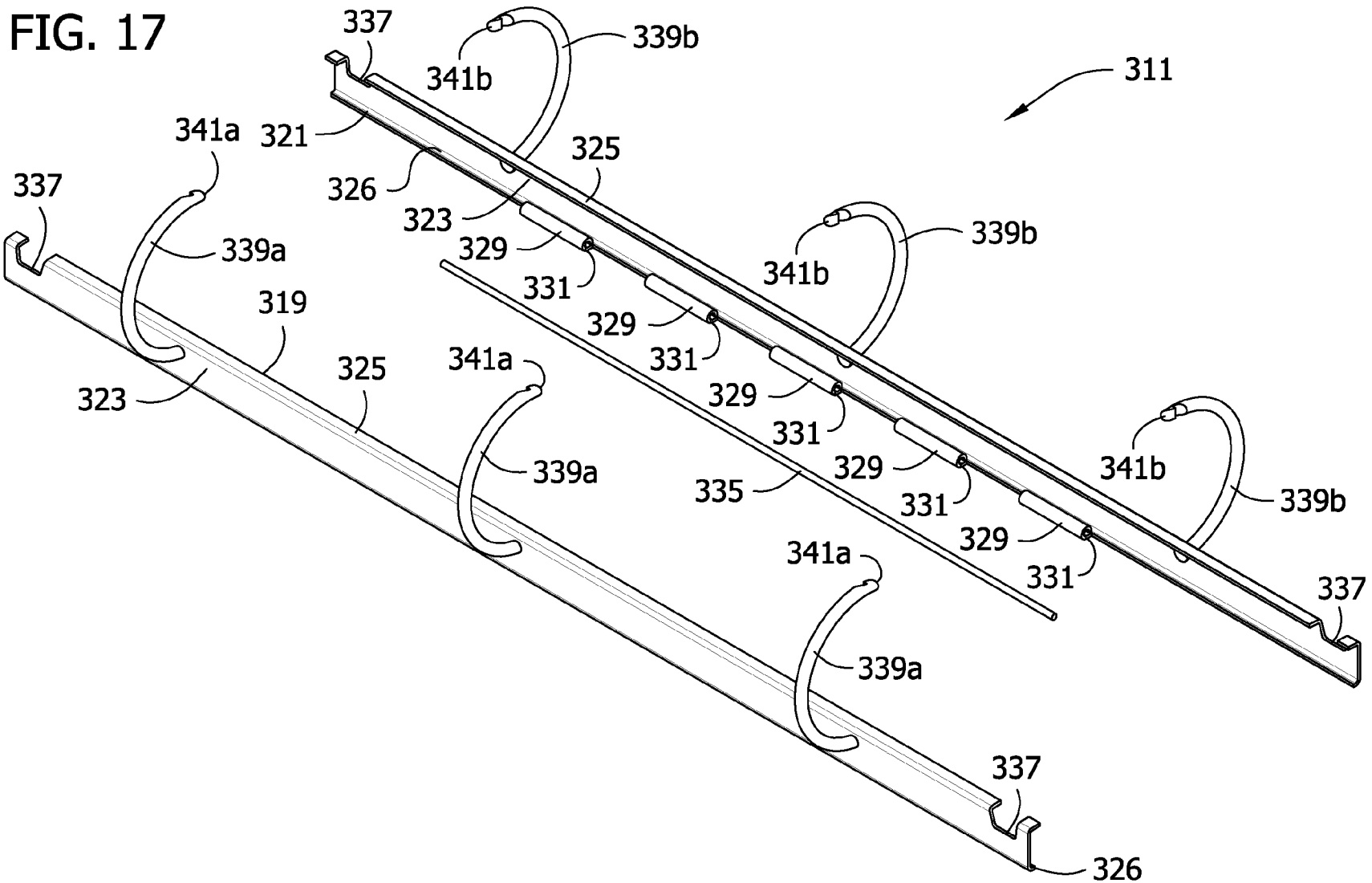
FIG. 17 is an exploded perspective thereof.
Figure 18:
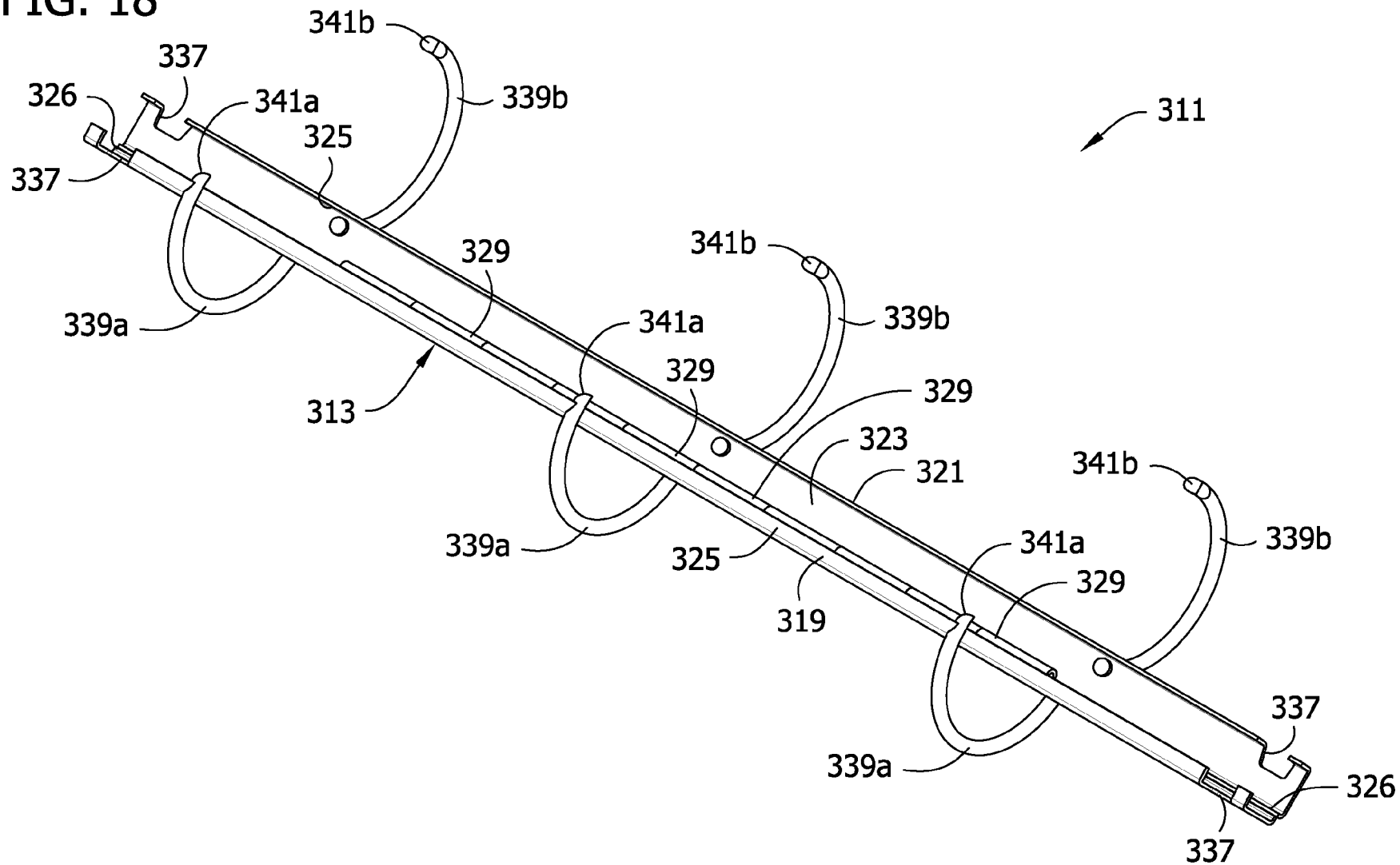
FIG. 18 is a top side perspective thereof with the ring mechanism in an open position.
Figure 19:
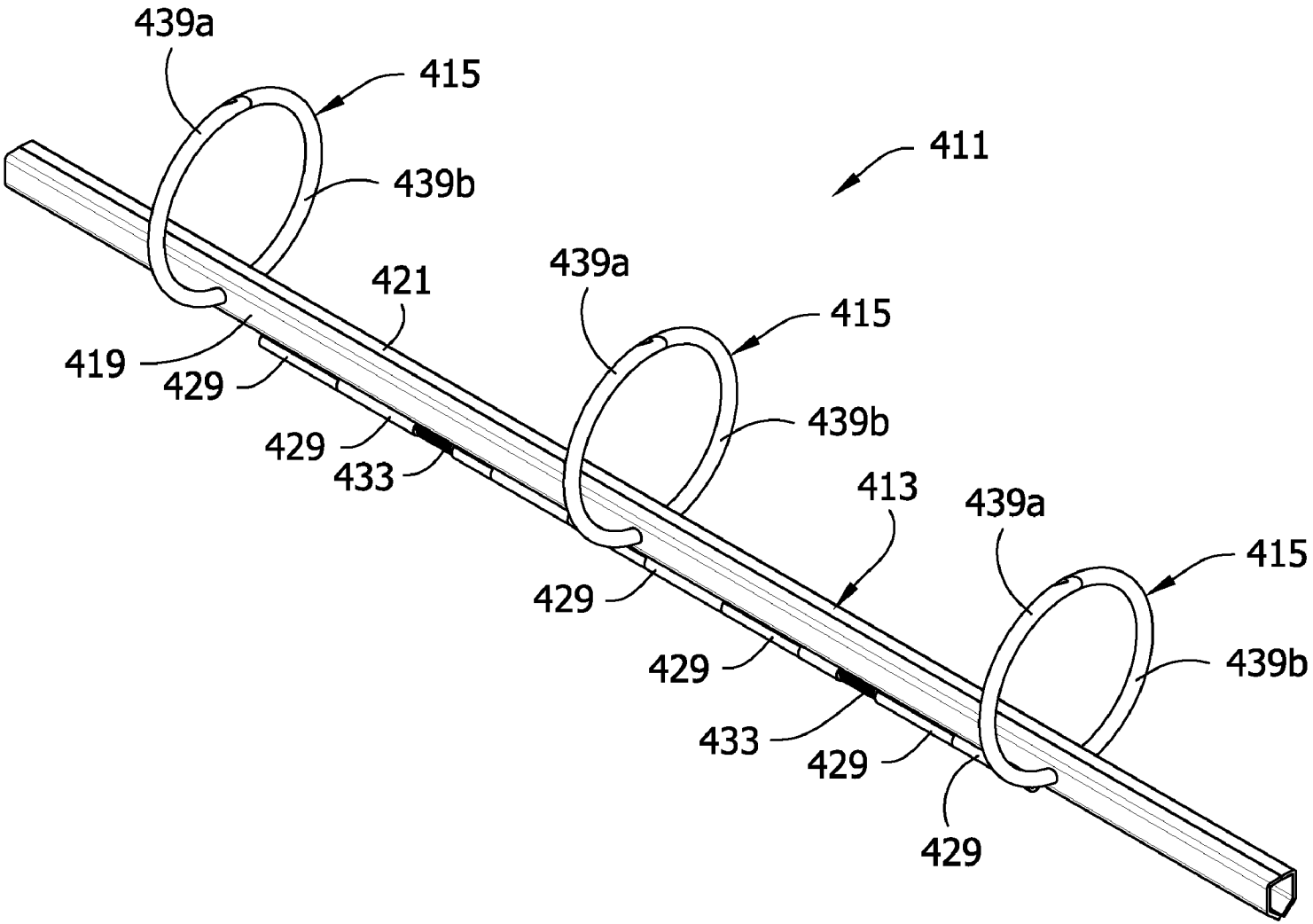
FIG. 19 is a top side perspective of a ring mechanism of a fifth embodiment.
Figure 20:
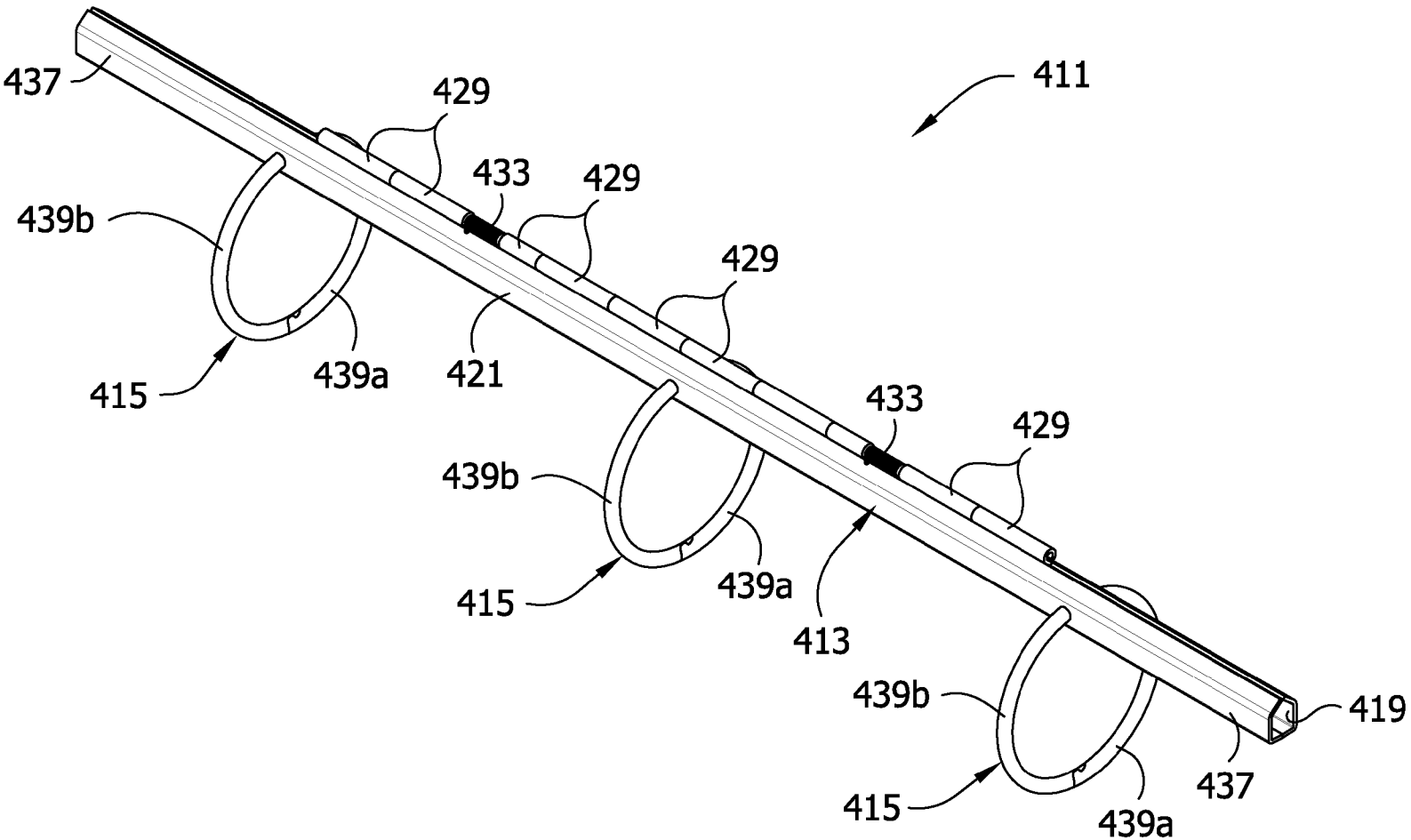
FIG. 20 is a bottom side perspective of the ring mechanism of FIG. 19.
Figure 21:
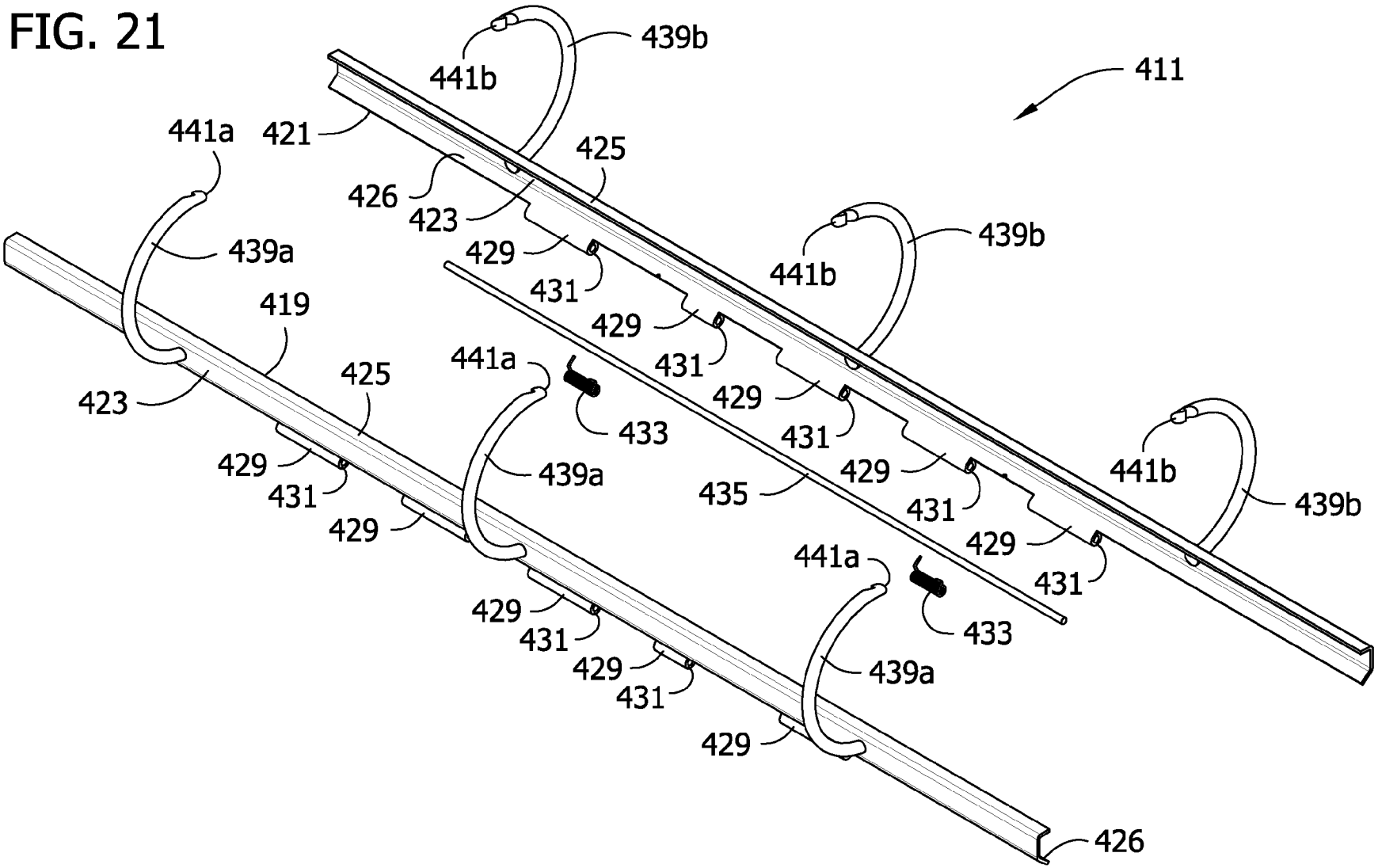
FIG. 21 is an exploded perspective thereof.
Figure 22:
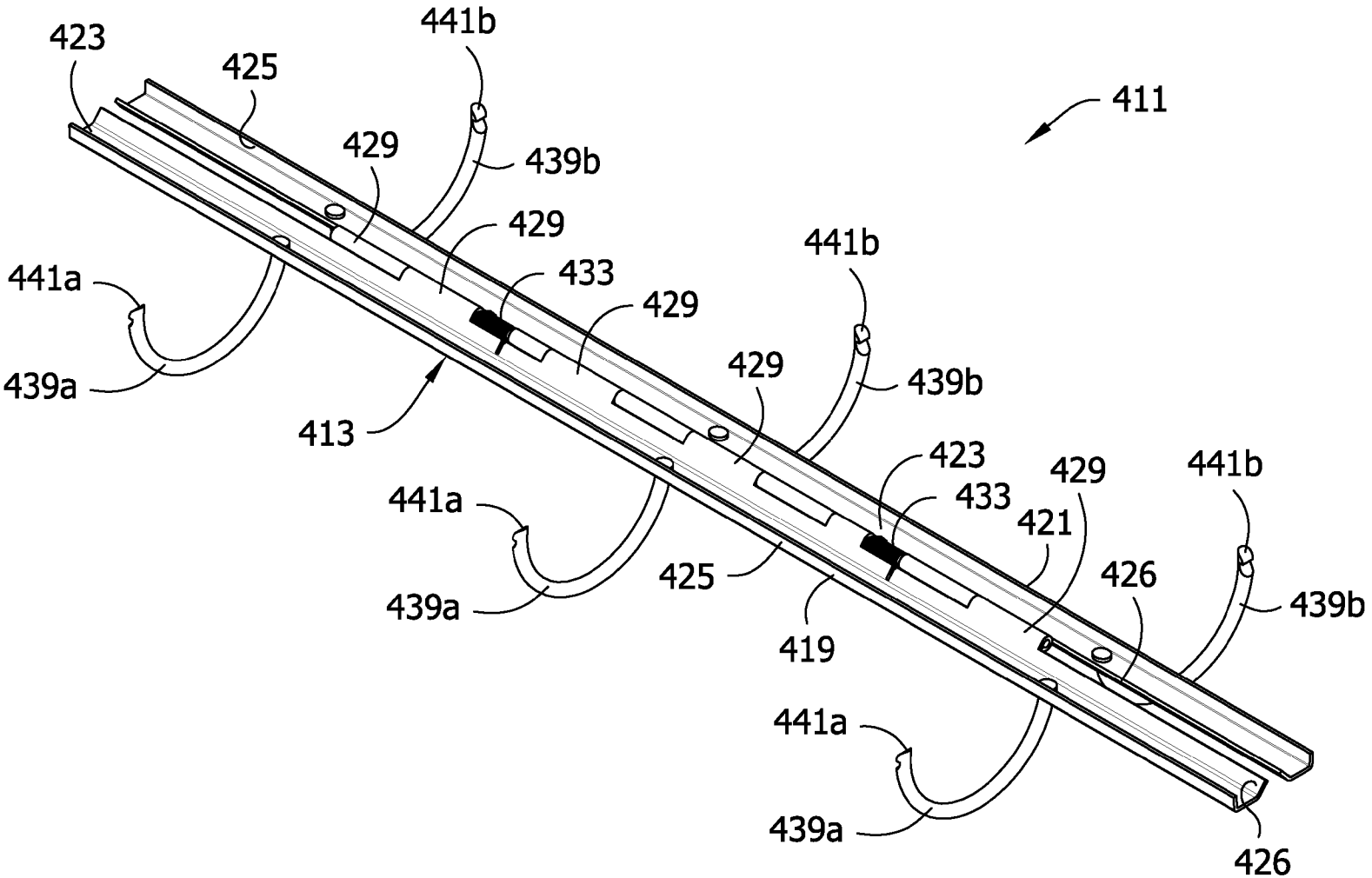
FIG. 22 is a top side perspective thereof with the ring mechanism in an open position.
Figure 23:
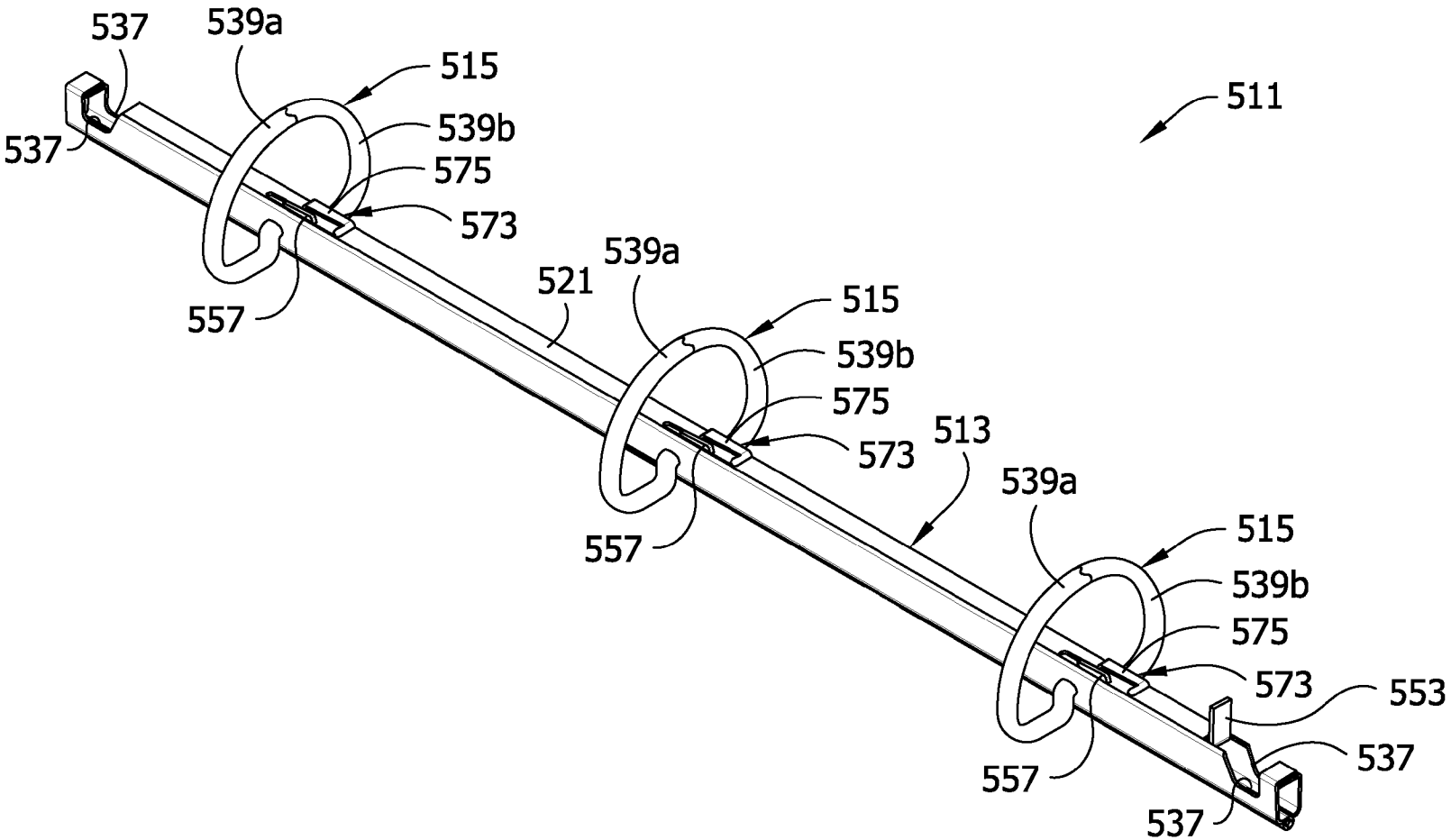
FIG. 23 is a top side perspective of a ring mechanism of a sixth embodiment.
Figure 24:
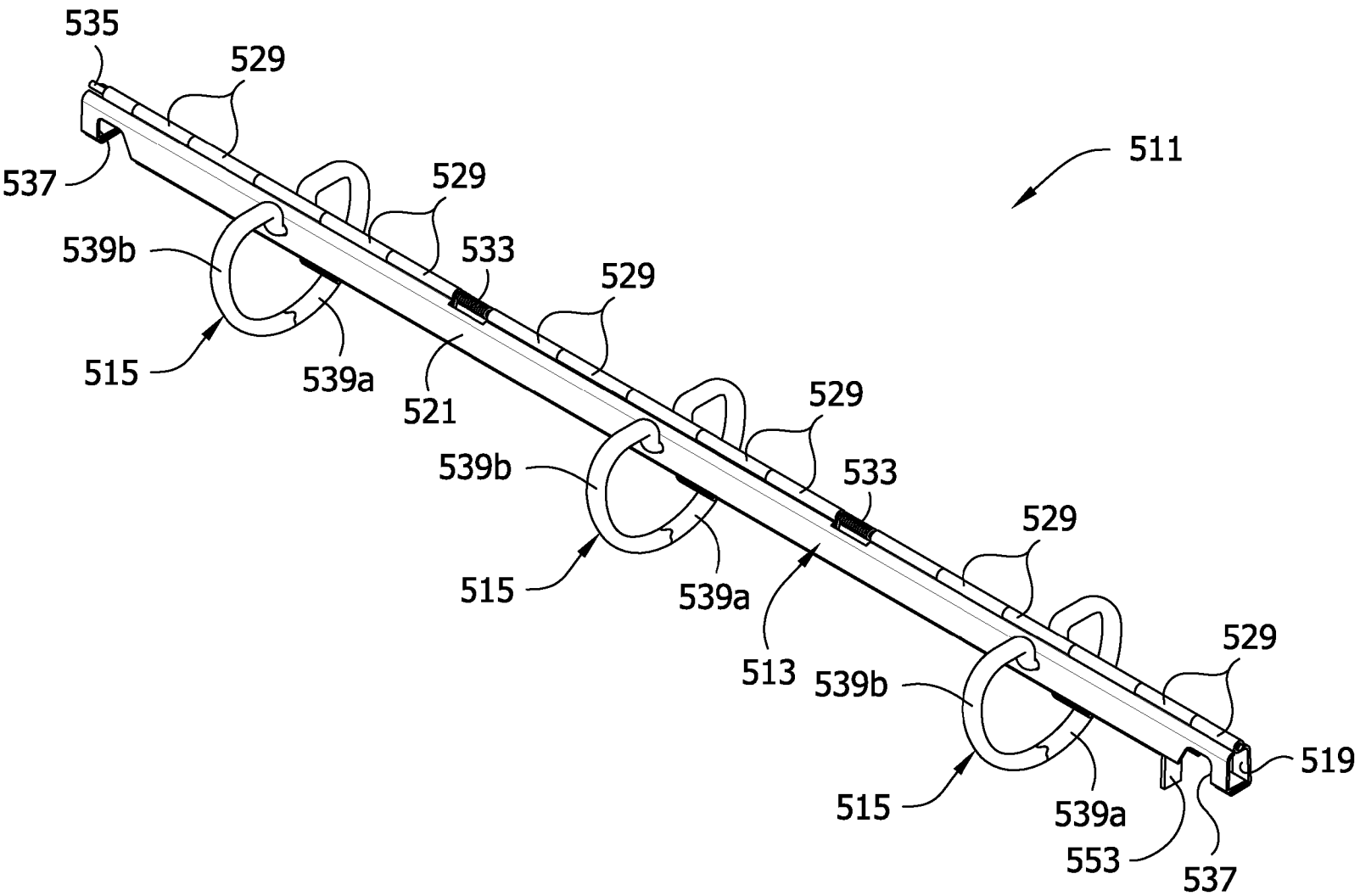
FIG. 24 is a bottom side perspective of the ring mechanism of FIG. 23.

Referring now to FIG. 5, to open the ring members 39*a*, 39*b*, the ring members are first moved to an "unlocked" position by disengaging the hook-shaped formations 41*a*, 41*b* of ring members, e.g., by moving one of the ring members relative to the other in a direction away from the ring member and generally parallel to the longitudinal axis of the frame 13. In the illustrated configuration, the first ring member 39*a* is moved to the right as viewed in FIG. 5 and indicated by a direction arrow, and the second ring member 39*b* is moved to the left as viewed in FIG. 5 and indicated by another direction arrow. The relative movement of the ring members 39*a*, 39*b* causes the hook-shaped formations 41*a*, 41*b* to disengage. Once the hook-shaped formations 41*a*, 41*b* are disengaged, the torsion springs 33 urge the first and second frame elements 19, 21 to simultaneously pivot on the hinge pin 35 relative to each other and thereby conjointly move the ring members from their closed position to their open position, as shown in FIG. 6. In the open position, the ring members 39*a*, 39*b* form a discontinuous, open loop suitable for adding or removing pages P.

To close the ring members 39*a*, 39*b* the hook-spaced formations 41*a*, 41*b* of each pair of mating ring members are pressed together against the bias of the torsion springs 33. The hook-shaped formations 41*a*, 41*b* re-engage and securely lock the ring members 39*a*, 39*b* together in a "locked position". As the ring members 39*a*, 39*b* are being brought together, the tapered surfaces of the hook-shaped formations 41*a*, 41*b* cause longitudinal movement of the ring members 39*a*, 39*b* with respect to each other as the tapered surfaces slidingly engage. The catches of the hook shaped formations 41*a*, 41*b* engage due to the resiliency of the ring members 39*a*, 39*b* after the tapered surfaces of the ring members pass each other. Once the catches are engaged, the hook-spaced formations 41*a*, 41*b* hold the frame elements 19, 21 and thereby the ring members 39*a*, 39*b* in place against the biasing force of the springs 33.

A second embodiment of a suitable ring mechanism 111 is shown in FIGS. 7-10. This ring mechanism 111 is substantially similar to the mechanism 11 previously described (FIGS. 1-6), with the exception that the frame 113 comprises frame elements 119, 121 having webs 123 with inner flanges 126 that extend from the respective web at about a 90 degree angle. As a result, the knuckles 129, hinge pin 135, and springs 133 are located in an interior space of the frame 113. Corresponding parts of this mechanism 111 configuration are indicated by the same reference numbers as the previous mechanism 11, plus "100".

FIGS. 11-14 show a third embodiment of a ring mechanism 211 that is substantially the same as the mechanism 11 of FIGS. 1-6 except this embodiment does not include a biasing member (e.g., springs 33 of FIGS. 1-6). As a result, frame elements 219, 221 of this embodiment are manually pivoted between first and second positions, which correspond respectively to open and closed configurations of the mechanism 211. Parts of this mechanism 211 configuration are indicated by the same reference numbers as the mechanism 11 of FIGS. 1-6, plus "200".

FIGS. 15-18 show a fourth embodiment of a ring mechanism 311 that is substantially the same as the mechanism 111 of FIGS. 7-10 except this embodiment does not include a biasing member (e.g., springs 133 of FIGS. 7-10). Parts of this mechanism 311 configuration are indicated by the same reference numbers as the mechanism 111 of FIGS. 7-10, plus "200".

FIGS. 19-22 show a fifth embodiment of a ring mechanism 411 that is substantially the same as the mechanism 11 of FIGS. 1-6 except this embodiment does not include the cutouts 37 for receiving a support. Rather, the framed is intended to simply rest on the supports. Parts of this mechanism 411 configuration are indicated by the same reference numbers as the mechanism 11 of FIGS. 1-6, plus "400".

Figure 25:
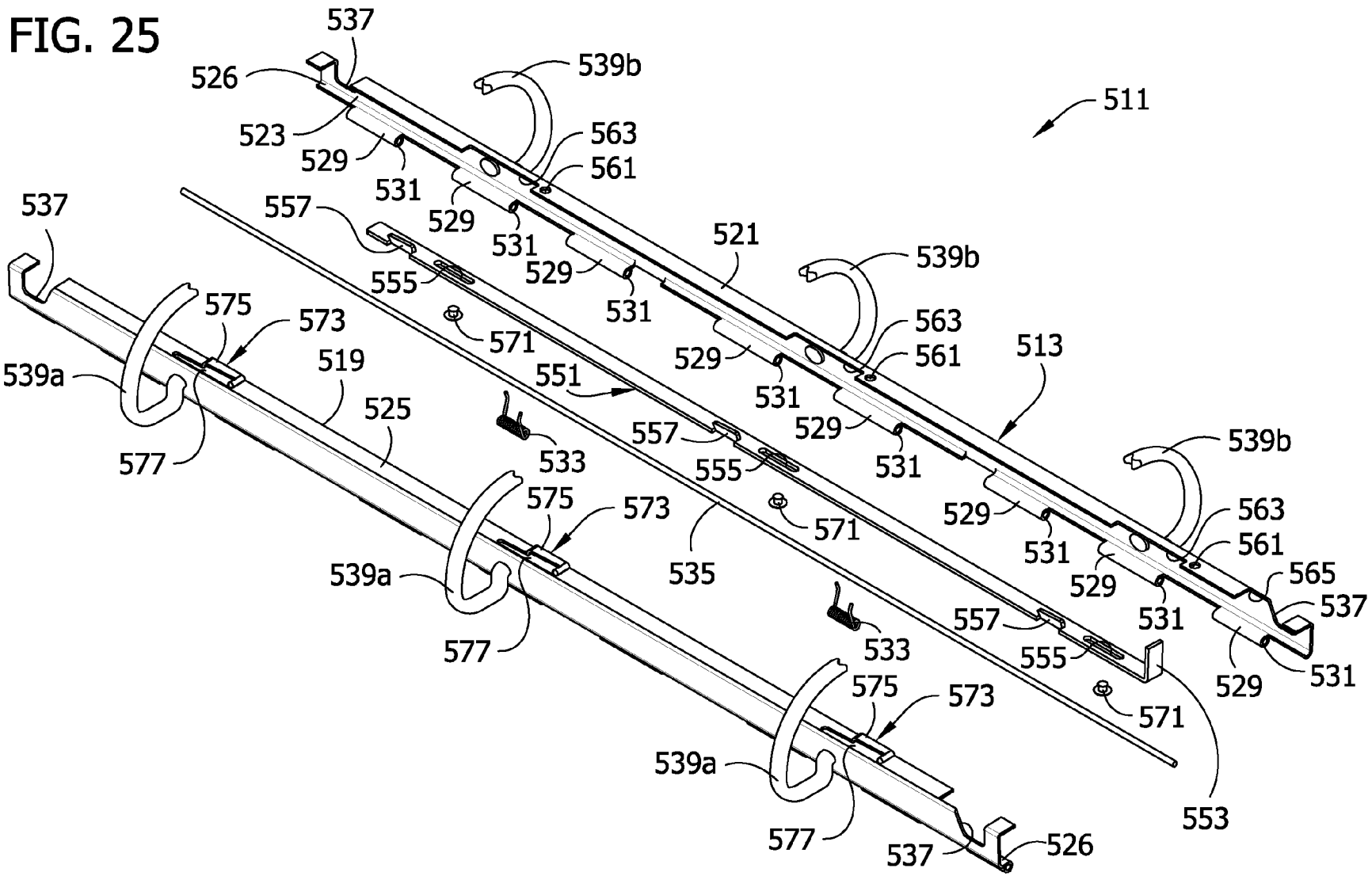
FIG. 25 is an exploded perspective thereof.
Figure 26:
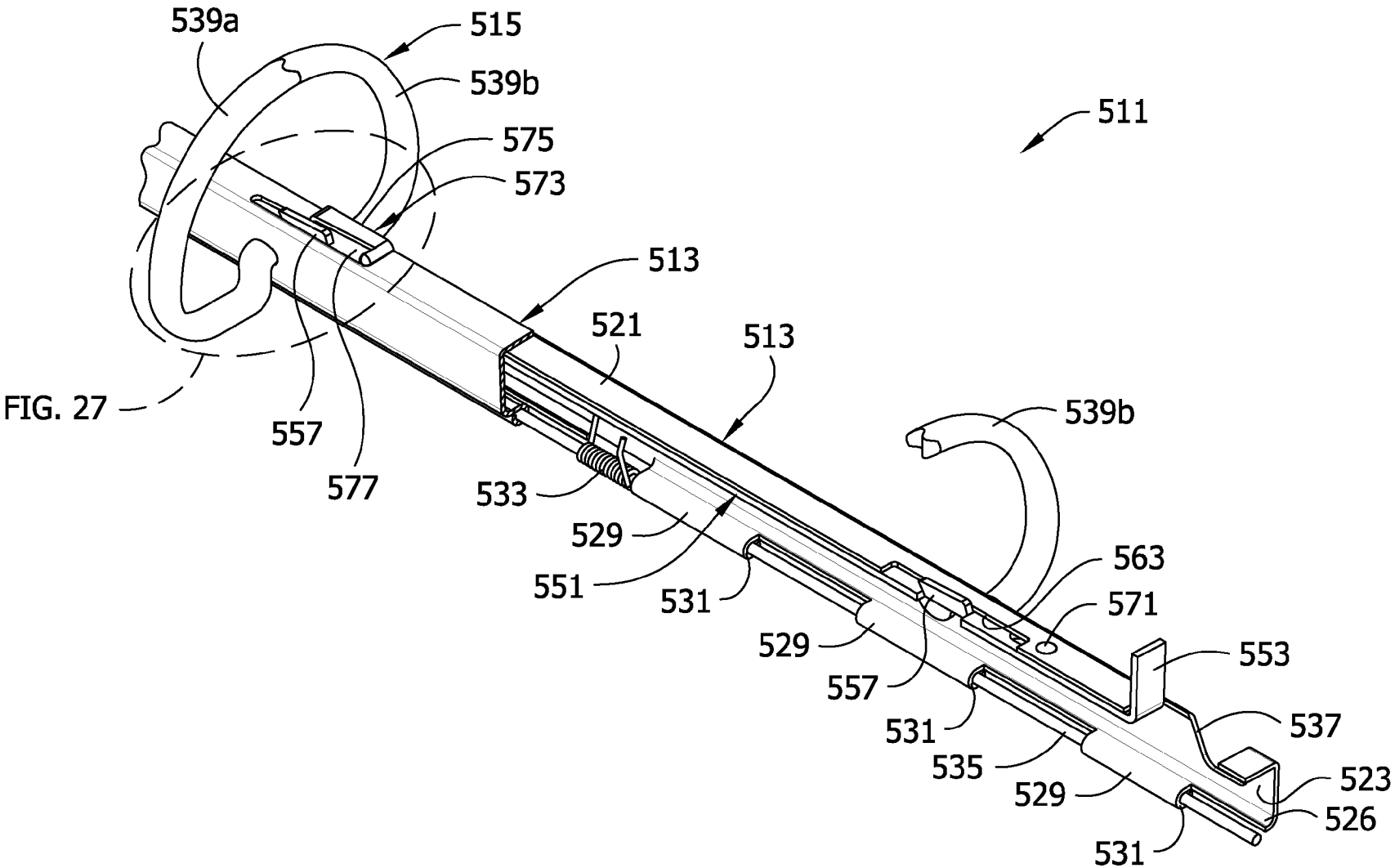
FIG. 26 is an enlarged fragmentary perspective thereof with a portion of a first frame element broken away and a ring member removed.

FIGS. 23-30 show a sixth embodiment of a ring mechanism 511 that is substantially the same as the mechanism 11 of FIGS. 1-6 except that the frame 513 of this ring mechanism includes a locking device comprising a slidable lock bar, generally indicated at 551 (see FIGS. 25 and 26). In addition, a hinge pin 535 has a length substantially equal to a length of the frame 513. It is understood (and shown in the previous embodiments) that the hinge pin could have a length less that the length of the frame. Corresponding parts of this mechanism 511 configuration are indicated by the same reference numbers as the mechanism 11 of FIGS. 1-6, plus "500".

Referring to FIG. 25, the lock bar 551 is elongate and flat with a bent end forming a grip 553 for manipulating movement of the lock bar as described below. The lock bar 551 includes three slots 555 spaced along a longitudinal axis of the bar and three tabs 557 spaced along a longitudinal edge of the bar. The tabs 557 are formed by folding a portion of the longitudinal edges of the bar 551 upward. It is understood that the bar 551 can have more or fewer slots and/or tabs and that the tabs can be formed in different ways without departing from the scope of this invention.

Figure 28:
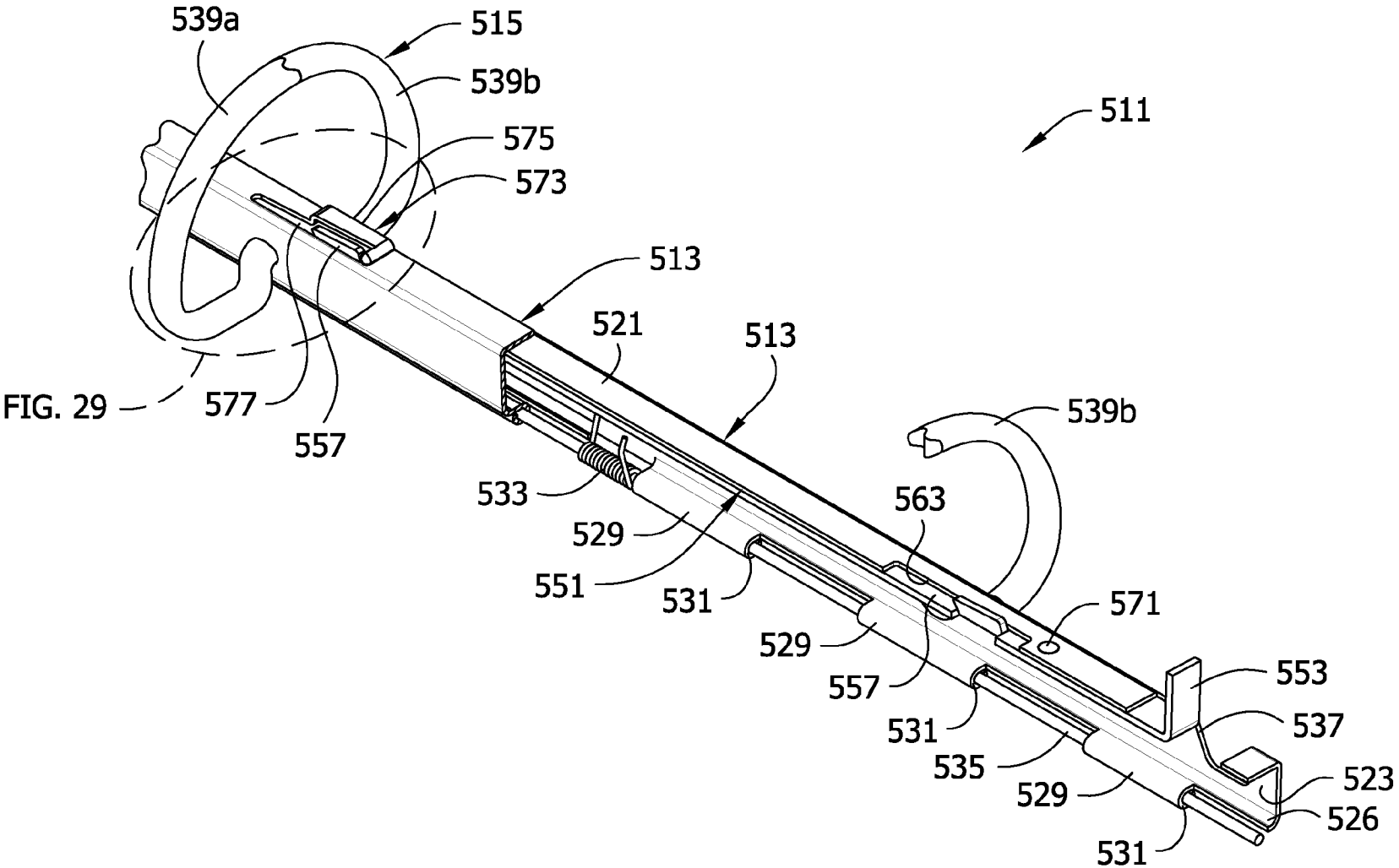
FIG. 28 is similar to FIG. 26 but with the locking device moved to an unlocked position.
Figure 30:
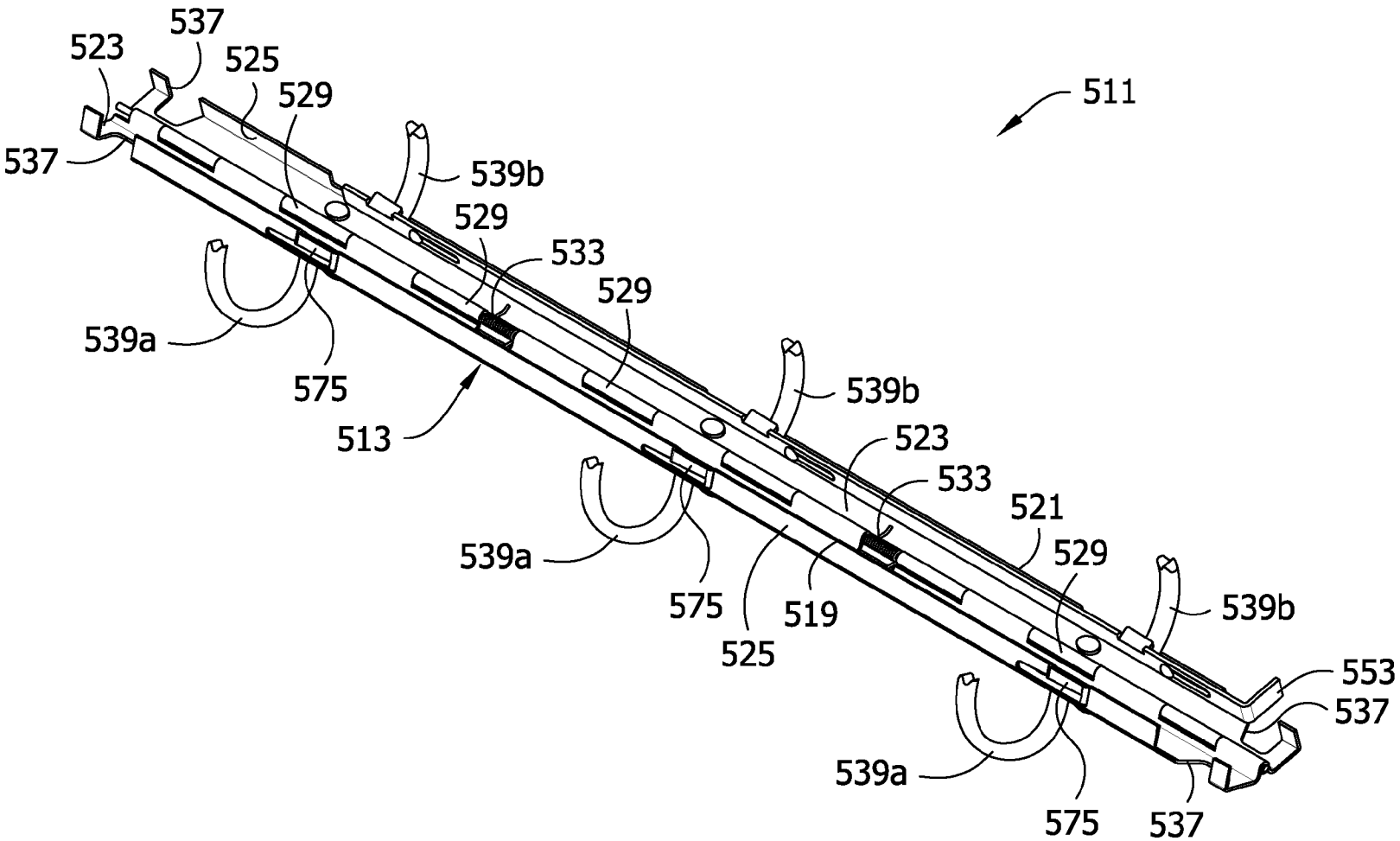
FIG. 30 is a top side perspective of the ring mechanism in an open position.

A second frame element 521 of the mechanism 511 comprises three circular openings 561, three generally rectangular notches 563, and one generally rectangular notch 565 that is coextensive with one of the frame cutouts 537. The three circular openings 561 on the second frame element 521 are aligned with the three slots 555 on the lock bar 551. Posts 571 are received through the openings 561 and the slots 555 to thereby slidably secure the lock bar 551 to the second element 521 (FIG. 30). The lock bar 551 can thus slide longitudinally relative to the second element 521 a distance corresponding to a length of the slots 555. As shown in FIGS. 26 and 28, the grip 553 of the lock bar 551 is received in the notch 565 coextensive with the cutout 537 portion of the second frame element 521 and extends above the second frame element so that it can be easily grasped to slide the lock bar. Each of the tabs 557 of the lock bar 551 is received in a respective rectangular notch 563 of the second frame element 521. The rectangular notches 563 provide sufficient clearance in the second frame element 521 for allowing the lock bar 551 to slide its full extent without the tabs contacting the second element.

Referring again to FIG. 25, a first frame element 519 is formed with three catches, indicated at 573, for releasable capture of the tabs 557 of the lock bar 551. Each of the catches 573 includes a raised portion 575 and a slot 577 inboard of the raised portion. The slots 577 are sized and shaped for receiving and holding the tabs 557 of the lock bar 551.

In use, the locking device is used to lock the first and second frame elements 519, 521 in a first position (FIGS. 23 and 24) corresponding to a closed configuration of the ring mechanism 511. Particularly, the lock bar 551 is slidably mounted on the second frame element 521 for movement between a locked position in which the tabs 557 of the lock bar are received in the slots 577 of the first frame element 519 (FIGS. 26 and 27), and an unlocked position in which the tabs 557 of the lock bar 557 are moved in alignment with the raised portions 575 of the first frame element 519 (FIGS. 28 and 29) to permit the first and second frame elements to pivot on a hinge pin 535 to the second position of the frame elements, which corresponds to an open configuration of the mechanism 511 (FIG. 30).

Figure 29:
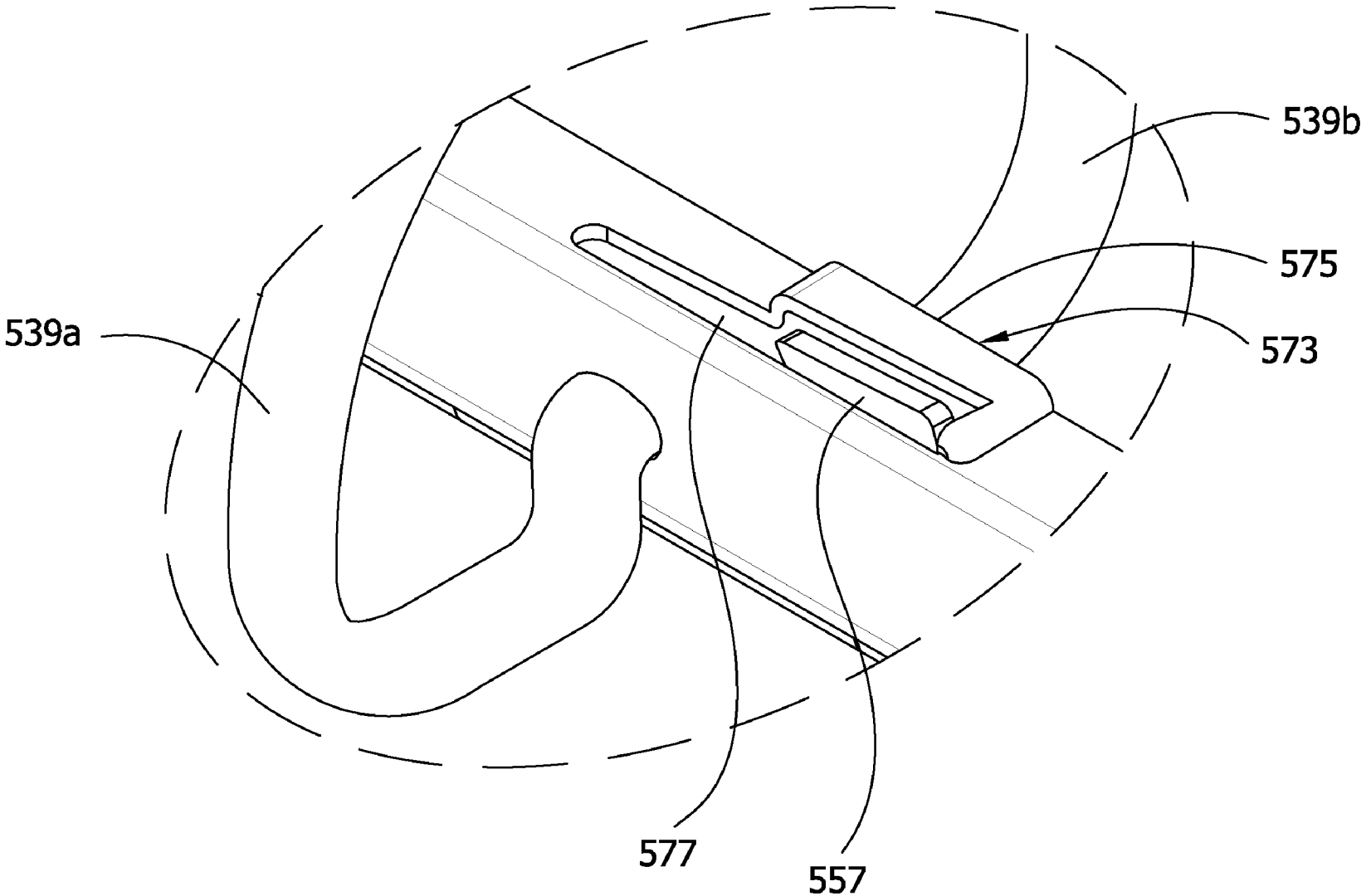
FIG. 29 is similar to FIG. 27 but with the locking device in the unlocked position.

To move the frame elements 519, 521 to their second position from their first position, a user moves the lock bar 551 using the grip 553 so that the tabs 575 in the second frame element 521 are aligned with the raised portions 575 of the first frame element 519 (FIGS. 28 and 29). Torsion springs 533 are mounted on the hinge pin 535 to bias the first and second frame elements 519, 521 to the open position. Thus, once the tabs 557 are aligned with the raised portions 575, the biasing force of the springs 533 causes the first and second frame elements 519, 521 to pivot away from each and to their second position (FIG. 30).

Figure 27:
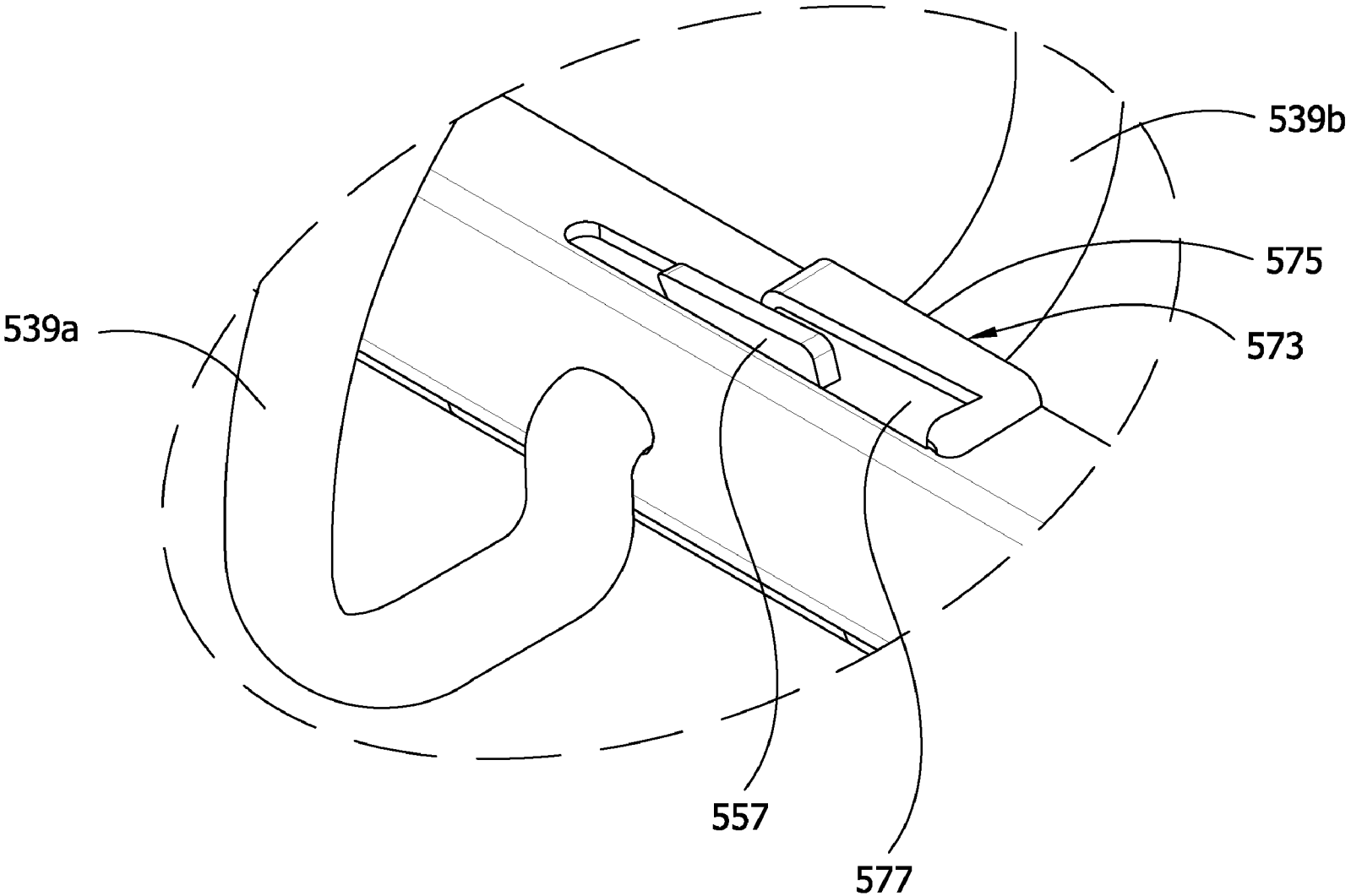
FIG. 27 is an enlarged perspective of a locking device of the ring mechanism in a locked position for locking the ring members in a closed position.

To move the frame elements 519, 521 back to their first position, the frame elements are manually pushed together against the bias of the springs 533. The tabs 557 of the second frame element 521 pass beneath the raised portion 575 of the first frame element 519 and into the slot 577. The lock bar 551 is then slid so that the tabs 557 are captured in the slots 577 of the first frame element (FIGS. 26 and 27).

Other locking devices capable for retaining the ring members in a closed position may be used without departing from the scope of this invention.

Figure 31:
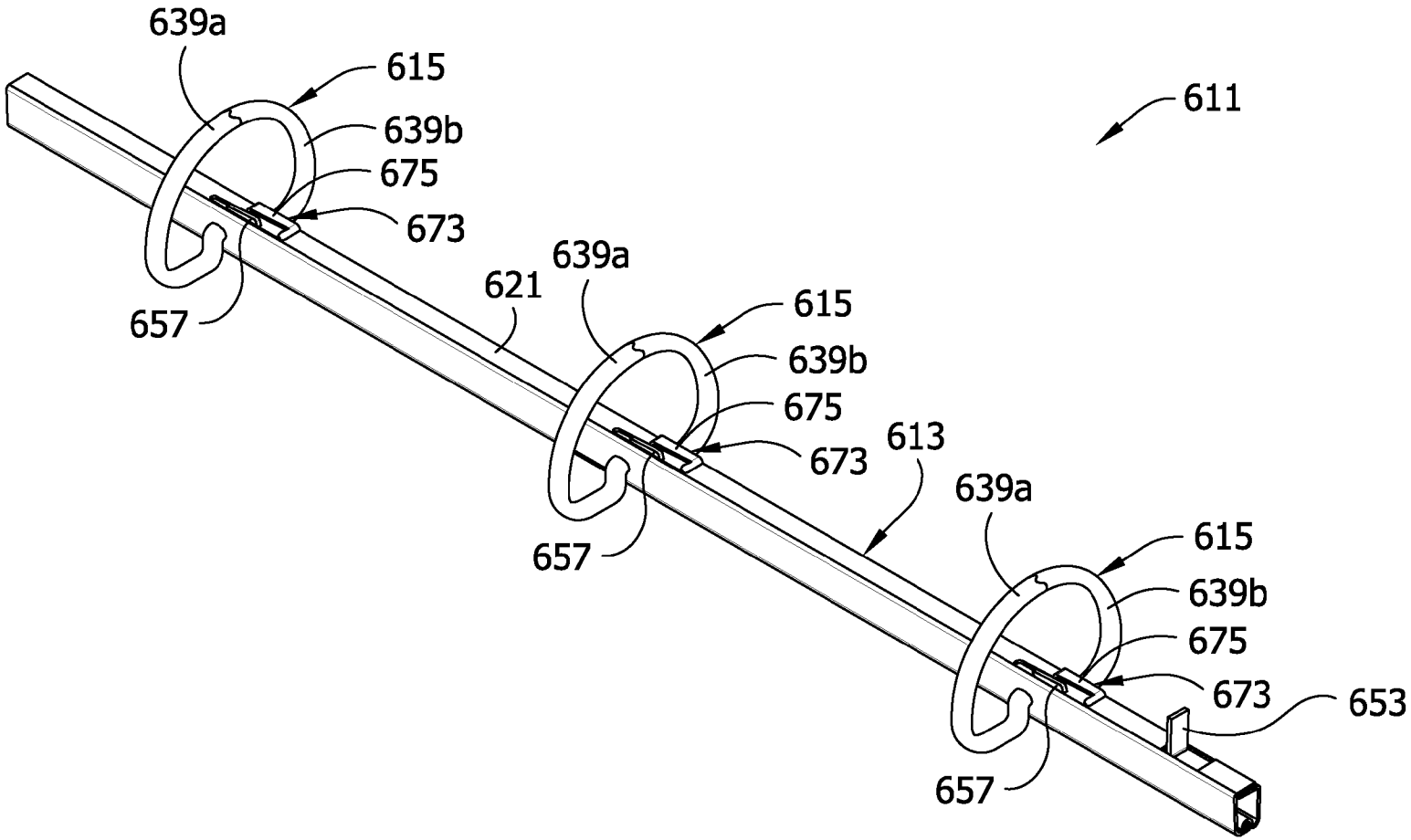
FIG. 31 is top side perspective of a ring mechanism of a seventh embodiment.
Figure 32:
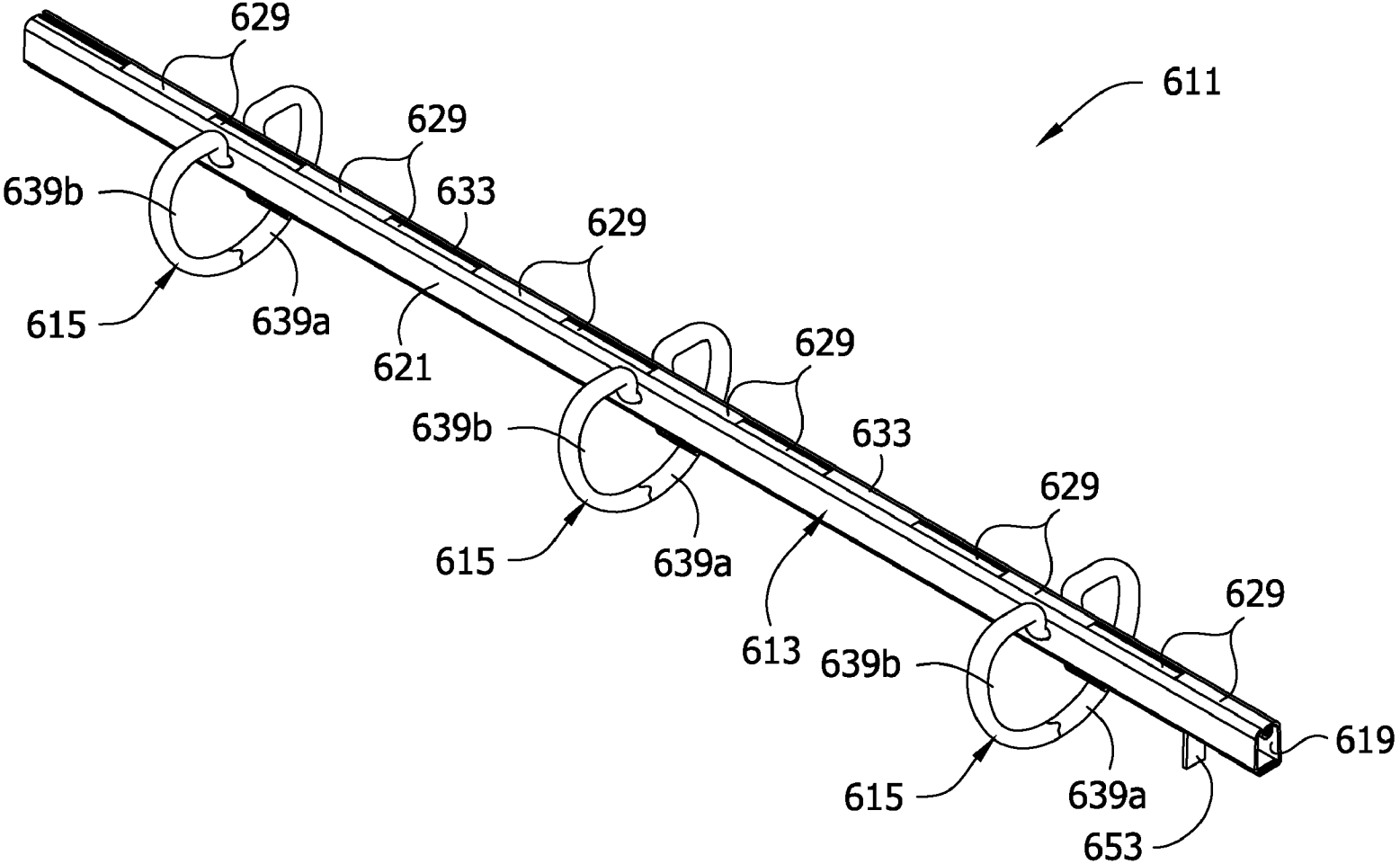
FIG. 32 is a bottom side perspective of the ring mechanism of FIG. 31.
Figure 33:
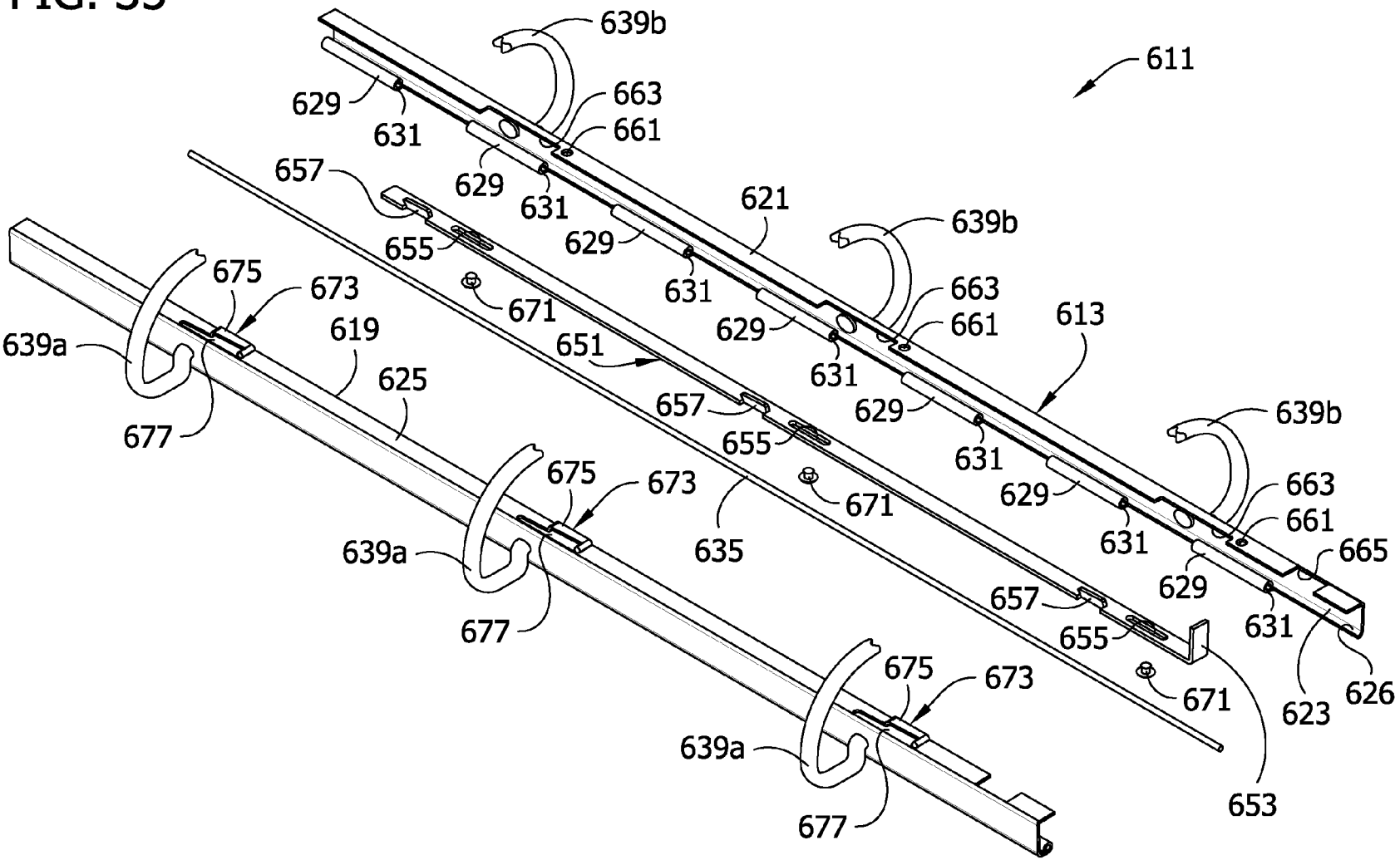
FIG. 33 is an exploded perspective thereof.

FIGS. 31-33 show a seventh embodiment of a ring mechanism 611 that is substantially the same as the mechanism 511 of FIGS. 23-30 except that the cutouts 537 are omitted from the frame and there are no springs 533. Parts of this mechanism 611 configuration are indicated by the same reference numbers as the mechanism 511 of FIGS. 23-30, plus "100".

Figure 34:
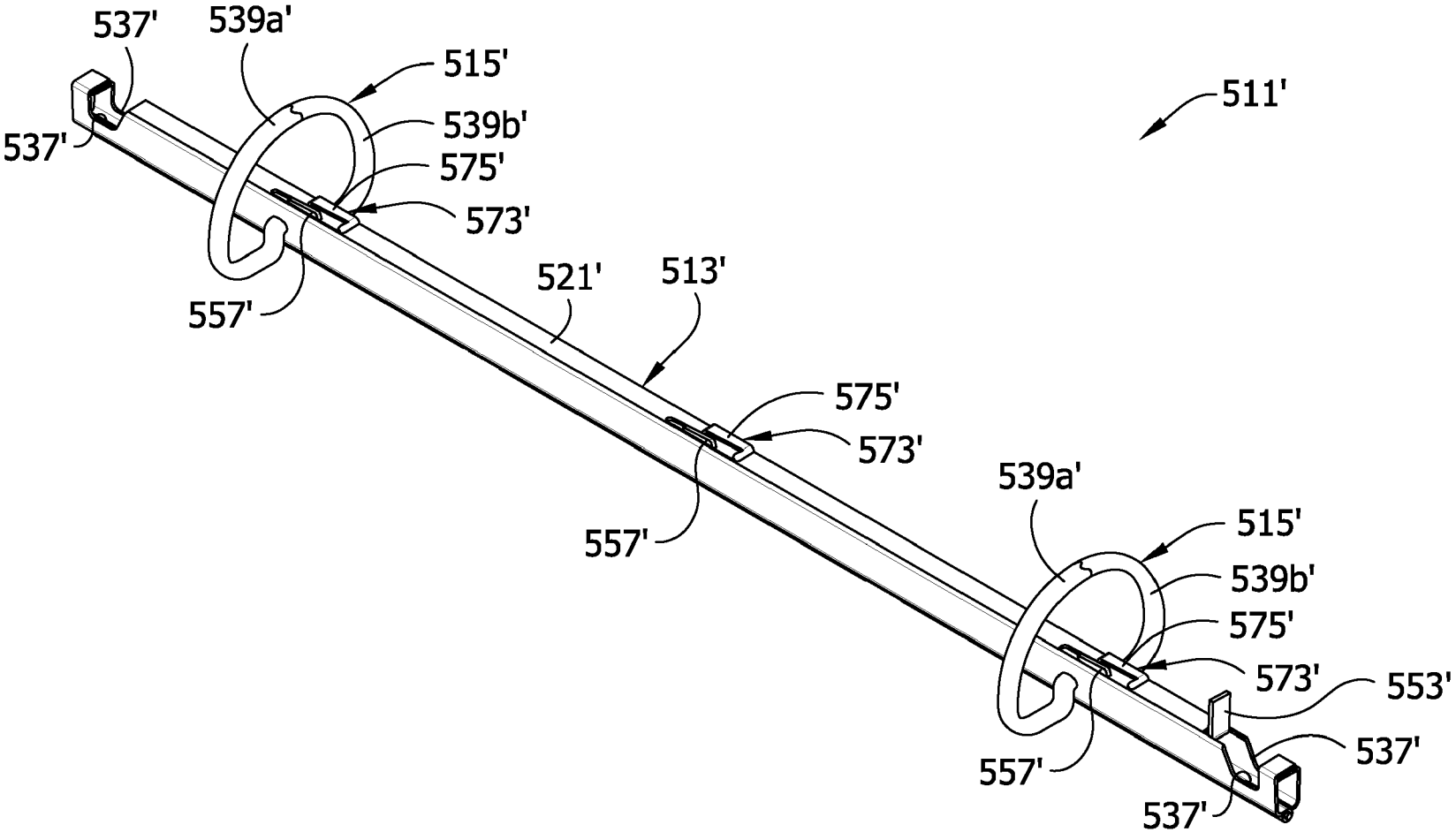
FIG. 34 is top side perspective of a modified version of the ring mechanism of FIG. 31 having two rings.
Figure 35:
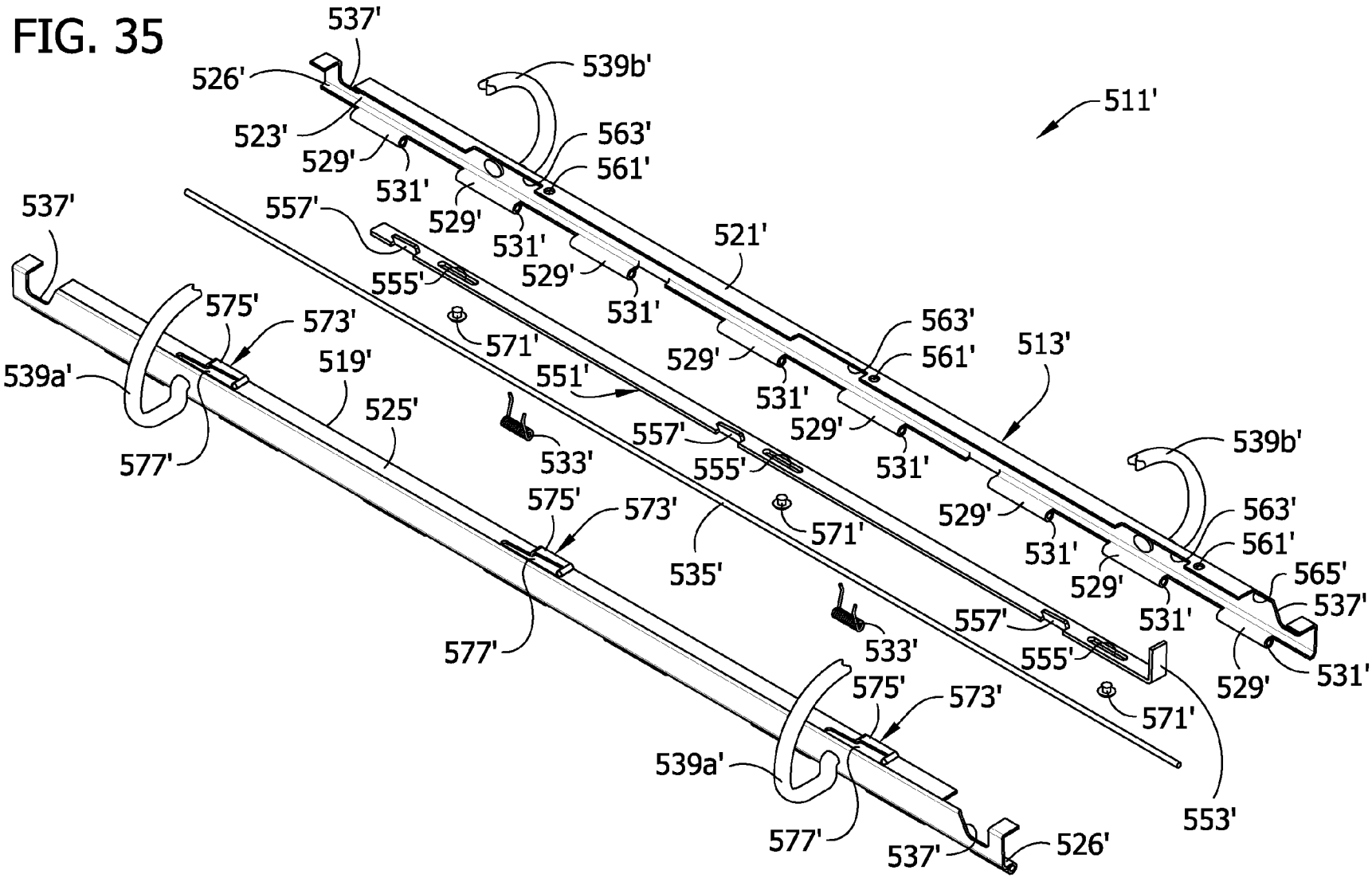
FIG. 35 is an exploded perspective of the ring mechanism of FIG. 34.
Figure 36:
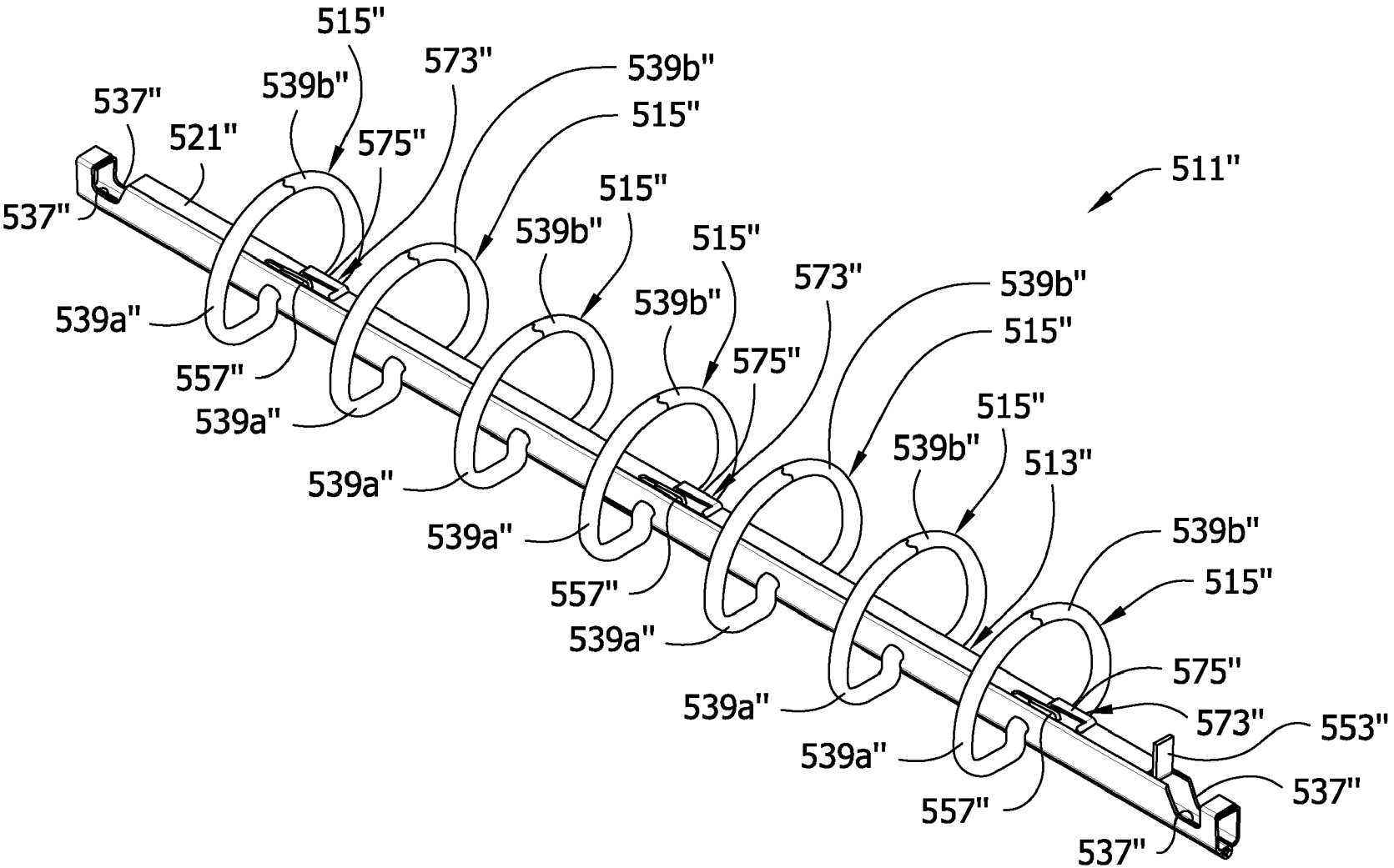
FIG. 36 is a top side perspective of another modified version of the ring mechanism of FIG. 31 having seven rings.
Figure 37:
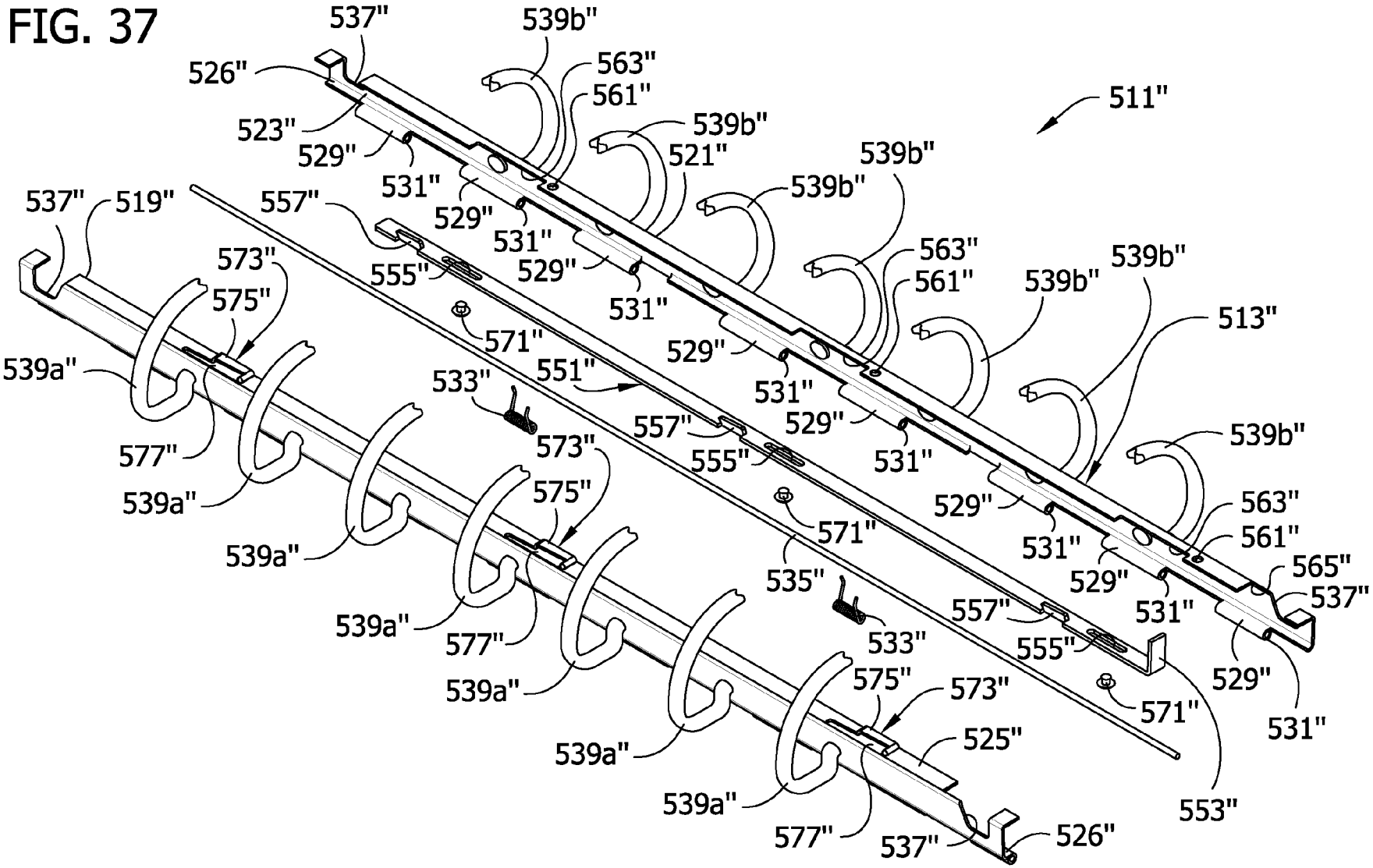
FIG. 37 is an exploded perspective of the ring mechanism of FIG. 36.

FIGS. 34 and 35 show a modified version of the ring mechanism of FIGS. 23-30 having two rings instead of three. Parts of this mechanism 511' configuration are indicated by the same reference numbers as the mechanism 511 of FIGS. 23-30, plus a prime. FIGS. 36 and 37 also show another modified version of the ring mechanism of FIGS. 23-30 having seven rings. Parts of this mechanism 511'' configuration are indicated by the same reference numbers as the mechanism 511 of FIGS. 23-30, plus a double prime. It is understood that each of the ring mechanisms described herein can be modified to have more or fewer rings.

Figure 38:
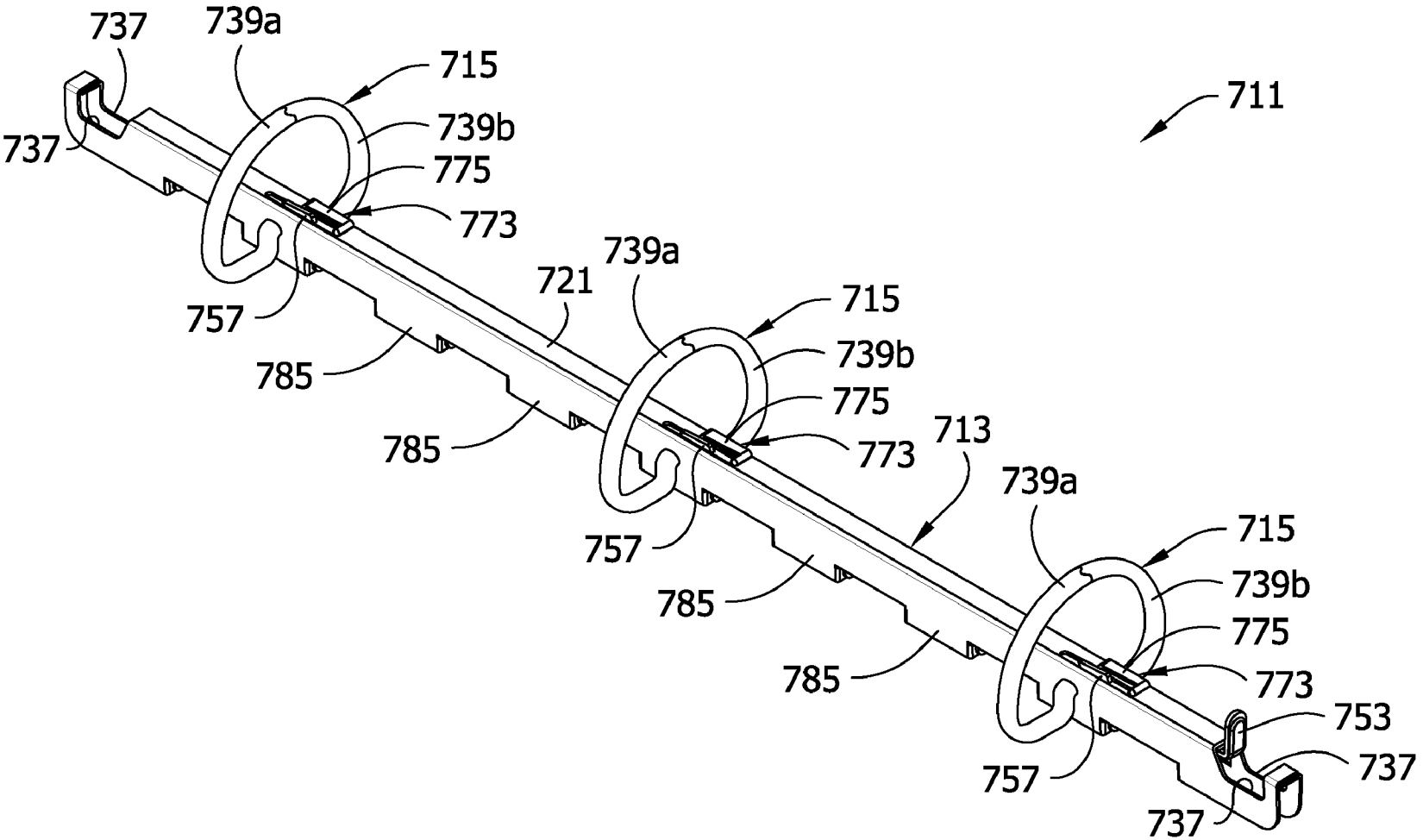
FIG. 38 is a top side perspective of a ring mechanism of a eighth configuration.
Figure 39:
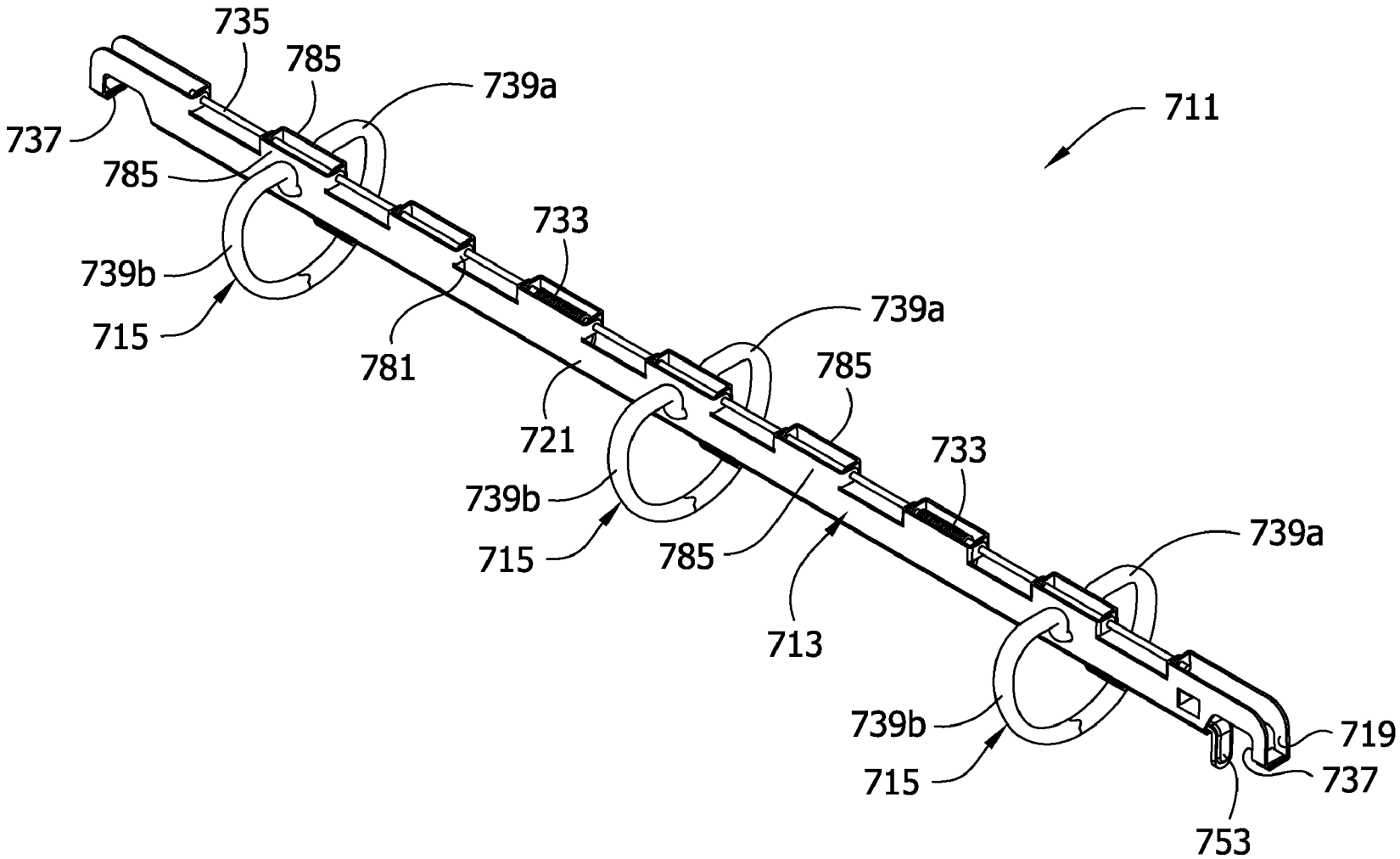
FIG. 39 is a bottom side perspective of the ring mechanism of FIG. 38.
Figure 40:
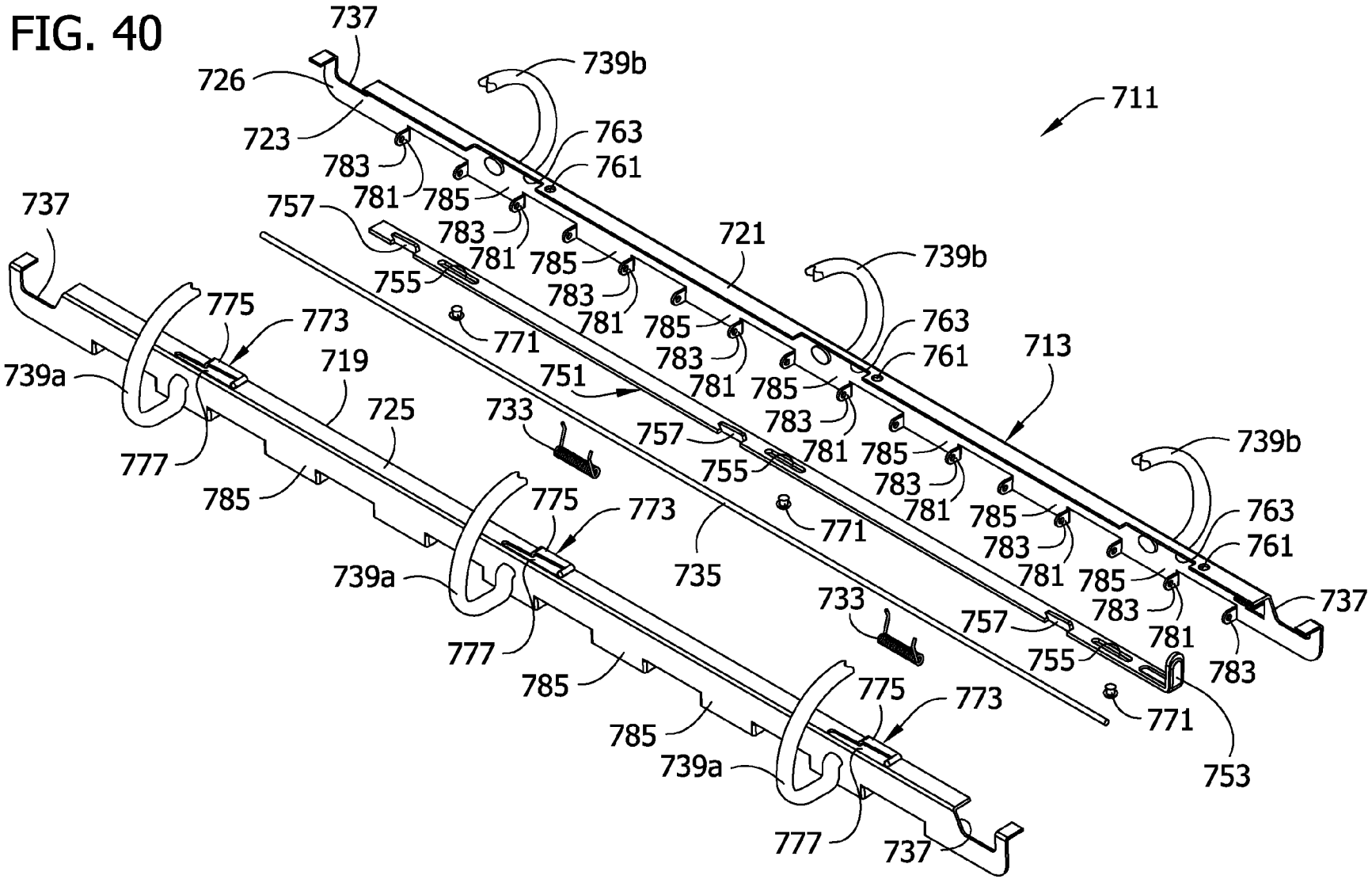
FIG. 40 is an exploded perspective thereof.

FIGS. 38-40 show an eighth embodiment of a ring mechanism 711. The ring mechanism of this embodiment is substantially similar to the ring mechanism of FIGS. 23-30 but the knuckles 529 supporting the hinge pin have been replaced with ears 781 (FIG. 40). Parts of this mechanism 711 are indicated by the same reference numbers as the mechanism 511 of FIGS. 23-30, plus "200".

First and second frame elements 719, 721 of this mechanism further comprise a plurality of ears 781 with openings 783 (FIGS. 39 and 40). The ears 781, which are thin and flat, are attached to longitudinally opposite ends of tabs 785 that extend outward from webs 723 of the first and second frame elements 719, 721. The ears 781 particularly project laterally outward from the tabs 785 and the first and second frame elements 719, 721. In other words, the tabs 785 lie in a plane generally perpendicular to a plane in which each of the webs 723 lies. The ears 781, tabs 785, and the associated frame element 719, 721 comprise a one-piece structure. However, the ears 781 and/or tabs 785 may be formed separate from the frame element 719, 721 and then connected to the element. Furthermore, the ears 781 and tabs 785 may have different configurations without departing from the scope of this invention.

The frame elements 719, 721 are positioned relative to each other in a lengthwise direction so that the ears 781 of the first element 719 are aligned with the ears of the second element 721. More specifically, the pairs of ears 781 on one of the elements 719, 721 are received between ears on the other element (FIG. 39). A hinge pin 735 is received through the openings 783 in the ears 781 to hinge the first and second frame elements 719, 721 to each other. Thus, the frame elements can pivot on the hinge pin 735 relative to each other between a closed position and an open position.

FIGS. 41-48 show a ninth embodiment of a ring mechanism 811 that is substantially similar to the ring mechanism 711 of FIG. 38-40 but having a retractable hanging member, indicated generally at 891. In this configuration, the mechanism 811 has two hanging members 891 that are selectively received in a frame 813 of the mechanism and are slidably mounted on a hinge pin 835. The hanging member 891 is slidable between a retracted position (FIGS. 41 and 42) wherein the hanging member is received in the frame 813 (i.e., between first and second frame elements 819, 821), and an extended position (FIGS. 47 and 48) wherein a portion of the hanging member extends longitudinally outward from the frame. The hanging member 891 includes a generally U-shaped recess 893 for engaging and thereby supporting the mechanism 811 on the support.

Figure 41:
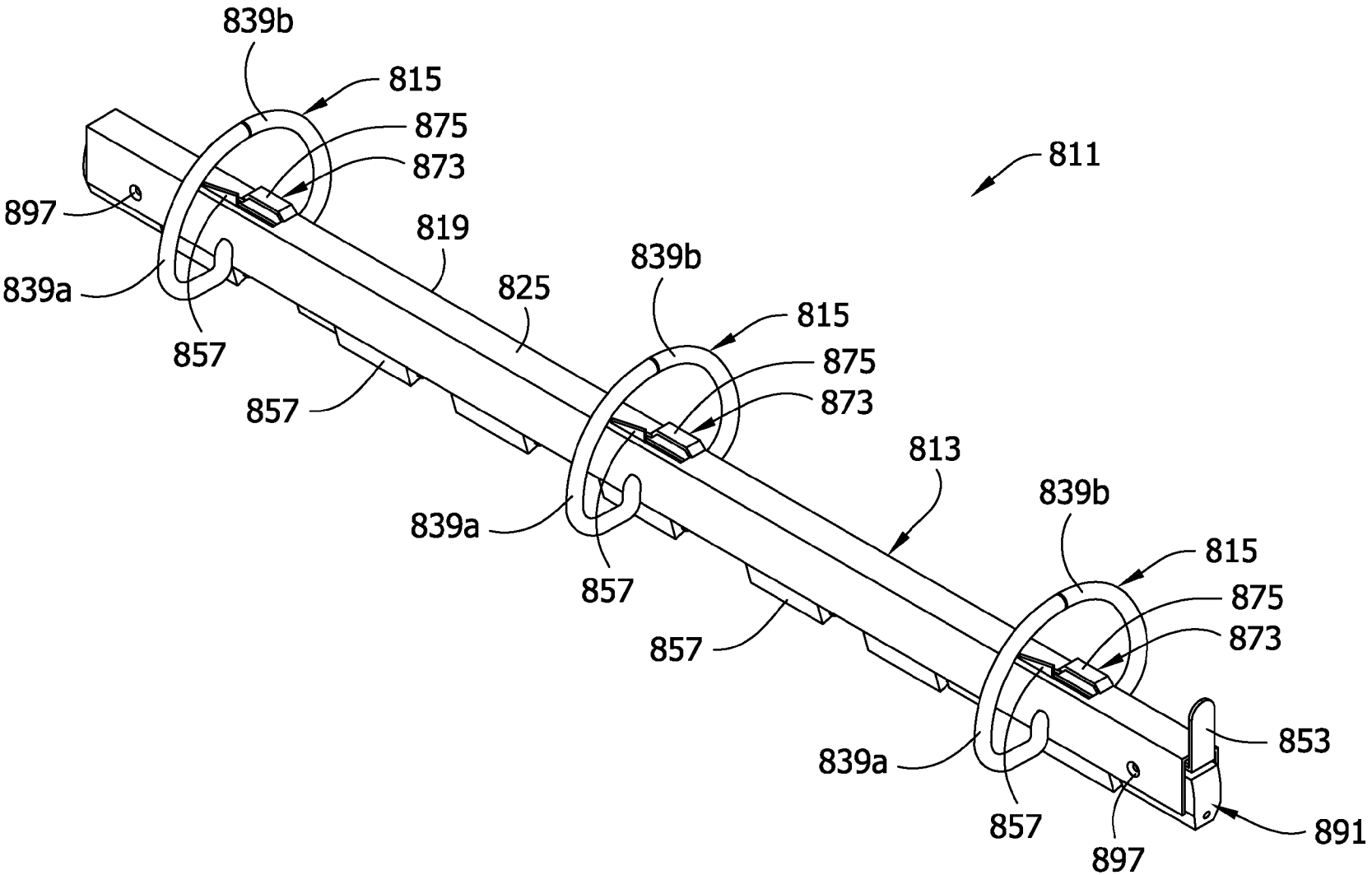
FIG. 41 is a top side perspective of a ring mechanism of a ninth embodiment.
Figure 42:
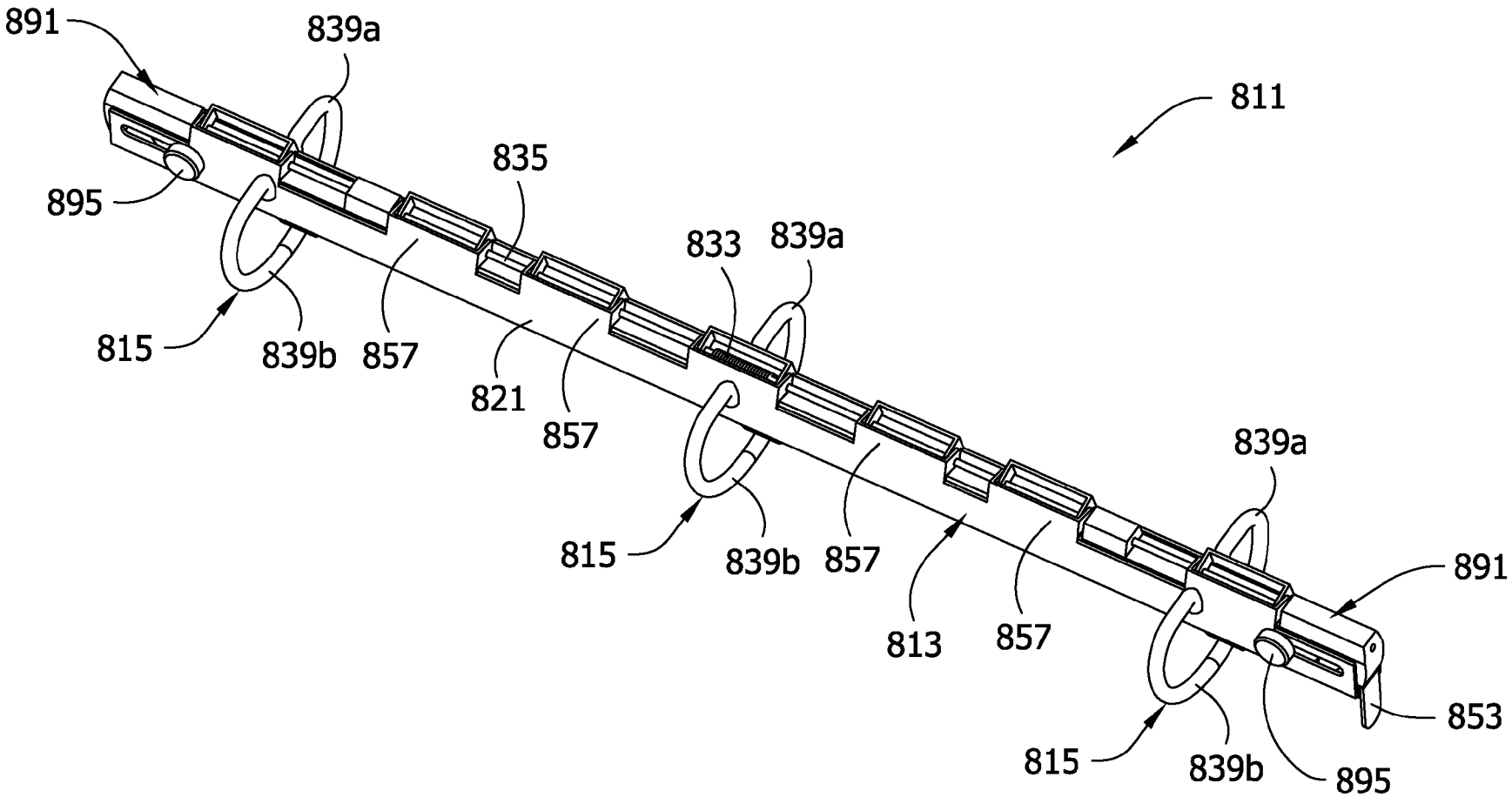
FIG. 42 is a bottom side perspective of the ring mechanism of FIG. 41.
Figure 43:
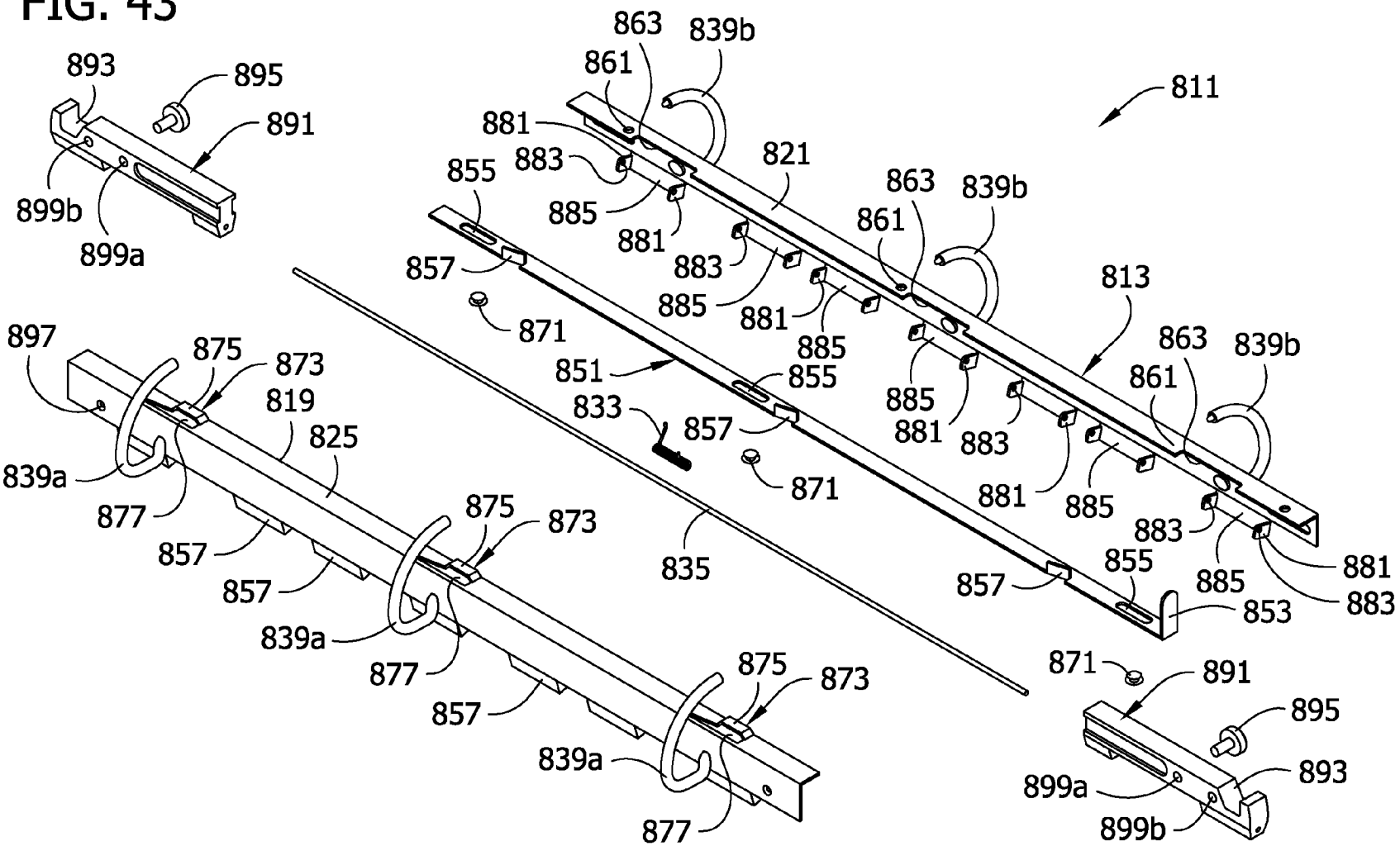
FIG. 43 is an exploded perspective thereof.
Figure 44:
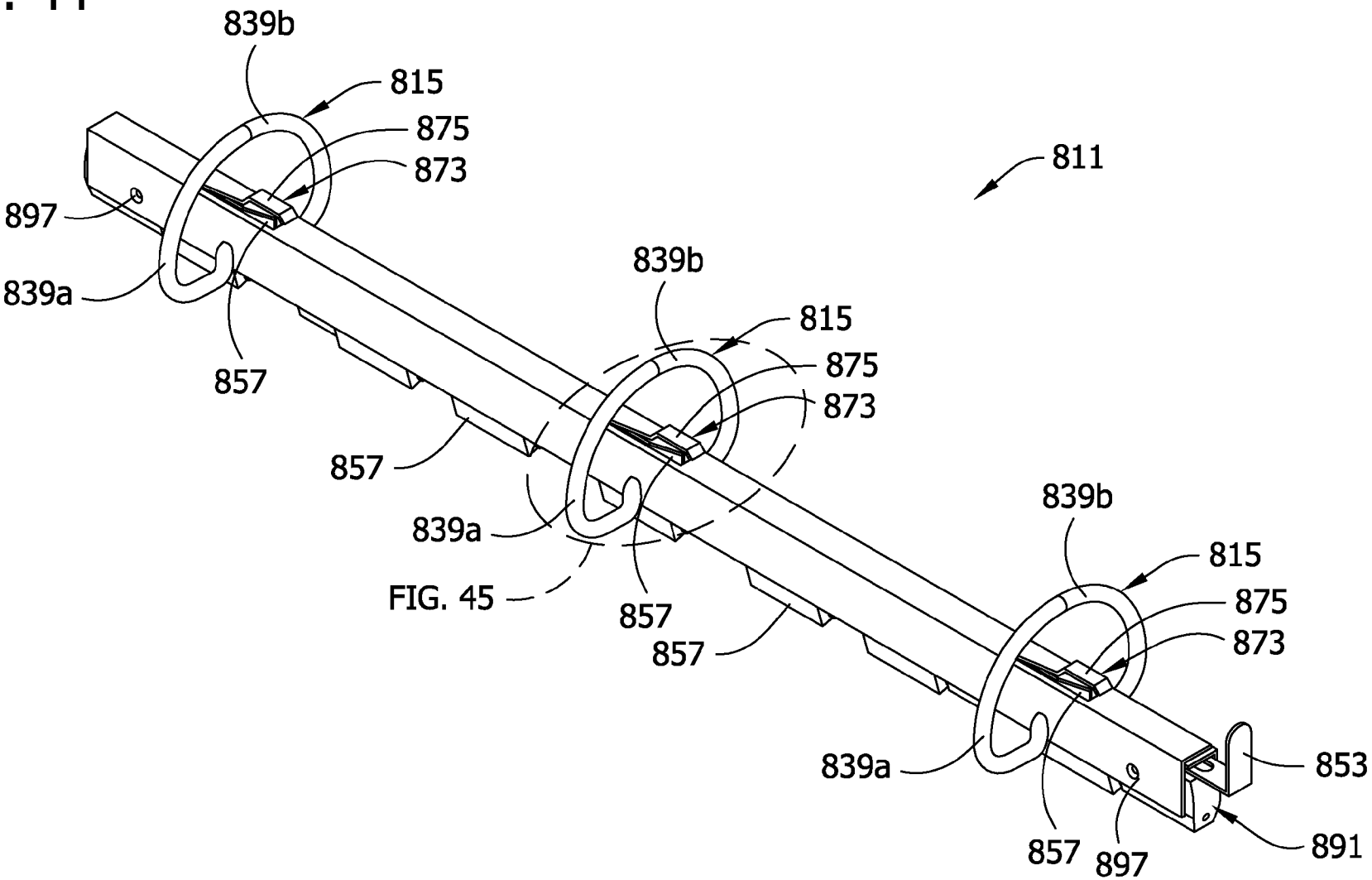
FIG. 44 is similar to FIG. 41 but showing a locking device in an unlocked position.
Figure 45:
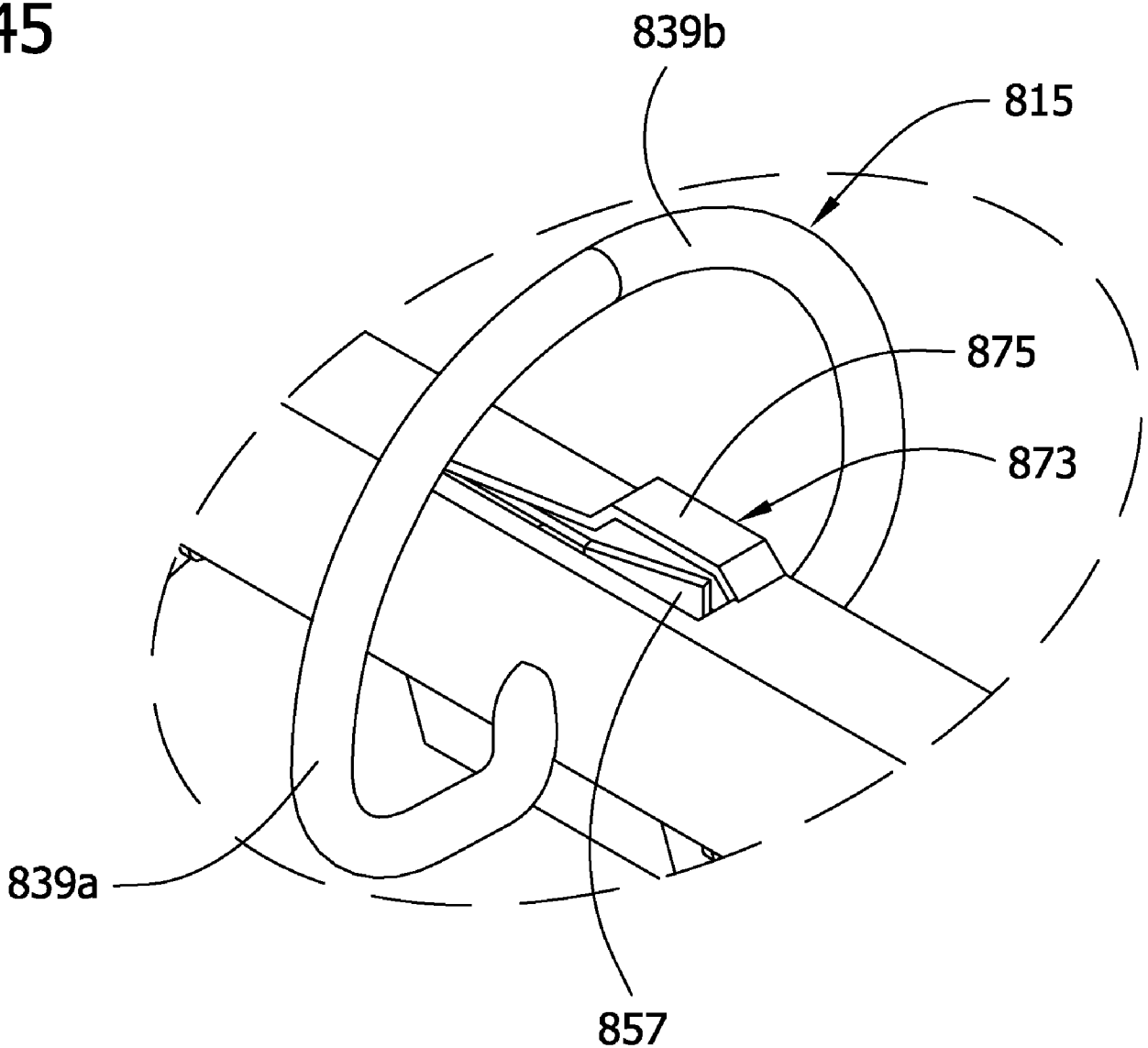
FIG. 45 is an enlarged view of the locking device in the unlocked position.
Figure 46:
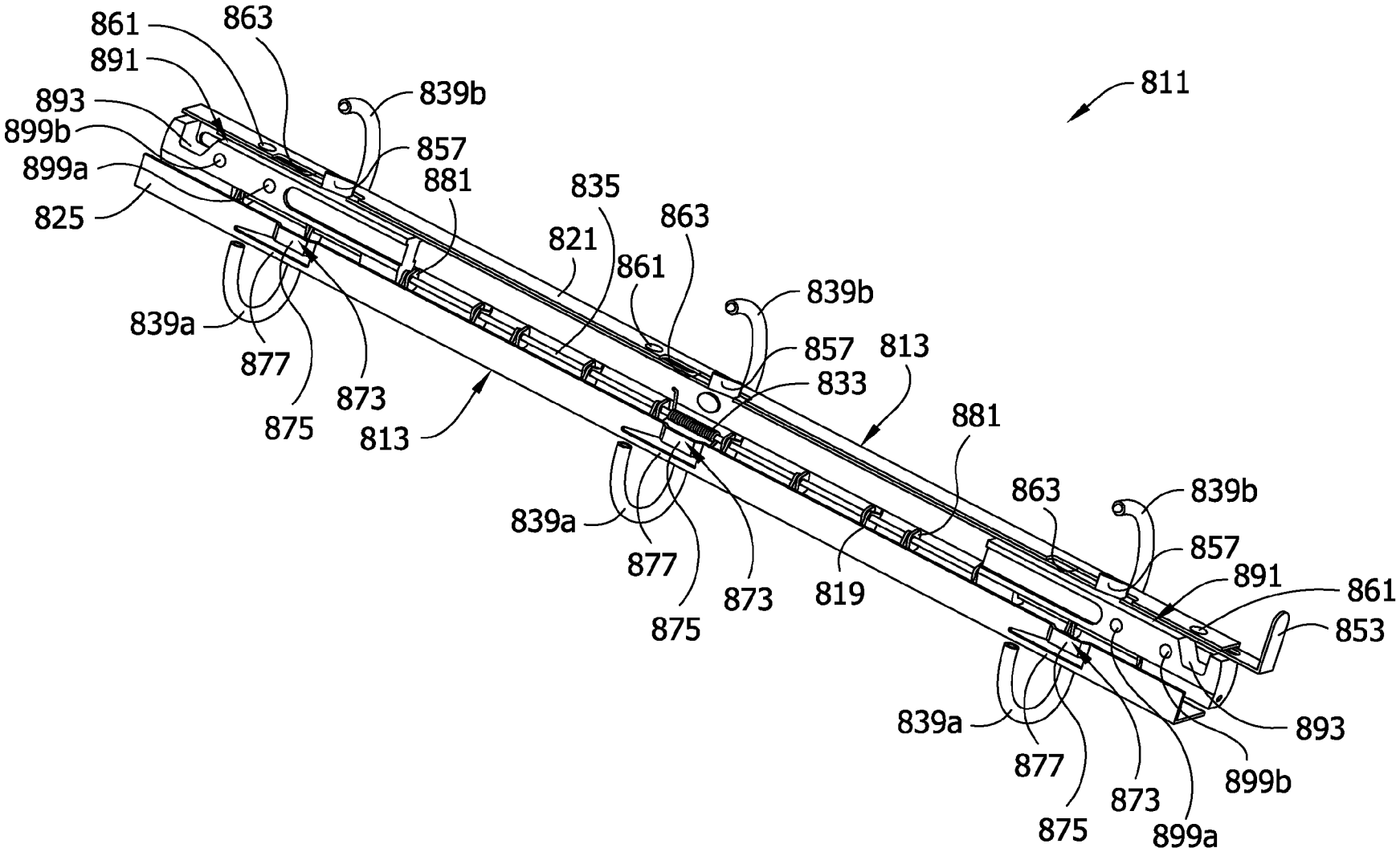
FIG. 46 is a top side perspective of the ring mechanism in an open position.
Figure 47:
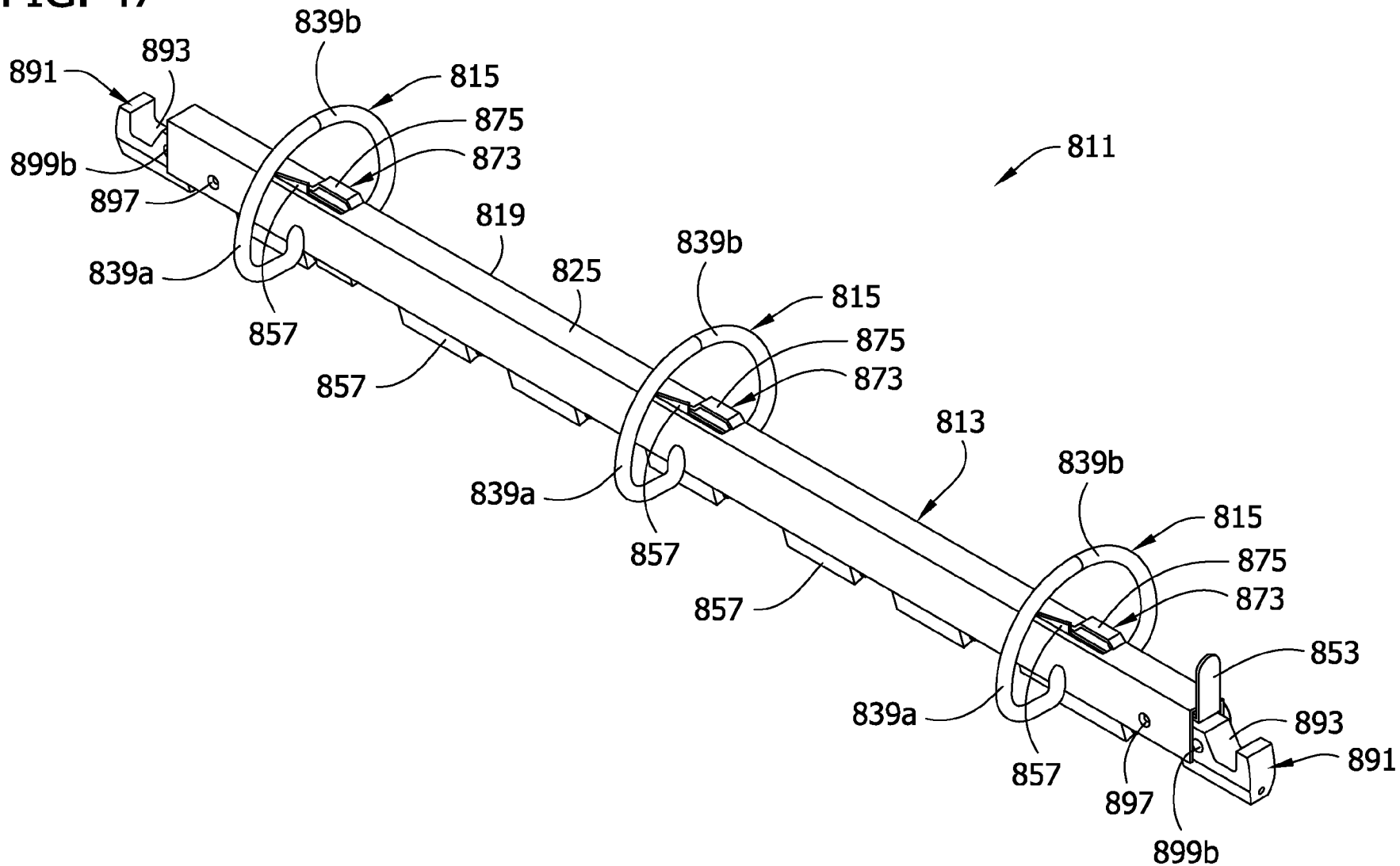
FIG. 47 is similar to FIG. 41 but showing a pair of hanging members in an extended position.
Figure 48:
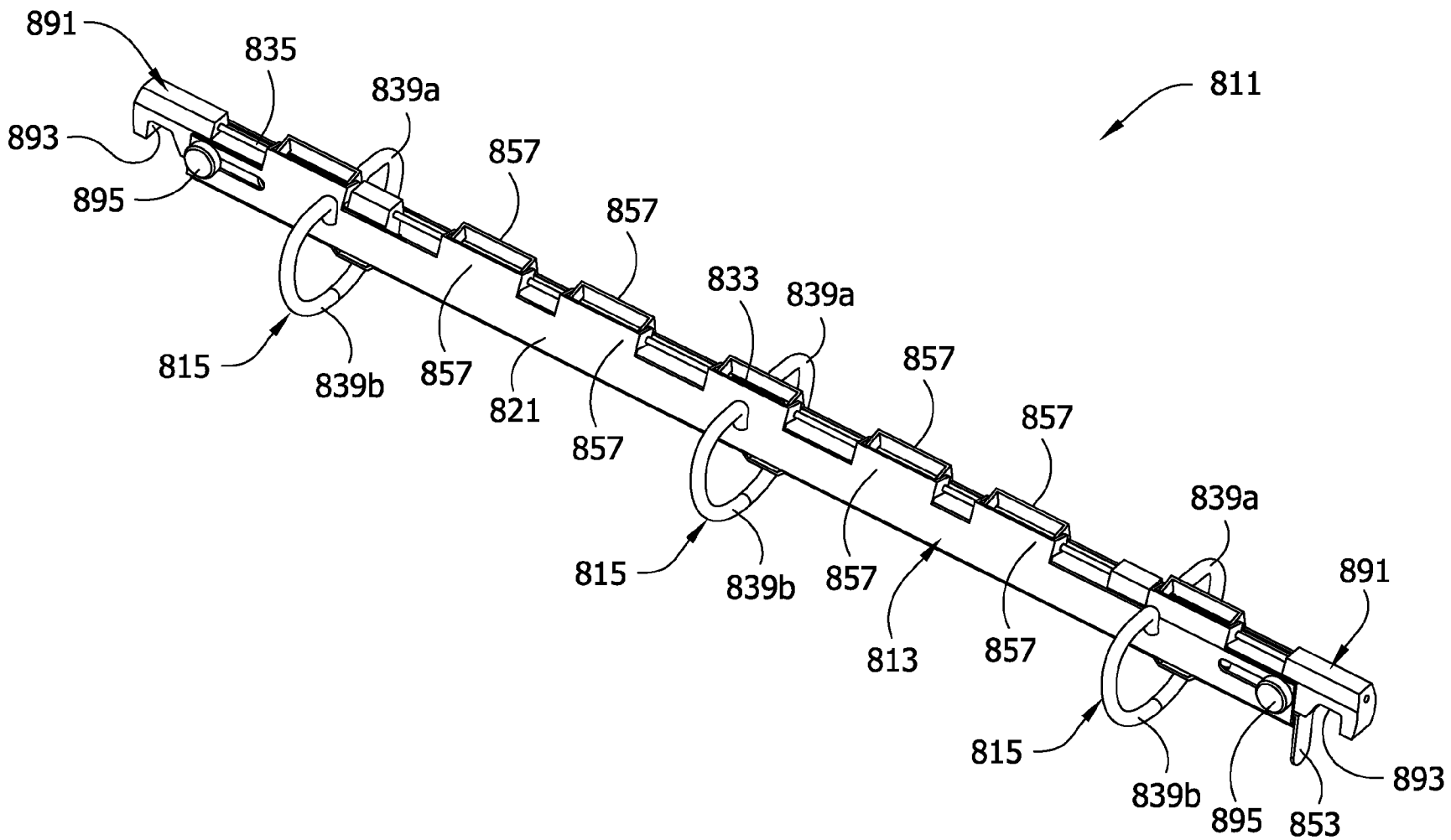
FIG. 48 is a bottom side perspective of the ring mechanism with the hanging members in the extended position.

A knob 895 is operatively connected to each of the hanging members 891 and slidably connected to the second frame element 821. The knob 895 can be grasped for manually sliding the respective hanging member 891 between the retracted and extended positions. In addition, the first frame element 819 includes two nubs and each of the hanging members includes two recesses 899*a*, 899*b* for engagement with the respective nub. Only the backsides, which correspond to recesses 897, of the nubs are shown in the drawings (FIGS. 41, 44 and 47). The nubs in the first frame element 819 and recesses 899*a*, 899*b* in the hanging members 891 cooperate to hold the hanging members in the retracted and extended position. More specifically, one of the nubs 899*a* corresponds to the retracted position and the other nub 899*b* corresponds to the extended position. Parts of this mechanism 811 configuration are indicated by the same reference numbers as the mechanism 511 of FIGS. 31-33, plus "300".

Figure 49:
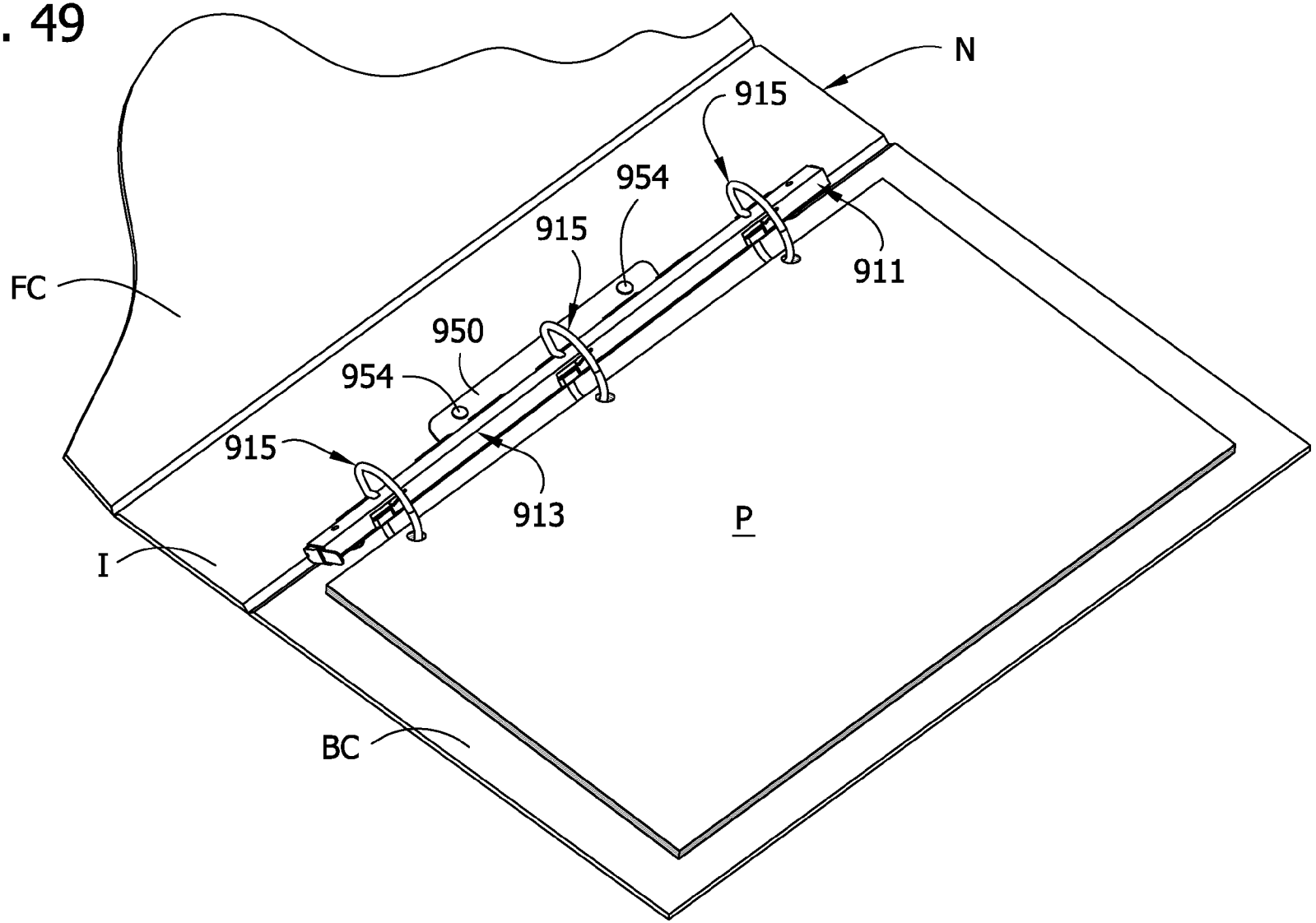
FIG. 49 is a fragmentary perspective of a notebook having a ring mechanism of a tenth embodiment.
Figure 50:
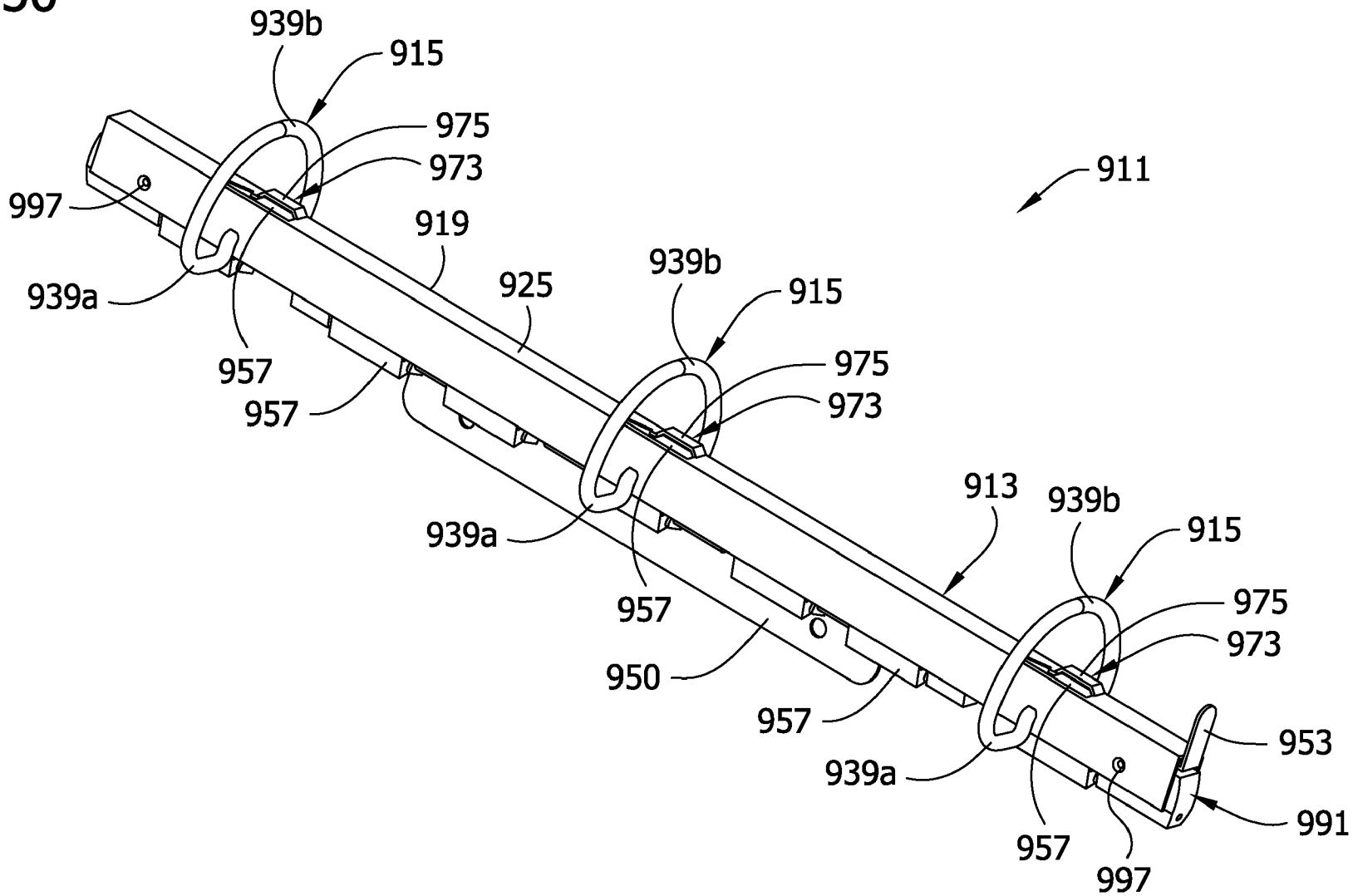
FIG. 50 is a top side perspective of the ring mechanism of FIG. 49.
Figure 51:
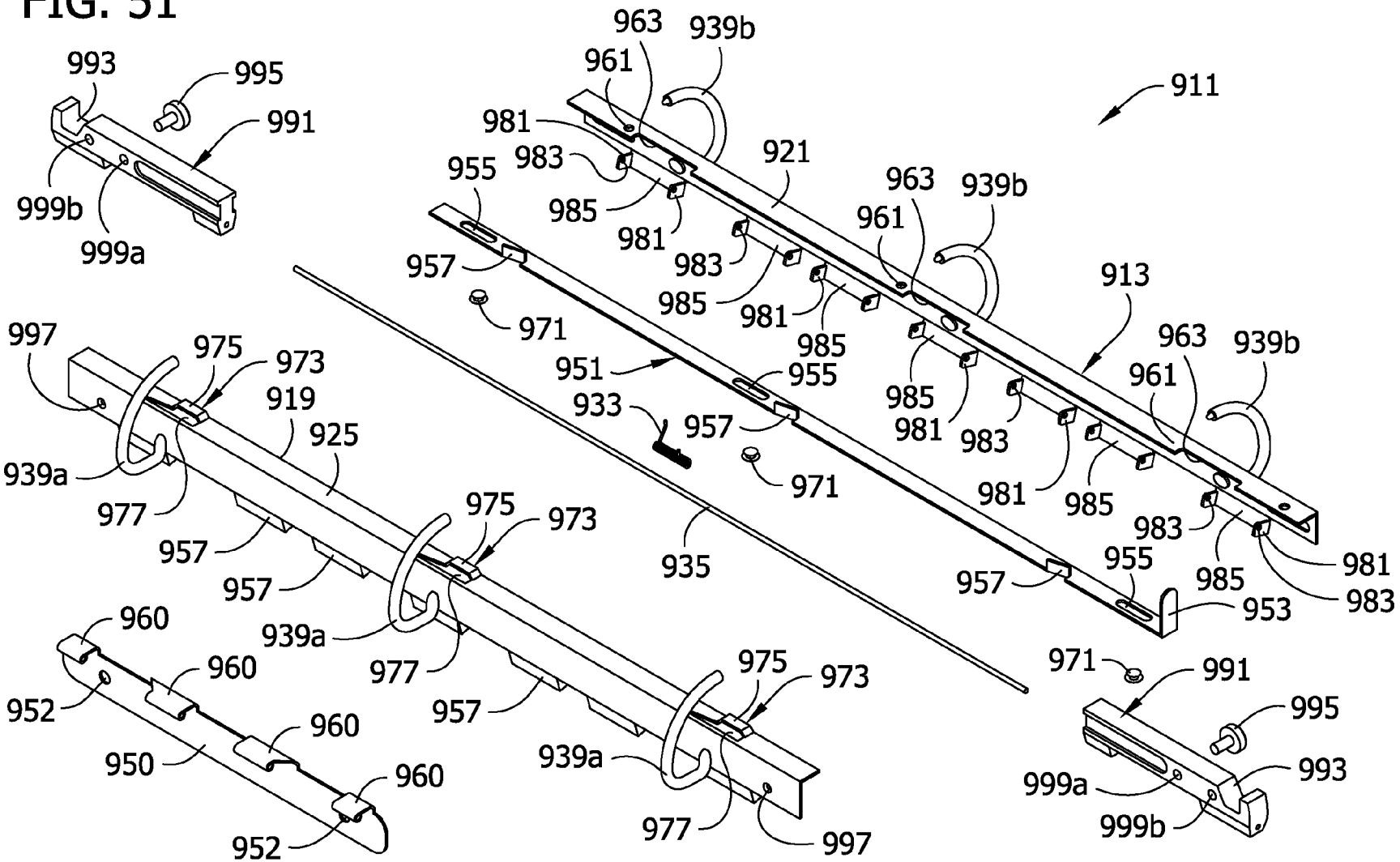
FIG. 51 is an exploded perspective thereof.

FIGS. 49-51 illustrate a ring mechanism 911 of a tenth embodiment. This ring mechanism 911 is substantially similar to the ring mechanism 811 of FIGS. 41-48 but with a bracket 950 for mounting the ring mechanism 911 to a notebook, indicated generally at N. Parts of this mechanism 911 are indicated by the same reference numbers as the mechanism 811 of FIGS. 41-48, plus "100".

In this embodiment, a frame 913 of the ring mechanism 911 is pivotally connected to the bracket 950 used to mount the mechanism on the notebook N (FIG. 49). Specifically, the illustrated bracket 950 has two, spaced apart apertures 952 (FIG. 51) for receiving fasteners 954 (e.g., rivets, which are shown in FIG. 49) for mounting the bracket on the notebook N. The mechanism 911 is shown mounted on a spine I of the notebook N. The notebook has a front cover FC (partially shown) and a back cover BC hingedly attached to the spine I. While the ring mechanism 911 is shown mounted on the spine I of the notebook N, the mechanism can be mounted on the front cover FC, the back cover BC, or other structures besides the notebook without departing from the scope of this invention. The front and back covers FC, BC of the notebook N are adapted to move to selectively cover or expose the loose-leaf pages P retained by the ring mechanism 911.

The bracket 950 is a generally planer sheet metal member having a length less than a length of the frame 913 but it is understood that the bracket can have a length equal to or greater than the frame. The bracket 950 includes, along one of its side edges, a plurality of spaced knuckles 960 (FIG. 51). The knuckles 960 are formed by rolling an edge or a portion of an edge of the sheet metal member into a tube. The knuckles 960 are aligned with ears 981 of first and second frame elements 919, 921 and receive a hinge pin 935. As a result, the frame 913 can be pivoted about the hinge pin 935 relative to the bracket 950. In the illustrated configuration, the bracket 950 is made of a sheet metal material but can be made from materials other than sheet metal without departing from the scope of this invention. It is also understood that the bracket 950 can be formed in a variety of shapes and sizes without departing from the scope of this invention.

It is understood that the various features discussed above in relation to any one of the illustrated ring mechanisms may be incorporated into any of the other above-described ring mechanisms. It is also understood that the hinge elements may be formed other than as frame elements, e.g., suitable elongate structure capable of mounting the rings and a hinge connection and more suitably hinge plates which are commonly used in other ring mechanisms.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What claimed is:

1. A ring mechanism for retaining loose leaf pages, the ring mechanism being selectively configurable between an open configuration in which loose leaf pages can be added or removed from the mechanism and a closed configuration in which loose leaf pages are retained by the ring mechanism, the ring mechanism being supportable on at least one support member, said ring mechanism comprising:

an elongate frame having a longitudinal axis and comprising an elongate first frame element and an elongate second frame element separate from the first frame element, and hinged thereto to permit pivoting movement of said frame elements relative to each other about an axis extending one of parallel to and coaxial with the longitudinal axis of said frame between a first position corresponding to the closed configuration of the ring mechanism and a second position different from the first position and corresponding to the open configuration of the ring mechanism;

at least one ring comprising a first ring member mounted on the first frame element and having a free end and a second ring member mounted on the second frame element and having a free end such that in the first position of said frame elements corresponding to the closed configuration of the ring mechanism the free ends of the first and second ring members are adjacent one another and the first and second ring members together form a substantially continuous, closed loop for allowing loose-leaf pages retained by the ring to be moved along the ring from one ring member to the other, and in the second position of said frame elements corresponding to the open configuration of the ring mechanism the free ends of the ring members are spaced from each other to form a discontinuous, open loop for adding or removing loose-leaf pages from the ring; and at least one hanging member on said frame for releasably hanging the ring mechanism from the support when the ring members are in the closed configuration so the free ends of the ring members are substantially underneath the frame, the hanging member comprising a cutout in each of the first and second frame elements, the cutouts being spaced apart in the second position of the frame elements and adjacent each other in the first position of the frame elements for conjointly receiving the support in the cutouts, said hanging member being configured to inhibit longitudinal movement of the hanging member relative to the support.

2. The ring mechanism as set forth in claim 1 further comprising a biasing member for biasing the first and second hinge elements toward the open configuration of the ring mechanism.

3. The ring mechanism as set forth in claim 2 wherein the biasing member is a torsion spring.

4. The ring mechanism as set forth in claim 1 further comprising a hinge pin interconnecting the first and second frame elements.

5. The ring mechanism as set forth in claim 4 wherein the first and second frame elements define an interior space of the frame, the hinge pin being disposed in the interior space of the frame in the closed configuration of the ring mechanism.

6. The ring mechanism as set forth in claim 5 wherein the first and second frame elements include knuckles for receiving the hinge pin.

7. The ring mechanism as set forth in claim 6 wherein the knuckles are formed as one piece with respective ones of the first and second frame elements.

8. The ring mechanism as set forth in claim 5 wherein the first and second frame elements include ears for receiving the hinge pin.

9. The ring mechanism as set forth in claim 8 wherein the ears are formed as one piece with respective ones of the first and second frame elements.

10. The ring mechanism as set forth in claim 4 wherein the first and second frame elements define an interior space of the frame, the hinge pin being disposed externally of the interior space of the frame in the closed configuration of the ring mechanism.

11. The ring mechanism as set forth in claim 10 wherein the first and second frame elements include knuckles for receiving the hinge pin.

12. The ring mechanism as set forth in claim 11 wherein the knuckles are formed as one piece with respective ones of the first and second frame elements.

13. The ring mechanism as set forth in claim 10 wherein the first and second frame elements include ears for receiving the hinge pin.

14. The ring mechanism as set forth in claim 13 wherein the ears are formed as one piece with respective ones of the first and second frame elements.

15. The ring mechanism as set forth in claim 4 wherein the first and second frame elements have interconnected knuckles, the hinge pin being received in the interconnected knuckles of the first and second frame elements and thereby interconnecting the first and second frame elements.

16. A ring mechanism for retaining loose leaf pages, the ring mechanism being selectively configurable between an open configuration in which loose leaf pages can be added or removed from the mechanism and a closed configuration in which loose leaf pages are retained by the ring mechanism, the ring mechanism being supportable on at least one support member, said ring mechanism comprising:

an elongate frame having a longitudinal axis and comprising an elongate first frame element and an elongate second frame element separate from the first frame element, and hinged thereto to permit pivoting movement of said frame elements relative to each other about an axis extending one of parallel to and coaxial with the longitudinal axis of said frame between a first position corresponding to the closed configuration of the ring mechanism and a second position different from the first position and corresponding to the open configuration of the ring mechanism;

at least one ring comprising a first ring member mounted on the first frame element and a second ring member mounted on the second frame element such that in the first position of said frame elements corresponding to the closed configuration of the ring mechanism the first and second ring members together form a substantially continuous, closed loop for allowing loose-leaf pages retained by the ring to be moved along the ring from one ring member to the other, and in the second position of said frame elements corresponding to the open configuration of the ring mechanism the ring members are spaced from each other to form a discontinuous, open loop for adding or removing loose-leaf pages from the ring;

at least one hanging member mounted on said frame for releasably hanging the ring mechanism from the support, said hanging member being configured to inhibit longitudinal movement of the hanging member relative to the support; and a locking device moveable relative to at least one of the first and second frame elements for locking the first and second frame elements in the first position, the locking device comprising a lock bar slidably mounted on one of the first and second frame elements for movement between a locked position in which the lock bar is positioned to hold the frame elements in the first position, and an unlocked position in which the lock bar permits the first and second frame elements to pivot to the second position, the lock bar being mounted on the second frame element, and the first frame element comprises at least one catch for engagement with the lock bar in the locked position.

17. The ring mechanism as set forth in claim 16 wherein the lock bar includes a tab for being captured by the catch of the first frame element.

18. The ring mechanism as set forth in claim 16 wherein the locking device comprises engageable hook-shaped formations formed on the free ends of the first and second ring members.

19. The ring mechanism as set forth in claim 18 wherein at least one of the first and second ring members is sufficiently resiliently deformable for allowing the hook-shaped formations to be engaged and disengaged.

20. A ring mechanism for retaining loose leaf pages, the ring mechanism being selectively configurable between an open configuration in which loose leaf pages can be added or removed from the mechanism and a closed configuration in which loose leaf pages are retained by the ring mechanism, the ring mechanism being supportable on at least one support member, said ring mechanism comprising:

an elongate frame having a longitudinal axis and comprising an elongate first hinge element and an elongate second hinge element separate from the first hinge element, and hinged thereto to permit pivoting movement of said hinge elements relative to each other about an axis extending one of parallel to and coaxial with the longitudinal axis of said frame between a first position corresponding to the closed configuration of the ring mechanism and a second position different from the first position and corresponding to the open configuration of the ring mechanism;

at least one ring comprising a first ring member mounted on the first hinge element and a second ring member mounted on the second hinge element such that in the first position of said hinge elements corresponding to the closed configuration of the ring mechanism the first and second ring members together form a substantially continuous, closed loop for allowing loose-leaf pages retained by the ring to be moved along the ring from one ring member to the other, and in the second position of said hinge elements corresponding to the open configuration of the ring mechanism the ring members are spaced from each other to form a discontinuous, open loop for adding or removing loose-leaf pages from the ring; and at least one hanging member mounted on said frame for releasably hanging the ring mechanism from the support, said hanging member being configured to inhibit longitudinal movement of the hanging member relative to the support;

a bracket for use in mounting the frame on a base structure; and a hinge pin interconnecting the first and second frame elements, wherein the bracket is adapted to receive the hinge pin to connect the frame to the bracket.

* * * * *